US012213552B2

(12) United States Patent
Neubauer et al.

(10) Patent No.: US 12,213,552 B2
(45) Date of Patent: Feb. 4, 2025

(54) HELMET SYSTEM

(71) Applicant: VICIS IP, LLC, Seattle, WA (US)

(72) Inventors: Jason Neubauer, Seattle, WA (US); Noah Lanphear, Seattle, WA (US); Travis E. Glover, Seattle, WA (US); Dave Marver, New York, NY (US); Cord Santiago, Seattle, WA (US); Kayla Fukuda, Seattle, WA (US); Andre H. P. Stone, New York, NY (US); Adam Kollgaard, Seattle, WA (US); Kurt Fischer, Seattle, WA (US); Marie Pahlmeyer, Seattle, WA (US); Rich Curren, New York, NY (US); Miguel Herrera, New York, NY (US); John Cagle, Seattle, WA (US)

(73) Assignee: VICIS IP, LLC, New York, NY (US)

( * ) Notice: Subject to any disclaimer, the term of this patent is extended or adjusted under 35 U.S.C. 154(b) by 181 days.

(21) Appl. No.: 18/184,263

(22) Filed: Mar. 15, 2023

(65) Prior Publication Data

US 2024/0049827 A1 Feb. 15, 2024

Related U.S. Application Data

(63) Continuation of application No. 16/918,773, filed on Jul. 1, 2020, now Pat. No. 11,606,999.

(60) Provisional application No. 62/895,978, filed on Sep. 4, 2019, provisional application No. 62/869,192, filed on Jul. 1, 2019.

(51) Int. Cl.
*A42B 3/06* (2006.01)

(52) U.S. Cl.
CPC ..... *A42B 3/063* (2013.01)

(58) Field of Classification Search
CPC .. A42B 3/063; A42B 3/06; A42B 3/10; A42B 3/124; A41D 13/0156
See application file for complete search history.

(56) References Cited

U.S. PATENT DOCUMENTS

| | | | |
|---|---|---|---|
| 6,871,525 | B2 | 3/2005 | Withnall et al. |
| 8,528,118 | B2 | 9/2013 | Ide et al. |
| D752,822 | S | 3/2016 | Bologna |
| D787,748 | S | 5/2017 | Bologna |
| 9,788,591 | B2 | 10/2017 | Ide et al. |
| 10,136,692 | B2 | 11/2018 | Ide et al. |
| 10,159,296 | B2 | 12/2018 | Pietrzak et al. |
| D844,255 | S | 3/2019 | Bologna |
| 10,271,605 | B2 | 4/2019 | Withnall et al. |
| 10,362,829 | B2 | 7/2019 | Lowe |
| D856,600 | S | 8/2019 | Withnall et al. |

(Continued)

*Primary Examiner* — Tajash D Patel
(74) *Attorney, Agent, or Firm* — Lorenz & Kopf, LLP

(57) ABSTRACT

Protective clothing and/or equipment may comprise a modular helmet assembly which comprises a plurality of impact mitigation modules positioned between an outer layer and an interior layer of the helmet, optionally with a plurality of perforations or openings in an outer shell of the helmet. The plurality of impact mitigation assemblies may comprise an impact absorbing array of impact mitigation structures having at least one filament and a lateral support wall or connecting element. When force is applied to the exterior surface, the structures of the impact absorbing materials deform in a desired and controlled manner, reducing the force received by the interior layer.

20 Claims, 53 Drawing Sheets

(56) References Cited

U.S. PATENT DOCUMENTS

| | | | | |
|---|---|---|---|---|
| 10,506,841 | B2 | 12/2019 | Bologna et al. | |
| 10,561,193 | B2 | 2/2020 | Withnall et al. | |
| 10,780,338 | B1 | 9/2020 | Bologna et al. | |
| 10,856,600 | B2 | 12/2020 | Ide et al. | |
| 10,932,514 | B2 | 3/2021 | Ide et al. | |
| 10,948,898 | B1 | 3/2021 | Pietrzak et al. | |
| D916,385 | S | 4/2021 | Withnall et al. | |
| D927,084 | S | 8/2021 | Bologna et al. | |
| 11,166,511 | B2 | 11/2021 | Infusing et al. | |
| 11,167,198 | B2 | 11/2021 | Bologna et al. | |
| 11,213,736 | B2 | 1/2022 | Bologna et al. | |
| 11,291,263 | B2 | 4/2022 | Lowe | |
| 11,311,067 | B2 | 4/2022 | Bologna et al. | |
| 11,399,589 | B2 | 8/2022 | Bologna et al. | |
| 11,419,383 | B2 | 8/2022 | Pietrzak et al. | |
| 11,503,872 | B2 | 11/2022 | Bologna et al. | |
| 11,606,999 | B2 * | 3/2023 | Neubauer | A42B 3/063 |
| 11,638,457 | B2 | 5/2023 | Lowe | |
| 11,712,615 | B2 | 8/2023 | Bologna et al. | |
| 12,121,095 | B1 * | 10/2024 | Leon | A42B 3/127 |
| 2019/0145877 | A1 * | 5/2019 | Chan | A42B 3/046 73/818 |
| 2021/0187897 | A1 * | 6/2021 | Reinhall | B32B 27/08 |
| 2023/0320450 | A1 * | 10/2023 | Wiart | A42B 3/12 |
| 2023/0354944 | A1 * | 11/2023 | Petre | A42B 3/127 |
| 2024/0130459 | A1 * | 4/2024 | Lowe | A42B 3/064 |
| 2024/0164465 | A1 * | 5/2024 | Levy | A42B 3/046 |

* cited by examiner

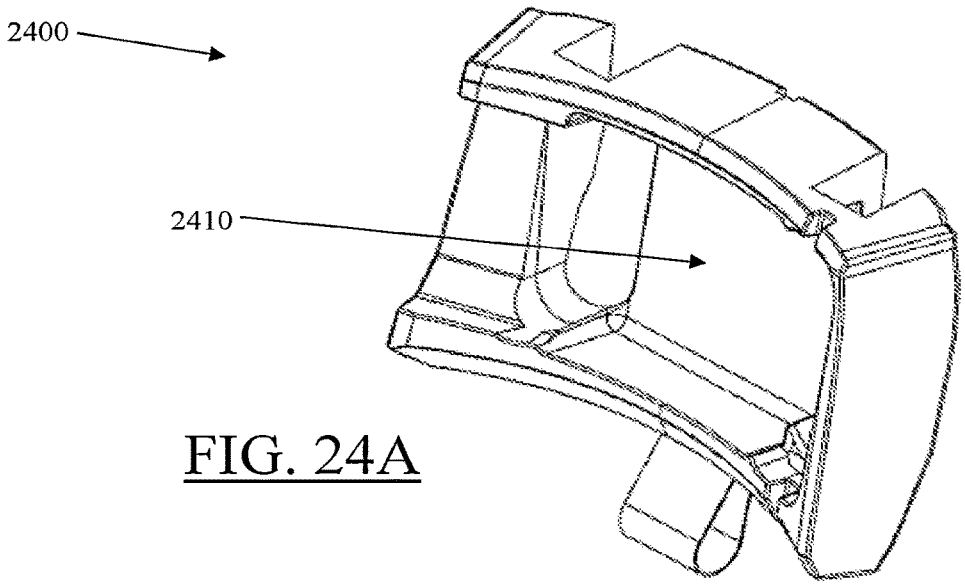
FIG. 24A
FIG. 24B
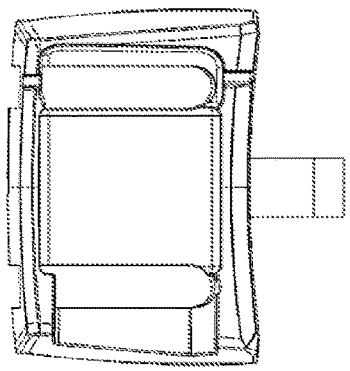
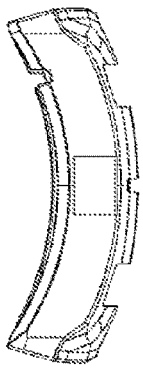
FIG. 24D
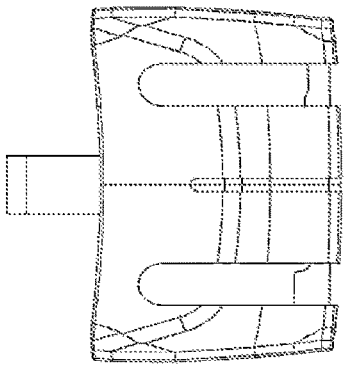
FIG. 24C

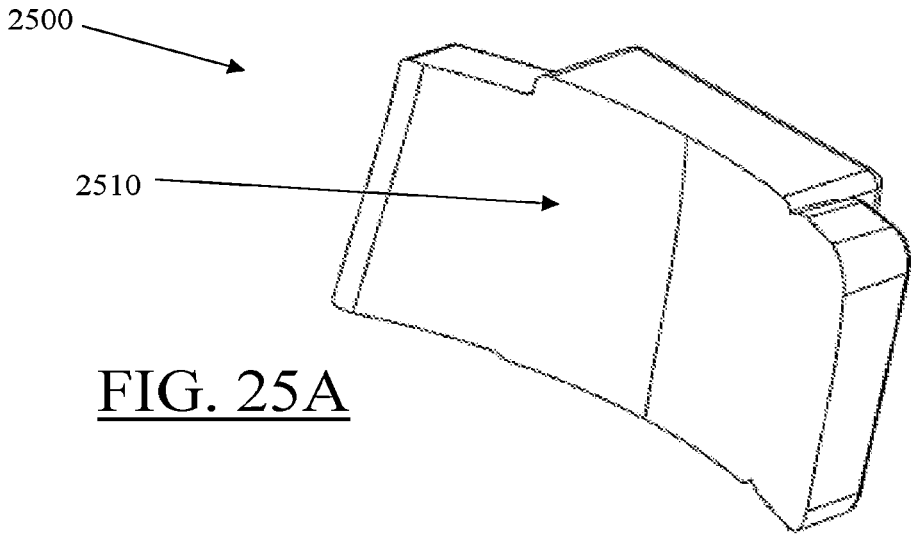
FIG. 25A
FIG. 25B
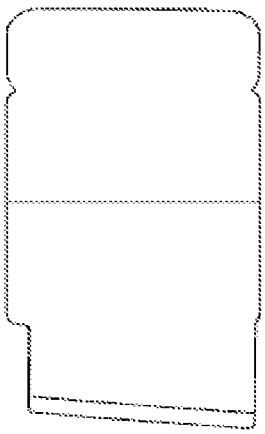
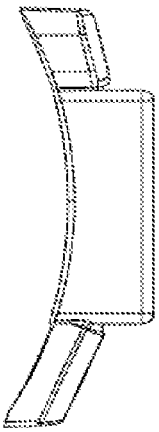
FIG. 25C
FIG. 25D
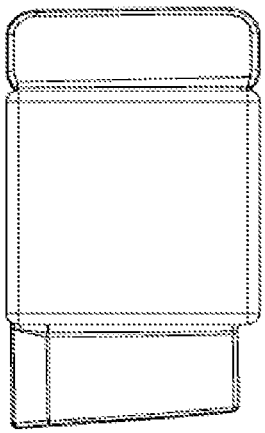

HELMET SYSTEM

CROSS-REFERENCE TO RELATED APPLICATIONS

This application is a continuation application of, and claims priority to, U.S. patent application Ser. No. 16/918,773, now U.S. Pat. No. 11,606,999, entitled "Helmet System," filed on Jul. 1, 2020, which claims the benefit under 35 U.S.C. § 119(e) of U.S. Provisional Patent Application Ser. No. 62/869,192, entitled "Perforated Helmet Shell," filed Jul. 1, 2019 and U.S. Provisional Patent Application Ser. No. 62/895,978, entitled "Helmet System," filed Sep. 4, 2019, the disclosures of which are each incorporated by reference herein in their entireties.

TECHNICAL FIELD

The present invention relates to devices, systems and methods for improving protective clothing such as helmets and protective headgear, including improvements in impact absorbing structures and materials to reduce the deleterious effects of impacts between the wearer and other objects. In various embodiments, a variety of modular helmet components are disclosed that can reduce acceleration/deceleration and/or disperse impact forces on a protected item, such as a wearer, wherein some and/or all of the modular components can be removed and/or replaced, allowing the helmet system to be repaired and/or reconditioned when necessary to extend the useful life of the helmet system and the protections afforded to its wearer. In addition, various devices, methods and systems for perforating a helmet shell or other component for a variety of functions, including improved ventilation, weight reduction, enhanced sound transmission, improved accessory connections, improved helmet performance, improvements in material stress and/or strain mitigation and/or the provision of visual and/or artistic features, as well as various combinations thereof. In various embodiments, a plurality of perforations of various sizes and/or shapes can be provided through various portions of a helmet component, with the perforations arranged in predefined patterns and/or other arrangements.

BACKGROUND

Impact absorbing structures can be integrated into protective clothing or other structures to desirably prevent and/or reduce the effect of collisions between stationary and/or moving objects. For example, an athletic helmet typically protects a skull and various other anatomical regions of the wearer from collisions with the ground, equipment, other players and/or other stationary and/or moving objects, while body pads and/or other protective clothing seeks to protect other anatomical regions. Helmets are typically designed with the primary goal of preventing traumatic skull fractures and other blunt trauma, while body pads and ballistic armors are primarily designed to cushion blows to other anatomical regions and/or prevent/resist body penetration by high velocity objects such as bullets and/or shell fragments. Some protective clothing designs primarily seek to reduce the effects of blunt trauma associated with impacts, while other designs primarily seek to prevent and/or reduce "sharp force" or penetration trauma, including trauma due to the penetration of objects such as bullets, knives and/or shell fragments into a wearer's body. In many cases, a protective clothing design will seek to protect a wearer from both blunt and sharp force injuries, which often involves balancing of a variety of competing needs including weight, flexibility, breathability, comfort and utility (as well as many other considerations). Recently, helmets have also incorporated various structures and materials to decrease impact forces such as linear and angular acceleration that the wearers are subject to, for example, in the context of contact sports, all during cycling and other sports, industrial or recreational activities.

For example, a helmet will generally include a hard, rounded shell with cushioning inside the shell (and typically also includes a retention system to maintain the helmet in contact with the wearer's head). When another object collides with the helmet, the rounded shape desirably deflects at least some of the force tangentially, while the hard shell desirably protects against object penetration and/or distributes some amount of the impact forces over a wider area of the head. The impact absorbing structures, which typically contact both the inner surface of the helmet shell and an outer surface of the wearer's head, then transmits this impact force (at varying levels) to the wearer's head, which may involve direct contact between the hard shell and the head for higher impact forces.

A wide variety of impact absorbing structures have been utilized over the millennia, including natural materials such as leathers, animal furs, fabrics and plant fibers. Impact absorbing structures have also commonly incorporated flexible membranes, bladders, balloons, bags, sacks and/or other structures containing air, other gases and/or fluids. In more recent decades, the advent of advanced polymers and foaming technologies has given rise to the use of artificial materials such as polymer foams as preferred cushion materials, with a wide variety of such materials to choose from, including ethyl vinyl acetate (EVA) foam, polyurethane (PU) foam, thermoplastic polyurethane (TPU) foam, lightweight foamed EVA, EVA-bound blends and a variety of proprietary foam blends and/or biodegradable foams, as well as open and/or closed cell configurations thereof.

While polymer foams can be extremely useful as cushioning structures, there are various aspects of polymer foams that can limit their usefulness in many impact-absorption applications. Polymer foams can have open- or closed-cell structures, with their mechanical properties dependent on their structure and the type of polymer of which the cells are made. For open-cell foams, the mechanisms of cell edge and micro-wall deformations are also major contributors to the mechanical properties of the foam, while closed cell mechanical properties are also typically affected by the pressure of gases or other substance(s) present in the cells. Because polymer foams are made up of a solid (polymer) and gas (blowing agent) phase mixed together to form a foam, the dispersion, shape and/or directionality of the resulting foam cells are typically irregular and fairly random, which causes the foam to provide a uniform (i.e., non-directionally dependent) response to multi-axial loading. While useful from a general "cushioning" and global "force absorption" perspective, this uniform response can greatly increase the challenge of "tailoring" a polymer foam to provide a desired response to an impact force coming from different loading directions. Stated in another way, it is often difficult to alter a foam's response in one loading mode (for example, altering the foam's resistance to axial compression) without also significantly altering its response to other loading modes (i.e., the foam's resistance to lateral shear forces).

The uniform, multi-axial response of polymer foams can negatively affect their usefulness in a variety of protective garment applications. For example, some helmet designs incorporating thick foam compression layers have been successful at preventing skull fractures from direct axial impacts, but these thick foam layers have been less than successful in protecting the wearer's anatomy from lateral and/or rotational impacts, which is of particular importance since both linear and angular acceleration have been involved as forces leading to traumatic brain injuries such as concussions. While softening the foam layers could render the foam more responsive to lateral and/or rotational impacts, this change could also reduce the compressive response of the foam layer, potentially rendering the helmet unable to protect the wearer from impact induced trauma and/or additional brain concussions.

The balancing of force response needs becomes especially true where the thickness of a given compressive foam layer is limited by the cushioning space available in the protective garment, such as between an inner helmet surface and an outer surface of a wearer's skull. In many applications, it is desirous to minimize helmet size and/or weight, which can require a limited foam layer thickness and/or reduced weight foam layer which may be unable to protect the wearer from various impact forces. The resulting collision between the brain and the inner surface of the skull, as well as the shearing of certain brain structures can result in a traumatic brain injury with various transitory or more permanent neurological symptoms. Although the cerebrospinal fluid desirably cushions the brain from small forces, the fluid may not be capable of absorbing all the energy from collisions that arise in sports such as football, hockey, skiing, and biking. Even where the helmet design may include sufficient foam cushioning to dissipate some energy absorbed by the hard shell from being transmitted directly to and injuring the wearer, this cushioning is often insufficient to prevent concussions from very violent collisions or from the cumulative effects of many lower velocity collisions. While no helmet can prevent concussion, certain designs might be able to reduce linear and rotational acceleration of the head upon impact.

BRIEF SUMMARY OF THE INVENTION

The present invention relates to protective equipment, including protective helmets for individuals. More particularly, the present invention relates to protective helmets worn by athletes upon their heads during athletic competition. The various helmet components and designs provided herein are depicted with respect to American football, but it should be understood that the various devices, methods and/or components may be suitable for use in protecting players in various other athletic sports, as well as law enforcement, military and/or informal training session uses. For example, the embodiments of the present invention may be suitable for use by individuals engaged in athletic activities such as baseball, bowling, boxing, cricket, cycling, motorcycling, golf, hockey, lacrosse, soccer, rowing, rugby, running, skating, skateboarding, skiing, snowboarding, surfing, swimming, table tennis, tennis, or volleyball, or during training sessions related thereto.

Plastic football helmets are known in the art, and typically comprise a substantially rigid plastic outer shell configured to fit about a head of a wearer of the helmet. Between the head of the wearer and the inner surface of the outer shell, various types of impact absorbing materials can be positioned, including inflatable bladder pads, impact foam, comfort foam, Thermoplastic Polyurethane Elastomeric cones (or other shapes), bonnets and shock absorbers, and/or similar structures. More recently, however, a newer helmet design technology has been developed wherein a less rigid and/or flexible outer helmet layer can encompass an interface layer and/or impact absorbing structure layer such as filaments (with or without lateral supports) and/or polygonal-shaped buckling structures, with an inner helmet layer positioned proximate to the wearer's head (including helmet designs commercially available from VICIS, Inc. of Seattle, Washington, USA). In these newer designs, the less-rigid and/or flexible structure of the outer helmet shell desirably permits the deformation of the outer helmet layer and improved transmission of impacting forces to the underlying layers, which then absorb and/or attenuate the impact force with less "peak forces" ultimately experienced by the wearer. This newer design is expected to significantly reduce the incidence and/or frequency of concussion-causing impacts, as well as significantly reducing the amplitude and/or frequency of repetitive impacts experience by a player during a typical sports competition and/or playing career.

Various aspects of the present invention include the realization that some newer helmet designs do not mandate the same degree of structural rigidity and/or integrity of the outer shell component as required by previous helmet designs, especially where such rigidity and/or integrity of the outer shell component may not be critical to proper protection of the wearer. In many instances, the outer shell component in such newer designs can include significant regions of flexibility, ductility and/or malleability without significantly degrading the helmet's impact performance. This presents the potential for significant reductions in outer shell component thickness (if desired) and/or the potential for removal and/or piercing of various shell components (including the alteration of various surface and/or subsurface structural features of the helmet, including the intentional creation of imperfections, inclusions and/or stress concentrations in various helmet features which were previously undesirable) without compromising user protection, greatly enhancing the design flexibility for the helmet. Moreover, various aspects of the present invention include the realization of an opportunity for improved impact absorbing structures, including custom or semi-custom laterally supported buckling structures and/or various types of macroscopic support structures for replacing and/or augmenting various impact absorbing structures within helmets and/or other protective clothing. In various embodiments, the helmets, footwear and other protective clothing may comprise a variety of modular components, including one or more impact mitigation layers, the impact mitigation layer(s) being coupled to various components of the helmet and/or other protective clothing. In various embodiments, the impact mitigation layer(s) can include a plurality of laterally supported impact absorbing structures to significantly improve their predictability, performance, strength, utility and/or usability.

In various embodiments, a protective helmet is disclosed. The protective helmet can include various modular and/or replaceable components including an outer shell, an inner shell, one or more impact mitigation layers, optional layers of comfort foam and/or other padding, a protective face mask and helmet retention features such as a chin strap. The various impact mitigation layer(s) can comprise a plurality of impact absorbing pads, the plurality of impact absorbing pads positioned and/or coupled to different structures and/or structural regions within the helmet. In other alternative embodiments, a helmet can optionally include various perforations, openings and/or vents in various locations of the helmet, with such openings utilized alone or in combination with other helmet surface modification elements to create a variety of structural and/or design elements visible to the wearer, other sports participants and/or sport spectators.

BRIEF DESCRIPTION OF THE SEVERAL VIEWS OF THE DRAWINGS

FIGS. 24A through 24D depict one exemplary embodiment of a rear pad for use with the various helmet system components disclosed herein;

FIGS. 25A through 25D depict another exemplary embodiment of a rear pad for use with the various helmet system components disclosed herein;

DETAILED DESCRIPTION

Figure 1A:
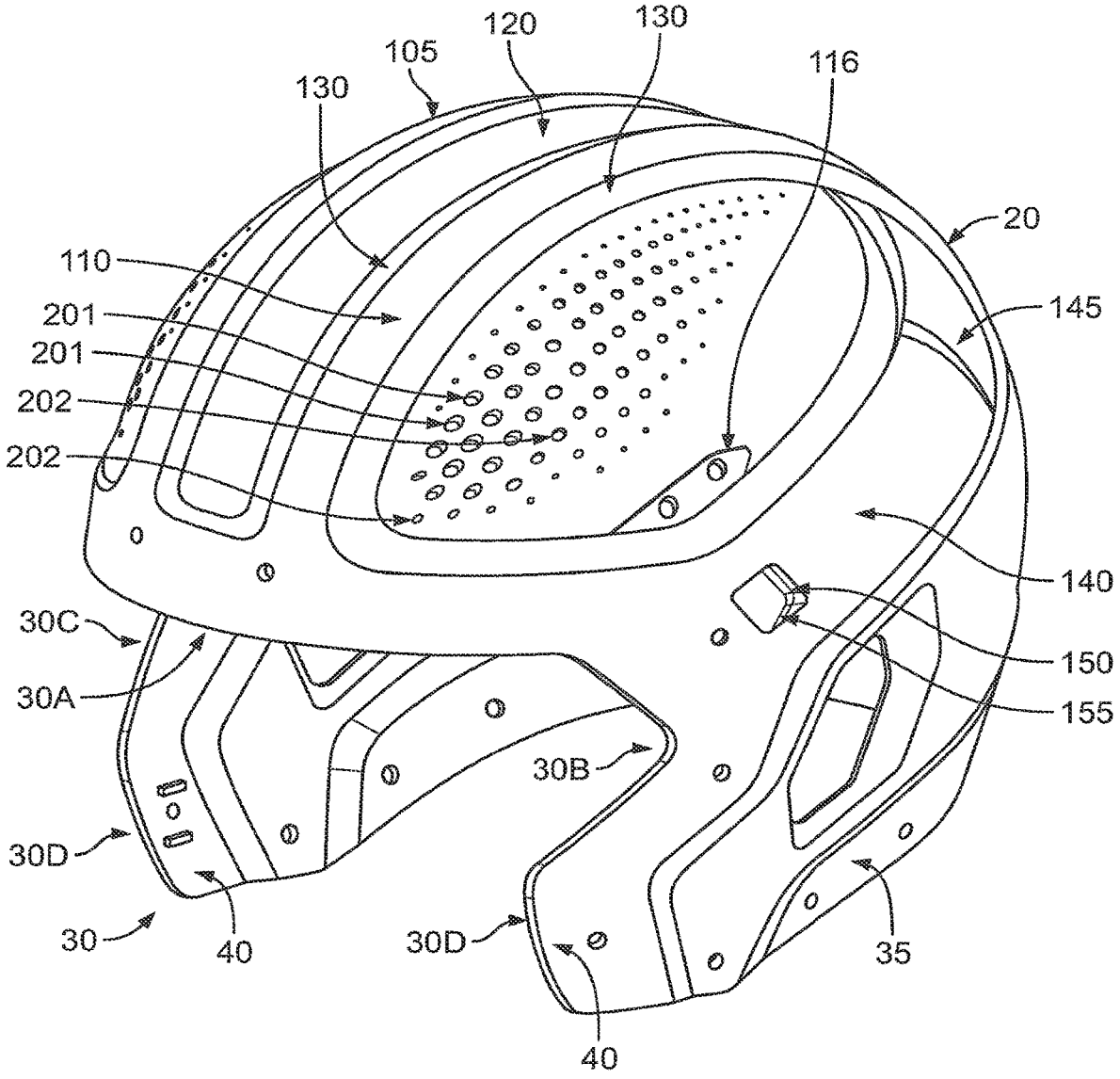
FIG. 1A is a perspective view of one exemplary embodiment of a helmet shell of a modular protective helmet assembly.

While the disclosed inventions may be incorporated into embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The various improved modular structures and related components provided herein are depicted with respect to American football, but it should be understood that the various devices, methods and/or components may be suitable for use in protecting players in various other athletic sports, as well as other occupations that require personal protective equipment, such as law enforcement, military, construction and/or informal training session uses. For example, the embodiments of the present invention may be suitable for use by individuals engaged in athletic activities such as baseball, bowling, boxing, cricket, cycling, motorcycling, golf, hockey, lacrosse, soccer, rowing, rugby, running, skating, skateboarding, skiing, snowboarding, surfing, swimming, table tennis, tennis, or volleyball, or during training sessions related thereto.

Modular Helmet

FIG. 1A is a perspective view of one exemplary embodiment of a helmet shell of a modular protective helmet assembly. In this embodiment, the helmet is shown to generally include an outer impact surface or shell 20, which incorporates a frontal shell opening 30, ear flaps 35 and jaw flaps 40. The frontal shell opening 30 can be defined by an arrangement of edges of the outer shell 20, including an upper frontal edge 30A, medial and lateral side edges 30B and 30C, and a pair of lower edges 30D.

In various embodiments, the shell 20 can be manufactured in a single piece, with all openings and/or holes in the shell being formed in the initial molding process. In various alternative embodiments, post processing of the shell can be performed in the shell to modify the shell and/or create additional opening, etc., if desired.

Figure 4:
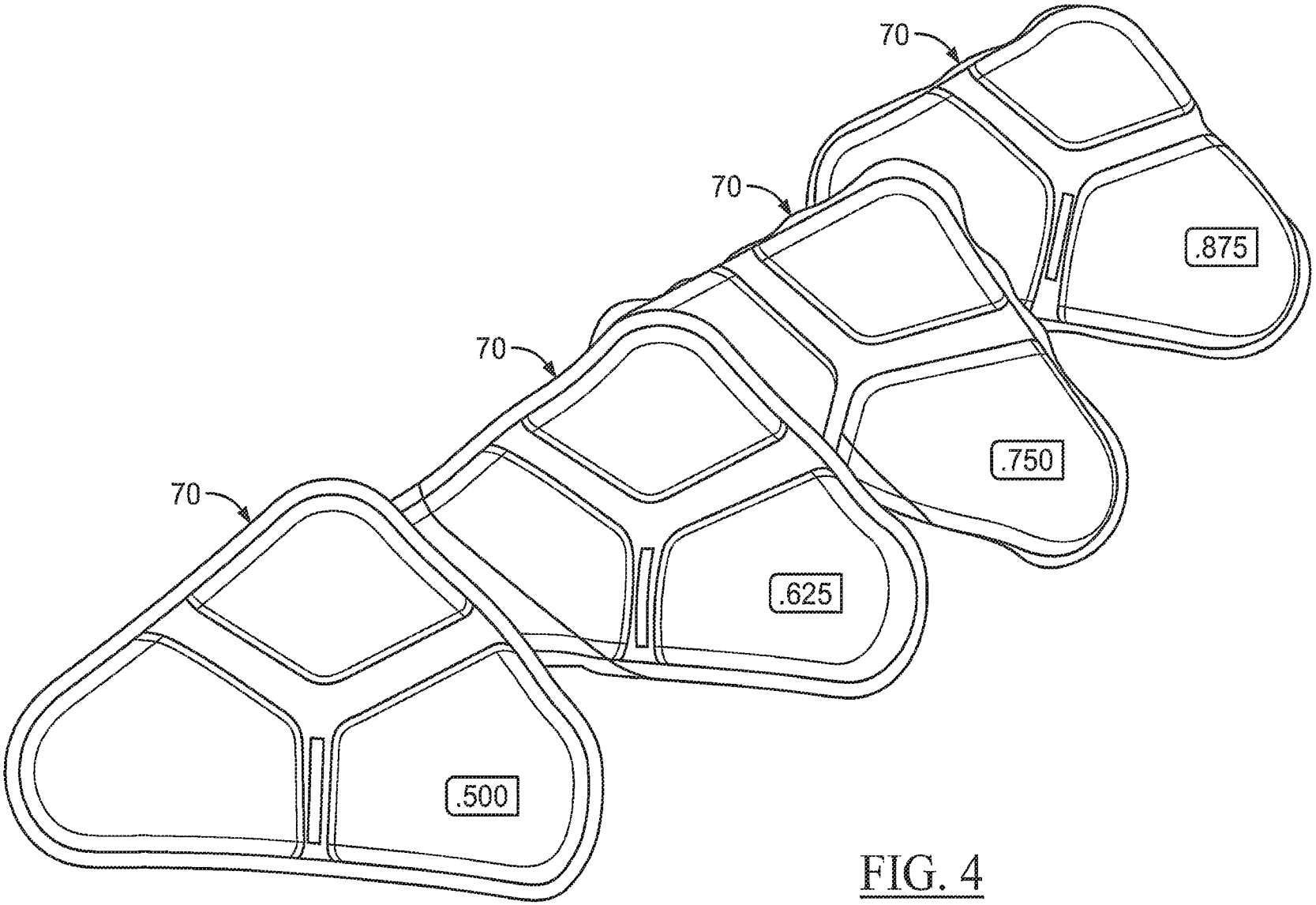
FIG. 4 depicts a set of modular fit pods and/or fit pod assemblies that can be inserted into an inner shell.
Figure 5A:
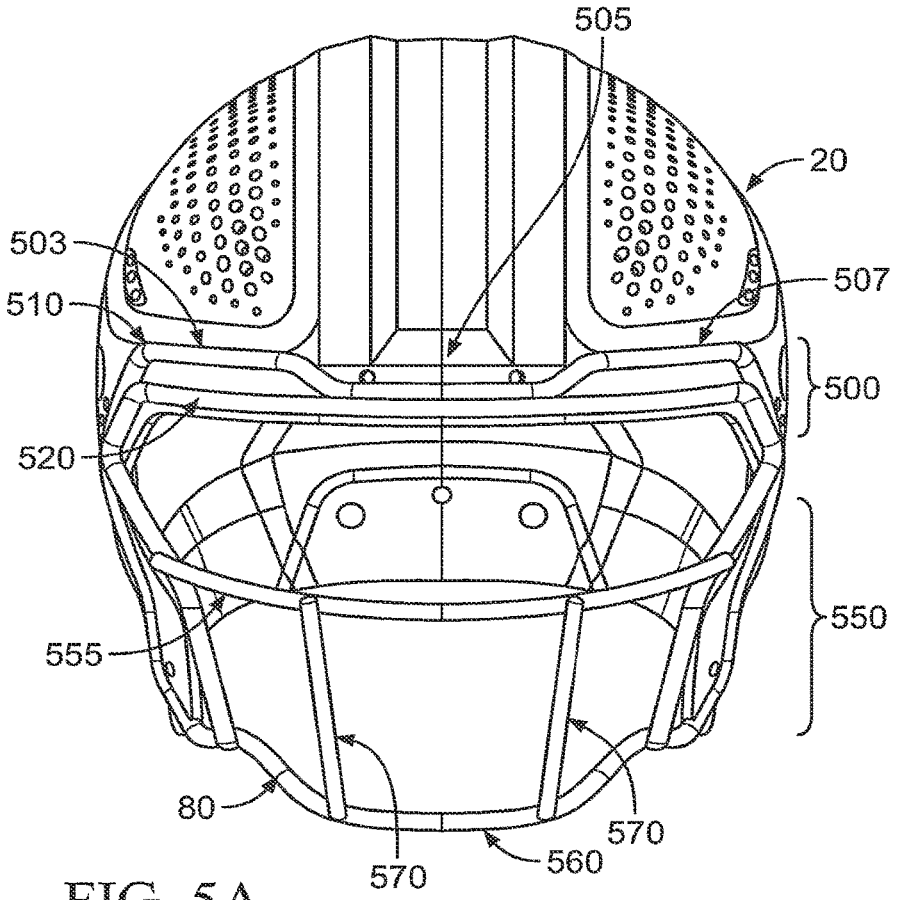
FIGS. 5A and 5B depict an exemplary facemask having a plurality of rod-like segments or bars that, when connected together and attached to the helmet system, can create a protective lattice, screen or "cage" to protect a wearer's face.
Figure 5B:
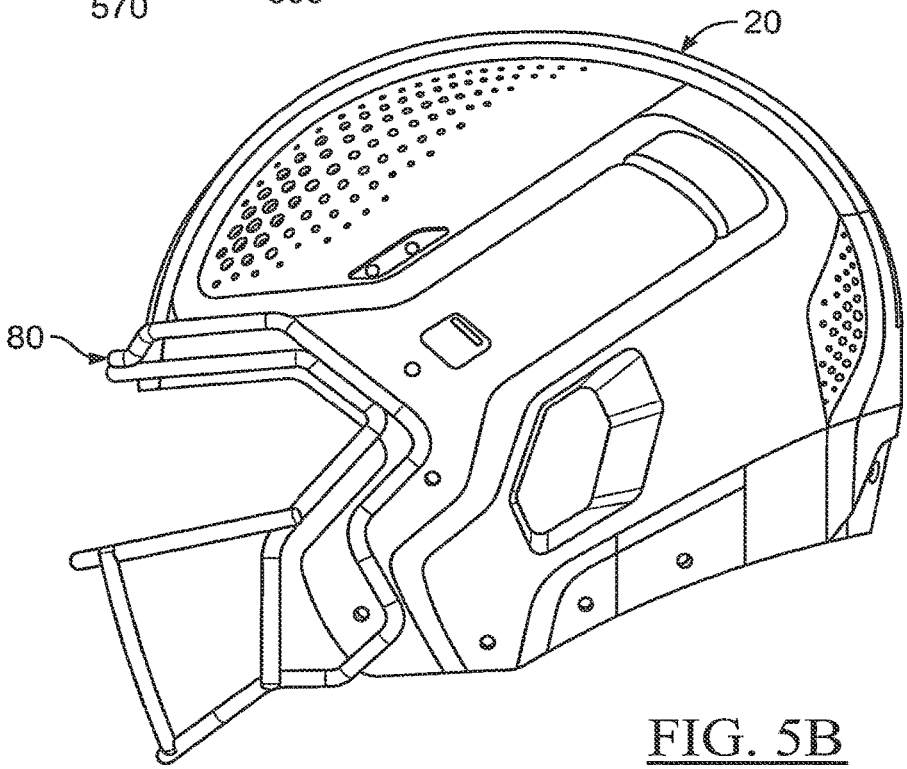

As best seen in FIGS. 2A through 2I, 3A through 3F and 4, the helmet can further include an energy absorbing impact layer 50 (FIGS. 2A through 2I), an inner layer or cap 60 (FIGS. 3A through 3F) and comfort or fitting pods 70 (FIG. 4). As best seen in FIGS. 5A and 5B, a facemask 80 which spans the frontal shell opening 30 can be attached to the shell 20, which in some embodiments can desirably include an energy attenuating faceguard mounting system.

In general, the shell 20 comprises a hemispherical or generally rounded shape, with the frontal shell opening 30 desirably corresponding to a wearer's face. The shell may comprise a front or frontal region, a central region, a side region (right and left sides) and a back region. The outer shell may further comprise an external surface and an internal surface, with various perforations extending through the helmet and in communication with both the internal and external surfaces.

In various embodiments, the shell 20 and/or inner layer or cap 60 may comprise different configurations and materials. In one embodiment, the shell may be a single, continuous shell and/or provided in two or more components. The shell may be manufactured from a deformable, relatively flexible polymer that allows the shell to be pliable enough to locally deform when subject to an incident force. Alternatively, the shell may comprise a relatively or rigid polymer. In other embodiments, the inner layer can be relatively stiff or rigid thereby preventing projectiles or intense impacts from fracturing the skull or creating hematomas. In some embodiments, the inner layer can be at least five times to one-hundred times more rigid than the shell 20 and/or various components of the impact mitigation layer. The frontal region of the shell can correspond to a forehead region of the helmet. In this frontal region, the edge or perimeter of the helmet can be located proximate to an eyebrow region of the wearer or disposed within the brow region of the wearer. Furthermore, the frontal region can incorporate one or more opening or holes which extend into and/or through the shell, which in various embodiments can accommodate fasteners and/or a front bumper. The front bumper can comprise at least one or more posts, with the one or more posts sized and/or configured to fit within the one or more holes. The one or more holes can be sized and configured to receive one or more posts. The front bumper having a front surface and a back surface. The bumper may be inserted through the one or more holes until the back surface of the front bumper mates with the exterior surface of the helmet. The front bumper front surface may further comprise a nameplate or logo. In other embodiments, the front bumper might comprise tabs allowing a facemask upper bar or bars to releasably connect.

In various embodiments, the central region (and/or various other regions) of the shell 20 can include one or more strips, groove and/or ridges on each side of the central region, including a raised medial strip 105 and a raised lateral strip 110, as depicted in FIG. 1A. If desired, the central section of the central region can form a continuation of the hemispherical shell (i.e., be an unraised or not lowered section 120 such as shown in FIG. 1A), or in alternative embodiments the central shell can comprise a raised and/or lowered grooves, strips or ridges. Specifically, a central strip may be raised from the external surface of the outer shell, while in other embodiments the central strip may be even with and/or lowered relative to the external surface of the outer shell, which may include a corrugated and/or raised or lowered inner shell surface if desired. In some embodiments, portions of the one or more medial, lateral and/or raised central strip(s) may be disposed within the frontal region of the helmet and/or within the rear region. The one or more strips may originate anywhere from the edge or perimeter of the helmet within the frontal region and/or proximate or adjacent to the edge or perimeter of the helmet within the frontal region over the crown region and towards, into and/or through the back region. In various embodiments, the one or more strips may terminate at some point between the front and rear regions of the helmet, or may terminate within the back region of the helmet, or may alternatively terminate at an edge or perimeter of the helmet within the back region. The one or more strips may have a uniform width or a non-uniform width, which could include a tapered or irregular width, with a larger taper beginning in the frontal region and terminating at a smaller taper in the back region, or visa-versa. In at least one embodiment, the one or more strips may comprise a first width and a second width, with the second width being greater and/or smaller than the first width (and the dimensions and/or shapes of each of the strips may be the same or different for dimensions and/or shapes of other strips within the same helmet). The one or more strips may include strip walls that are linear, curvilinear or non-linear, be continuous or non-continuous.

In the disclosed embodiment, the central region includes a pair of raised peripheral belts 105 and 110, with a central strip 120 positioned between and/or separated by the peripheral belts 105 and 110. The central strip 120 can have a width, which in various embodiments may be approximately 0.50 inches to 4 inches. The raised peripheral belts 105 and 110 can be raised relative to the external surface of the helmet (i.e., raised relative to the central strip 120 and the sides of the helmet), with the central strip 120 recessed relative to the raised peripheral belts 105 and 110. In various embodiment, the central strip 120 may match and/or substantially matches an external surface diameter of the shell, or may be raised and/or recessed from the external shell to varying degrees, if desired. At least a portion of the central strip 120 may be disposed within the frontal region of the helmet, and extend over the crown region of the helmet, and a portion of the central strip may optionally terminate within the back region of the helmet.

As previously noted, the peripheral belts 105 and 110 may be raised from the external surface of the outer shell (as depicted in FIG. 1A), with at least a portion of the at least two peripheral belts originating within the frontal region, extending over the crown region, and extending towards the back region of the shell. At least a portion of the peripheral belts may terminate within the back region. Alternatively, the peripheral belt may terminate at an edge or periphery of the helmet within the back region and/or proximate or adjacent to the edge or periphery of the helmet within the back region.

The peripheral belts may further comprise one or more beveled edges 130, with the beveled edges optionally positioned on opposing sides of the peripheral belts and desirably smoothly transitioning into adjacent regions of the helmet shell. At best seen in FIG. 1A, the first beveled edge and the second beveled edge can be positioned on opposing sides of each of the peripheral belts—e.g., on the right and left sides of each of the peripheral belts. At least a portion of the first beveled edge can originate in the fontal region of helmet, the first beveled edge may be adjacent to the edge or perimeter within the frontal region. Furthermore, the first beveled edge can extend over the crown towards the back region, and a portion of the first beveled edge can terminate within the back region of the helmet. At least a portion of the second beveled edge can similarly originate in the fontal region of helmet, with the second beveled edge being adjacent to the edge or perimeter within the frontal region. Furthermore, the second beveled edge can extend over the crown towards the back region, and a portion of the second beveled edge may terminate at the edge or periphery within the back region of the helmet, which may be at, equal to and/or near the termination of the first beveled edge, if desired. In another embodiment, the second beveled edge comprises a first portion, a second portion and a third portion. The first portion of the second beveled edge originates from the edge or periphery within the back region of the helmet and extends at an oblique angle, the oblique angle may be anywhere from 1 degree to 60 degrees. The second portion of the second beveled edge extends from the first portion, the second portion may extend obliquely and/or perpendicularly or substantially perpendicular from the first portion, where the second portion may be parallel or substantially parallel to the edge or periphery the beveled edges and/or each of the at least two central belts. "Substantially" may comprise 1-10 degrees change. The third portion of the second beveled edge extends from the second portion, the extension may comprise an oblique angle from the second portion and/or substantially perpendicular, which the oblique angle is approximately from 1 degrees to 60 degrees from the second portion, and follows the contours of each of the at least raised belts (right and left sides) over the crown region and extends to the frontal region. The third portion may terminate within the frontal region or at the edge or periphery of the helmet within the frontal region.

In various alternative embodiments, one or more of the peripheral belts may comprise a combination of a first beveled edge and a second non-beveled edge, or a combination of non-beveled edges of varying shapes, as desired.

A side region of the helmet shell can include a raised side belt 140 on the right and left sides of the helmet, which may be formed symmetrically and/or asymmetrically, as desired. The raised side belt 140 can originate from a front edge and/or periphery within the side region of the helmet, and may extend obliquely towards, into and/or through the back region of the helmet. The raised side belt can vary in size and/or shape, including having a width, the width may be from 1 inch to 3 inches. The raised side belt 140 may further comprise one or more vent openings 145 and/or one or more chin strap openings 150. Furthermore, the raised side belt 140 may further comprise a chin strap recess 155, with the one or more chin strap openings 150 disposed within the chinstrap recess 155. The chin strap opening 150 may be sized and/or configured to receive at least a portion of a chinstrap band (not shown). The chinstrap opening 150 may be an elongated opening. The vent opening 145 may include an elongated shape, and may be used for ventilation, and/or be sized and configured to receive a portion of a chinstrap or other feature.

In an alternative embodiment (not shown), the raised side belt may comprise a main body with a plurality of legs (i.e., a first leg and a second leg) extending towards a back region of the helmet, where the legs may diverge and/or converge in various manners. The main body may comprise one or more vent openings and/or one or more chin strap openings.

The helmet shell can further include a back region, which in some embodiments can include at least a portion of one or more peripheral bands and/or a portion of a central strip. A back bumper and/or a recessed or raised area 115 (see FIG. 1H) may be included at the rear of the helmet shell, with the back bumper including one or more posts that can be sized and configured to be disposed within a plurality of holes within a recessed area of the shell. If desired, the raised area 115 can incorporate a supplemental impact protection pad or, in some embodiments, can accommodate a power supply (i.e., a battery) or an electronic package for helmet mounted electronic equipment such as a radio transceiver, electronic monitoring equipment and/or the like.

In the disclosed embodiment, the helmet shell 20 can comprise a plurality of perforations 200 of varying sizes and/or shapes. In some embodiments, some or all of the plurality of perforations 200 may extend fully from the external surface of the helmet through the inner surface of the helmet, which may function as ventilation elements and/or as structural elements which alter the stiffness and/or flexibility of portions of the helmet shell in a variety of ways. In alternative embodiments, some and/or all of the plurality of perforations 200 may extend only partially from the external surface of the helmet towards a portion of the inner surface of the helmet, forming an indentation and/or depression which may provide an ornamentation feature to the helmet shell, and/or which may also alter the stiffness and/or flexibility of portions of the helmet shell in a variety of ways.

In various embodiments, the plurality of perforations and/or indentations may have a center and a diameter and/or width, with the diameter and/or width in some embodiments being a range from 0.5 mm to 2 cm. The plurality of perforations may have a shape or combination of shapes, including shapes such as circles, regular polygons, irregular polygons, slits, other geometric features and/or any combination thereof, including a variety of features formed by a plurality of holes, such as the various embodiments shown in FIGS. as shown in FIGS. 1A through 1I, 5A, 5B and 6A through 6C. The plurality(ies) of perforations may comprise perforations of the same size and shape, and/or the plurality(ies) of perforations may be different sizes, shapes and/or distributions. The plurality of perforations may be positioned in a plurality of patterned repeating rows. Each of the patterned rows may be spaced apart from the adjacent or preceding patterned row. The spacing and/or bar width may the same and/or different from the adjacent or preceding patterned repeating row. Each of the plurality of patterned rows may comprise different sizes and shapes, with the plurality of perforations optionally varying in center, size, shape, spacing/bar width, diameter, perforations per square inch and/or any combination thereof. The plurality of perforations may be disposed onto the helmet in a random, symmetrical pattern and/or an asymmetrical pattern. The plurality of perforations may be disposed on the outer shell in a straight line, with repeating rows that have an identical number of perforations in each preceding row. Alternatively, the plurality of perforations may be disposed on the outer shell in a staggered and/or offset pattern, with repeating rows that are diagonal, offset and/or staggered alignment from the adjacent or preceding rows. In various embodiments, the plurality of perforations may be disposed onto the outer shell in a custom pattern, where each repeating row is not identical to the adjacent or preceding row—it may not be identical with respect to size, shape, spacing, diameter, width, perforations per square inch, patterned rows, and/or any combination thereof. If desired, the plurality of perforations may follow the contours of the outer shell, being in an arched or arched pattern. The plurality of perforations may be disposed within the frontal region, side regions (right and left sides), crown region, back region, on raised ridges, beveled sections and/or in depressed or other regions of the helmet shell, and/or any combinations thereof. In various embodiments, such as depicted in FIGS. 1A through 1I, a plurality of perforations 201 can be combined with a plurality of depressions and/or indentations 202 to create a functional vent opening (or other functional feature extending through the helmet shell) in combination with depressions or indentations, which when combined create a desired ornamental "look" to the helmet that includes some or all of the functional area.

In various embodiments, the plurality of perforations and/or vent openings may be disposed on the outer shell to create a decorative pattern. The decorative pattern may comprise a custom shape, an object, a person, a logo, and/or any combination thereof. If desired, the size, shape and/or location of perforations may be selected to desirably create a visually perceivable image, such as a human or animal (see FIG. 6C).

In various embodiments, the outer shell may comprise a first plurality of perforations and a second plurality of perforations. The first plurality of perforations may be positioned to the side of the right and left sides of a central region and/or to the side of the medial and lateral bands. At least a portion of the first plurality of perforations can be disposed within the frontal region and extend to the side regions (right and left sides) of the helmet. At least a portion of the first plurality of perforations terminate within the side regions. The first plurality of perforations is positioned in patterned rows, where each of the patterned rows have a similar or the same spacing between the adjacent or preceding patterned row. The plurality of perforations within each of the patterned rows may have a shape and size, the shape and size being different than the adjacent or preceding row. The second plurality of perforations can be disposed within the back region, the second plurality of perforations positioned adjacent and/or proximate to the right and left sides of the central region within the back region. The second plurality of perforations is positioned in patterned rows, where each of the patterned rows have a similar or the same spacing between the adjacent or preceding patterned row. The first plurality of perforations can follow the contours of the helmet. The plurality of perforations within each of the patterned rows having a total number of perforations, a shape and a size, the total number of perforations, the shape and the size is different than the adjacent or preceding row. In another embodiment, the plurality of perforations may be disposed onto the at least two raised bands, a central band, and/or a side band(s).

In at least one alternative embodiment (not shown) the outer shell may comprise a plurality of protrusions, with the protrusions comprising a portion that is raised or angled that are disposed onto the frontal region, side regions (right and left sides), crown region, back region, and/or any combination thereof. The plurality of raised or angled protrusions may be in symmetrical patterned rows or asymmetrical patterned rows. The plurality of raised or angled protrusions can be raised or angled from the external or outer surface of the outer shell. The plurality of raised or angled protrusions patterned rows may have a different height and/or different angle or the same angle or same height than the preceding and/or adjacent patterned row. If desired, the protrusions can be utilized to create similar decorative pattern as described with the perforations above (and/or various combinations of protrusions and/or perforations may be utilized, as desired).

FIGS. 2A through 2I depict various views of an energy absorbing impact layer 50, which can include a plurality of impact absorbing elements 300 which can be connected together by a connective structure or face sheet 310. The plurality of impact absorbing elements may span or substantially span between an internal surface of the shell to an internal surface of the inner layer or cap. In various embodiments, the impact absorbing elements may comprise laterally supported filament structures and/or segmented tile structures, which may optionally include a plurality of filaments with a plurality of laterally supporting wall structures. Such supporting wall structures or support members may be desirably modified into any shape or configuration that reduces and distributes impact forces, as well as relieves specific stress concentration points within the impact mitigation structure. The supporting wall structure shape and/or configuration may include polygon shaped, re-entrant shapes, parabolic shapes, cone shapes, venturi shaped, hemispherical shaped, re-entrant flared shaped, and/or any combinations thereof. The presence of the laterally supporting wall structures and/or support members (which may include laterally supporting members extending between adjacent filaments, face sheets, other support elements and/or between various combinations thereof) will desirably prevent and/or inhibit buckling of the filaments and/or columns in a lateral direction away from the wall, as well as possibly prevent and/or inhibit sideways buckling of the filaments (and/or buckling towards the wall) to varying degrees—generally depending upon the thickness, structural stiffness and/or material construction of the various walls, as well as various other considerations.

Figure 8A:
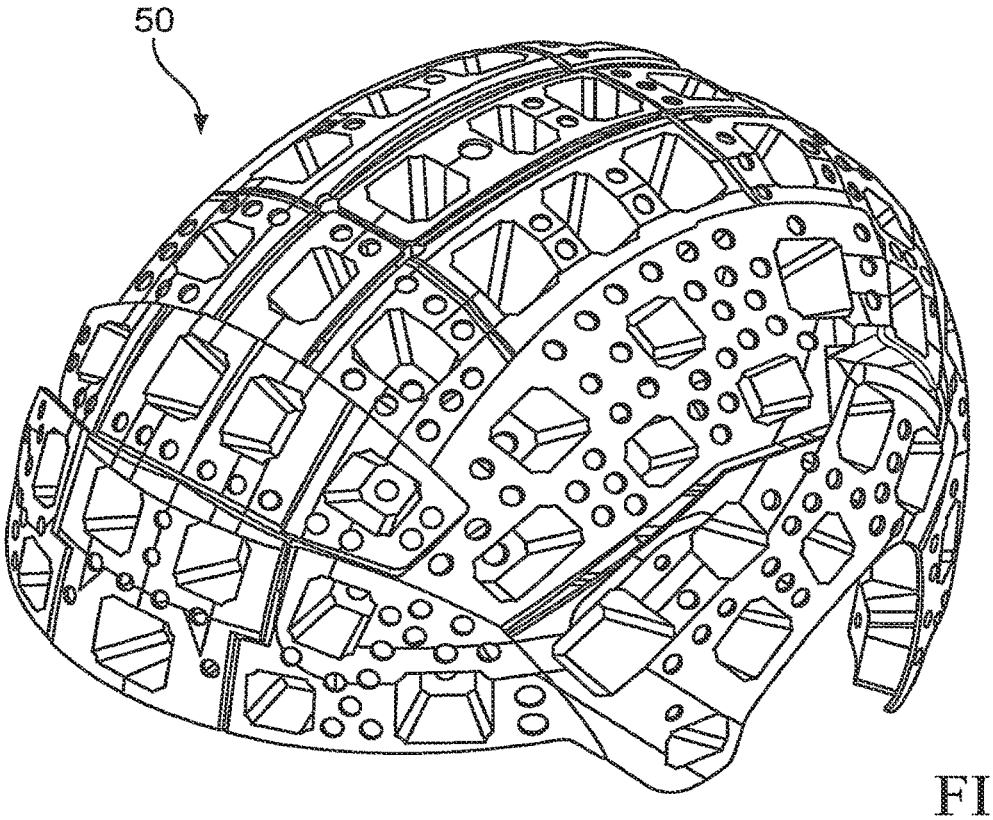
FIGS. 8A through 8C depict views of an energy absorbing impact layer comprising a plurality of impact layer modules.
Figure 8B:
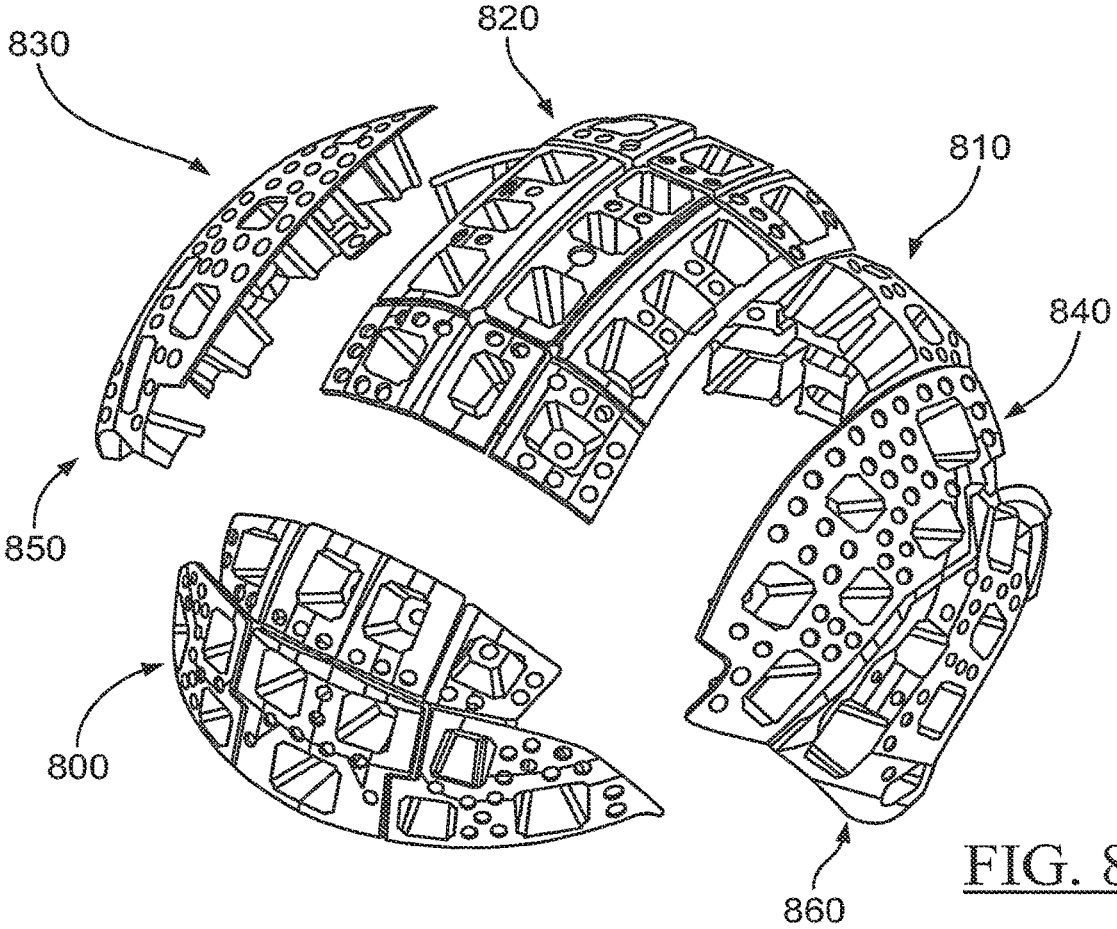

As best seen in FIGS. 8A and 8B, the energy absorbing impact layer 50 can comprise a plurality of impact layer modules, including a frontal impact module 800, a rear impact module 810, a ridge impact module 820, high side impact modules 830 and 840 and low side impact modules 850 and 860. Desirably, each of these impact modules can be removed and/or replaced in the helmet system as necessary and/or whenever desired. These impact modules desirably each comprise an array of impact absorbing structures, wherein the array of impact absorbing structures may comprise longitudinally extending vertical filaments, columns and/or other buckling structures, otherwise known as "closed" laterally supported filament (LSF) structures, connected together via at least one face sheet. Each impact absorbing LSF structure can comprise a plurality of connected support members, each connected support member having a first filament, a second filament and a connecting wall or connecting element. Each of the first and second filaments having an elongated body and high aspect ratio of greater than 3:1 to facilitate an elastic buckling response, the buckling being a lateral deflection away from a longitudinal axis of the filament. At least a portion of the first and second filament may further comprise a uniform and/or constant cross-sectional shape. Alternatively, at least a portion of the first and second filaments may have a substantially uniform and/or substantially constant cross-sectional shape, where substantially is defined as at least ninety percent of the filament body is uniform and/or constant cross-sectional shape. The connecting wall or element is coupling the first and second filament. The connecting wall or element may extend at least a portion of the length of the first or second filament. The connecting wall or element may comprise different shapes and/or configurations, which include polygon shaped, re-entrant shapes, parabolic shapes, cone shapes, venturi shaped, hemispherical shaped, re-entrant flared shaped, and/or any combinations thereof. The plurality of connected support members is positioned adjacent to each other to form a pattern, shape or structure. The symmetric pattern, asymmetric pattern, offset patterns, linear patterns, shape or structure comprises a circle, and/or a polygon. The polygons may comprise triangles, squares, rectangles, pentagons, hexagons, septagons, octagons, nonagons, decagons, and/or any combination thereof. The polygons may further comprise a regular or irregular polygon.

Figure 8C:
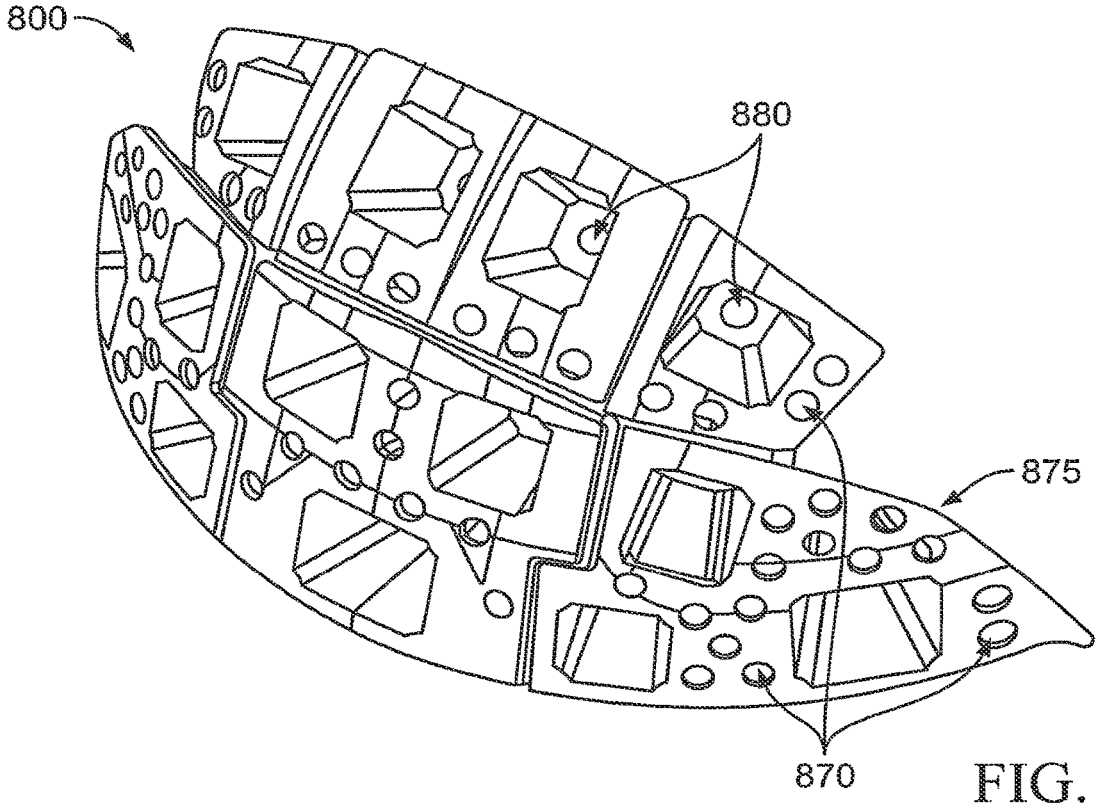
Figure 8D:
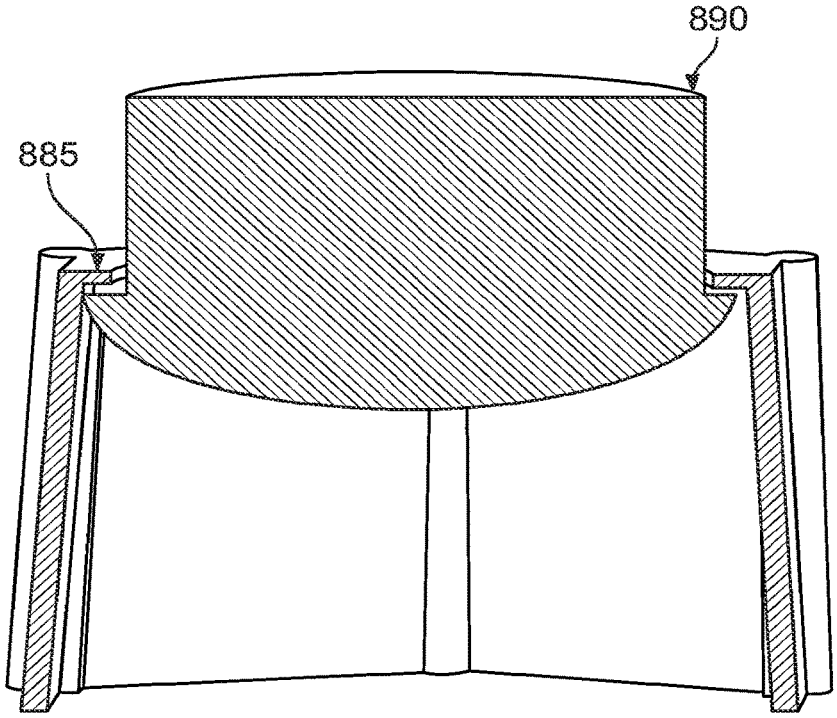
FIG. 8D depicts a cross-sectional view of an individual polygonal impact absorbing element.
Figure 8E:
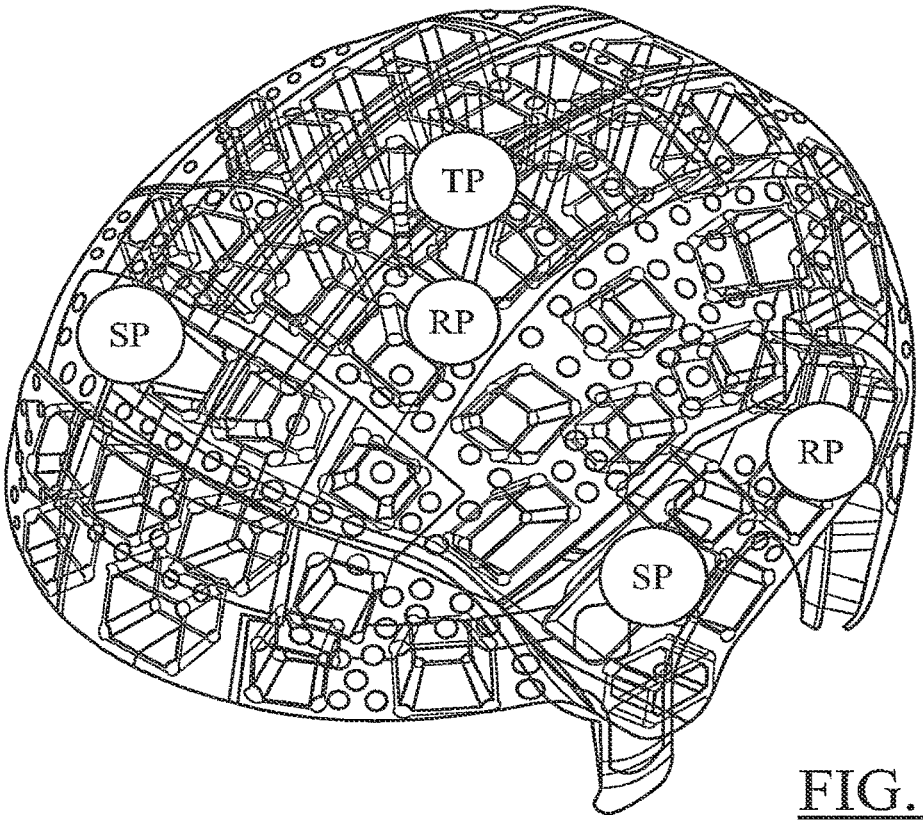
FIG. 8E depicts one exemplary embodiment of inner shell attachment locations for various modular components of an energy absorbing impact layer.
Figure 8F:
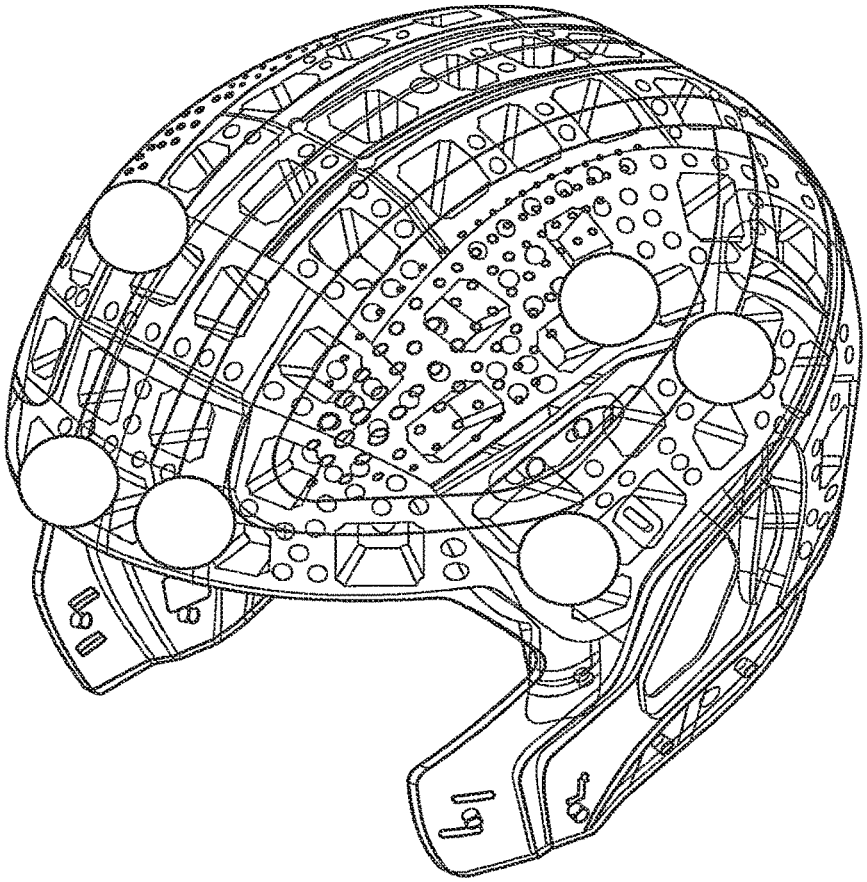
FIG. 8F depicts an alternative exemplary embodiment of inner shell attachment locations for various modular components of an energy absorbing impact layer.

In one exemplary embodiment, shown in FIG. 8E, the various modular components of the energy absorbing impact layer can be attached to the inner shell at 5 (five) or more locations, such as side pad connections SP, a top pad connections TP, and a pair of rear pad connections RP. This embodiment may also include additional connections between the energy absorbing impact layer and the shell or outer layer, such as side pad connections, a pair of front pad connections and 2 connections for a rear or $7^{th}$ pad (7P). Of course, a variety of alternative pad locations and attachment zones can be utilized, depending upon helmet size, shape, anticipated impact zones and/or player comfort, among other considerations, such as the exemplary attachment zones depicted in FIG. 8F.

As best seen in FIGS. 24A through 24D and 25A through 25D, a rear or $7^{th}$ pad 2400, 2500 of the energy absorbing impact layer can comprise an array of impact absorbing structures, which can alternatively include a centrally located opening 2410 (see FIG. 24A) or can include a centrally located foam 2510 or other impact absorbing structure, depending upon user preferences. Desirably, the $7^{th}$ pad can be modular and/or replaceable, and in some embodiments could accommodate an electronics unit such as a radio transceiver, power supply, computer and/or impact sensor.

In at least one alternative embodiment, the plurality of impact absorbing modules may be positioned in a variety of different regions throughout the protective helmet. The different regions may comprise a frontal region, a sphenoid region, an ethmoid region, a parietal region, a right temporal region, a left temporal region, zygomatic region, buccal region, parotid region, an occipital region, and/or any combinations thereof.

In another embodiment, the impact absorbing module can be one single continuous layer.

In some embodiments, a rear energy absorbing impact layer module in the helmet could include a recess formed herein, with the recess sized and configured to receive an impact foam structure. If desired, the impact foam could be removably connected, with removal allowing the recess to receive other things, including electronics, radio, biometrics, sensors, audio, etc. In various alternative embodiments, the modules may or may not incorporate one or more extending tab(s) used to attach to adjacent module(s).

In various embodiments, the presence of the lateral walls between the filaments of the polygonal structure can greatly facilitate recovery and/or rebound of the filament and structures as compared to the independent filaments within a traditional filament bed. During buckling and collapse of the filaments and polygonal structures, the lateral walls desirably constrain and control filament "failure" in various predictable manners, with the walls and/or filaments elastically deforming in various ways, similar to the "charging" of a spring, as the polygonal structure collapses. When the compressive force is released from the polygonal structure, the walls and filaments should elastically deform back to their original "unstressed" or pre-stressed sheet-like condition, which desirably causes the entirety of the polygonal structure and associated filaments/walls to quickly "snap back" to their original position and orientation, immediately ready for the next compressive force.

The disclosed embodiments also confer another significant advantage over many existing array designs, in that the presence, orientation and dimensions of the lateral walls and attached filaments can confer significant axial, lateral and/or torsional stability and/or flexibility to the entirety of the array, which can include the creation of orthotropic impact absorbing structures having unique properties when measured along different directions. More importantly, one unique features of these closed polygonal structures (and to some extent, open polygonal structures in various alternative configurations) is that the orthotropic properties of the polygonal structures and/or the entirety of the impact absorbing array can often be "tuned" or "tailored" by alterations and/or changes in the individual structural elements, wherein the alteration of one impact structure can significantly affect one property (i.e., axial load resistance and/or buckling strength) without significantly altering other properties (i.e., lateral and/or torsional resistance of the structural element). In various embodiments, this can be utilized to create a protective garment that responds differently to different forces acting in different areas of the garment.

If desired, the polygonal elements or structures of an impact absorbing array can include components of varying size, shape and/or material within a single element, such as filaments of different diameter and/or shape within a single element and/or within an array of repeating elements. For example, the orthotropic response of an individual polygonal structure can be altered by increasing the thickness of one set of lateral walls, while incorporating thinner lateral walls in the remaining lateral walls, if desired. Furthermore, the orthotropic response of the polygonal structure can be further altered by increasing the diameter of at least one filament, while incorporating smaller diameter filaments in the remaining filaments, if desired. This can have the effect of "stiffening" the lateral and/or torsional response of the structure in one or more directions, while limiting changes to the axial response and/or controlling the axial response. Accordingly, a wide variety of structural features and dimensions, as well as material changes, can be utilized to "tune" or "tailor" the element to a desired performance, which could include in-plane and/or out-of-plane rotation of various polygonal elements relative to the remainder of elements within an array. The ability to tune physical properties of filaments, LSF structures, facesheet, etc. throughout a single impact absorbing module or across various impact absorbing modules could be very desirable for example in the context of contact sports such as football, to confer position specificity to a protective helmet, tuning it for impacts at a specific helmet location and/or at a specific magnitude.

FIGS. 3A through 3F depict various views of one exemplary embodiment of an inner shell or cap 60. The inner shell or inner layer 60 can substantially surround the head of the wearer and, in conjunction with various fitting pods, desirably conforms to the shape of a wearer's head. The inner shell may comprise various openings 300 of differing shapes and/or sizes, and in various embodiments may include a plurality of retention posts (not shown). In various embodiments, some portion of the openings 300 may be sized and configured to receive a connection portion 75 of a fit pod connection mechanism (see FIGS. 7A through 7D). Such size and configuration will desirably allow the portion of the fit pod connection mechanism to be compressed, and pushed through the first plurality of openings, and once through, the at least a portion of the connection mechanism will expand and stay in place. Furthermore, the connection mechanism may comprise an alignment feature, the alignment feature allowing for intuitive placement of the fit pod assembly in the correct direction to prevent improper placement or orientation. Tactile feedback with a "snap" upon attachment and/or detachment may be desired. Accordingly, another portion of the openings may be sized and configured to secure other components of the helmet, such as the ridges of the impact absorbing elements (described below) and/or portions of the shell.

In various embodiments, the inner shell or cap may be provided in a range of sizes, including medium (for head circumference ranges of approximately 19.5" to 22"), large (22" to 23.25") and extra-large (23.25 to 24.5"). Desirably the inner shell will weigh between 5 and 8 ounces, with one desirably embodiment being approximately 7.5 ounces.

FIG. 8C depicts a perspective view of one exemplary embodiment of a frontal impact module 800, in which a series of first perforations 870 in a face sheet 875 of the module 800 can be seen. In addition, a series of second perforations 880 can be seen in a distal or end portion of the individual impact absorbing elements 300. In use, some portion(s) of the first perforations 870 may be utilized to accommodate connecting elements (not shown) which connect the module to an inner surface of the shell, while some portion(s) of the second perforations can be utilized to connect the module to an outer surface of the inner layer or cap 60. For example, the first and/or second perforations can be sized and configured to accept protrusions and/or one-way fasteners, if desired, in a known manner.

Another significant aspect of the module 800 of FIG. 8A (and of the other modules described herein), is that the module can comprise a plurality of impact absorbing elements connected to each other by a single face sheet having one or more perforations therein, which consequently allows the face sheet (and thus the modular array) to easily be bent, twisted and/or otherwise shaped or "flexed" to follow a hemispherical or curved shape, including an ability to deform the face sheet and associated impact absorbing elements around corners and/or edges or other complex surfaces, if desired. In this manner, the modular array can be manufactured in a flat or semi-flat sheet form, if desired, and then the array sheet can be manipulated to conform to a desired shape (i.e., the hemispherical interior of an athletic or military helmet, for example) without significantly affecting the shape and/or impact absorbing performance of the impact absorbing elements therein. In some embodiments, the face sheet may curve smoothly, while in other embodiments the face sheet may curve and/or flex primarily at locations between polygonal or other elements, while maintaining a relatively flat profile underneath the individual polygonal elements or structures.

In various embodiments, the second perforations 880 can include a ridge 885. If desired, each impact absorbing element can include a ridge incorporated into the end of each of the plurality of LSF structures, or ridges and/or second perforations can be included in only selected elements. Desirably, the second perforations and associated ridge can be formed in a variety of opening shapes and/or configurations, including circular, oval, triangular, square, pentagonal, hexagonal, septagonal, octagonal and/or any other shape, including shapes that mimic or approximate the shape of the polygonal element in which they reside, with the opening sized and/or configured to receive a connecting mechanism 890 (see FIG. 8D).

In addition to connecting the impact elements to the inner layer, an additional advantage of incorporating a ridge into the polygonal impact absorbing LSF structure is a potential increase in the "stiffness" and rebound force/speed of the element as compared to prior art elements. The addition of the ridge can, in various configurations, function in some ways similar to a second face sheet attached to the element, in that the ridge can constrain movement of the distal end of the filaments in various ways, and also potentially serve to stiffen the lateral walls to some degree. This can have the desired effect of altering the response of the polygonal LSF structure to lateral and/or torsional loading, with various opening sizes, configurations and sheet thickness having varying effect on the lateral and/or torsional response. Moreover, the addition of the ridge can increase the speed and/or intensity at which the polygonal LSF structure (and/or components thereof) "rebounds" from a compressed, buckled and/or collapsed state, which can improve the speed at which the array can accommodate repeated impacts. In addition, the incorporation of the ridge can reduce stress concentrations that may be inherent in the various component connections during loading, including reducing the opportunity for plastic flow and/or cracking/fracture of component materials during impacts and/or repetitive loading.

Figure 9A:
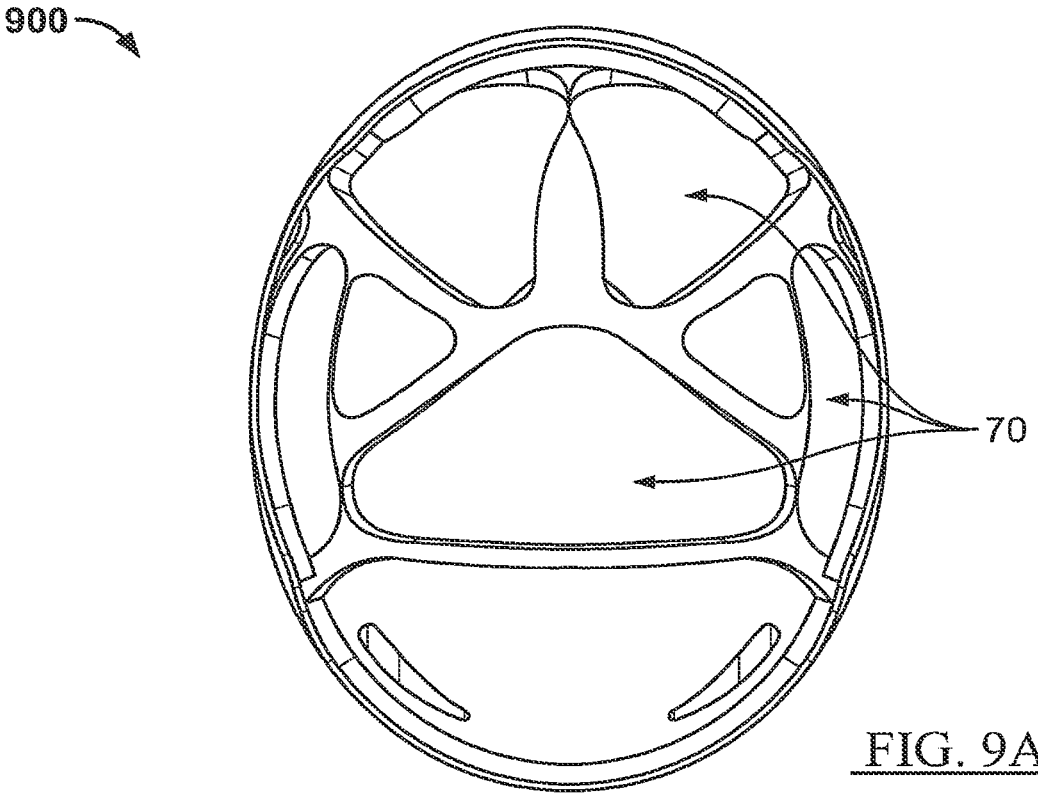
FIGS. 9A and 9B depict an exemplary inner layer or cap with a series of fit pods attached therein.
Figure 9B:
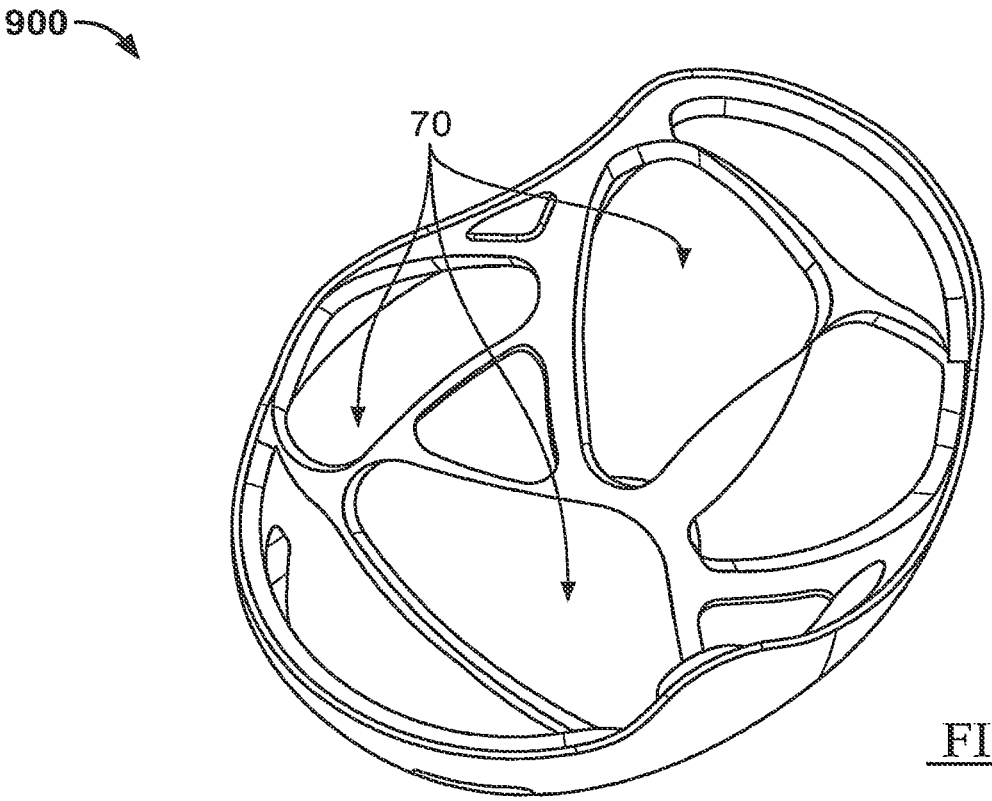

FIGS. 4 and 7A through 7D depict exemplary embodiments of comfort or fitting pods 70, which can be positioned on an inner surface of the inner layer or cap 60. Desirably, the cap 60 can be provided in a limited number of different sizes (i.e., small, medium, large and extra-large sizes), and then different fit pods 70 can be utilized in various combinations within a selected cap size to accommodate the actual size and/or shape of the wearer's head to achieve a comfortable and secure fit for the helmet system. For example, FIGS. 9A and 9B depict an exemplary inner layer or cap 900, with a series of fit pods 70 attached therein. In various alternative embodiments, the fit pod might be a custom fit pod comprising foam or a 3D printed structure with topography that desirably matches a topography of head and/or other structures within the helmet.

Figure 7A:
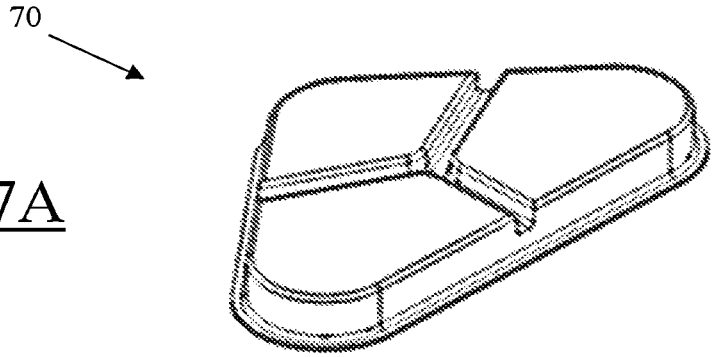
FIGS. 7A through 7D depict various views of an alternative embodiment of a comfort or fitting pod.
Figure 7B:
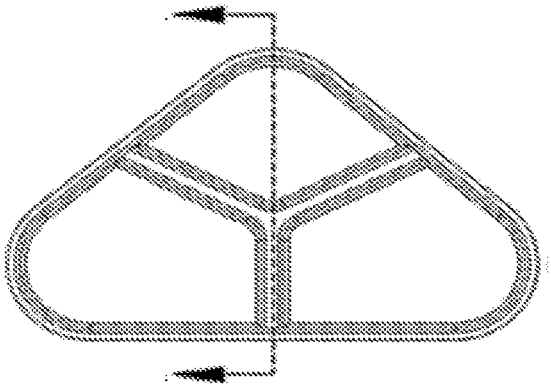
Figure 7C:
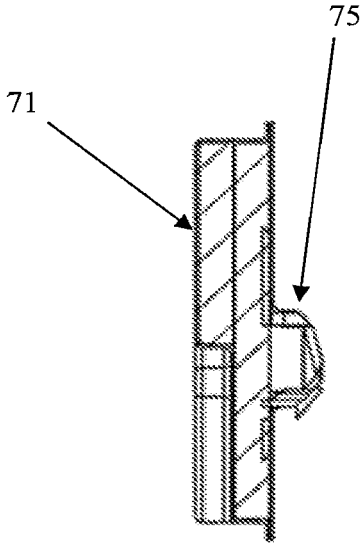
Figure 7D:
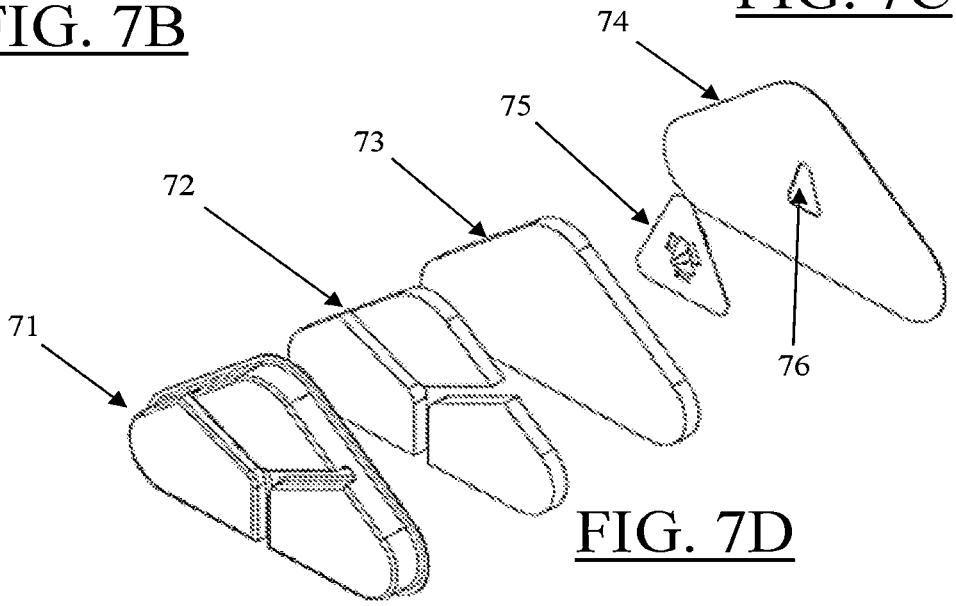

FIGS. 7C and 7D depict cross-sectional and exploded views of one exemplary embodiment of a fit pod assembly. The fit pod assembly 70 can comprise a fit pod and a connection mechanism 75. The fit pod comprises a top layer 71, a bottom layer 74, one or more foam layers 72 and 73, a connection mechanism 75, and/or any combination thereof. If desired, the fit pod assembly may optionally include an impact mitigation structure (not shown) and/or an impact distribution plate (not shown), where the impact mitigation structure and/or the impact distribution plate may be disposed between the top layer and/or bottom layer. Alternatively, the fit pod may not incorporate a connection mechanism. In at least one alternative embodiment, the fit pod may not include a top layer, but may rather include foam pads that may be laminated or thermoformed to create a top smooth surface.

In various embodiments, the fit pod assembly may comprise a flattened or planar configuration, and/or a curved configuration. The one or more foam layers 72 and 73 may be disposed between the top layer and the bottom layer.

In various embodiments, the top layer 71 and/or the bottom layer 74 may comprise a foam layer or foam material, a plastic material, a resilient fabric that may be a two-way or four-way stretch material and/or any elastic material. The plastic material may comprise an acrylic, a polypropylene, a polycarbonate, an acrylonitrile-butadiene-styrene, a polyethylene, a polyethylene terephthalate, and/or any combination thereof. In one embodiment, the top layer and/or bottom layer may comprise a 2-way or 4 way stretch fabric and a polymer film. The polymer film(s) may comprise a polyethylene film, polypropylene film, a polyurethane film, a nylon film, a polyester film, a polyvinyl chloride film and/or any combination thereof. The polymer film may be coupled or laminated to the 2-way or 4-way stretch fabric. The top layer and/or bottom layer may be the same material, or they may be different materials. In various embodiments, the individual foam layers of the one or more layer 72 and 73 may be the same foam material or different foam materials. The foam layer 72 may further comprise a single, continuous piece and/or two or more segmented pieces. The foam layer 74 may comprise an opening 76, the opening 76 sized and configured to receive a portion of the connection mechanism.

In various embodiments, the one or more foam layers 72 and 73 may comprise a single layer or multiple layers, which any of the layers may be comprised of the same or different various types of foam. In one example, the foam layer may comprise a first foam layer and a second foam layer. The first foam layer and/or a second foam layer may comprise of one single layer of foam, and/or a plurality of segmented foam components. The first foam layer and/or second foam layer may be disposed between the at least one top layer and/or at least one bottom layer. The first foam layer and/or second foam layer may be sized and configured to fit within the one or more recesses of the at least one top layer and/or at least one bottom layer. The one or more foam layers 72 and 73 include polymeric foams, quantum foam, polyethylene foam, thermoplastic polyurethane foam (foam rubber), XPS foam, polystyrene, phenolic, memory foam (traditional, open cell, or gel), impact absorbing foam (e.g., VN600), latex rubber foam, convoluted foam ("egg create foam"), Ariaprene, Evlon foam, impact hardening foam, 4.0 Custula comfort foam (open cell low density foam), and/or any combination thereof. The one or more foam layers 72 and 73 may have an open-cell structure or closed-cell structure. The one or more foam layers 72 and 73 can be further tailored to obtain specific characteristics, such as anti-static, breathable, conductive, hydrophilic, high-tensile, high-tear, controlled elongation, and/or any combination thereof. The foam layer, each of the one or more foam layers 72 and 73 and/or the impact mitigation structure may have a thickness ranging from 0.5 mm to 25 mm.

The at least one bottom layer 74 and/or the at least one top layer 71 can surround the complete perimeter of the one or more foam layers 72 and 73, and the connection mechanism 75 completely enclosing the components. The one or more foam layers 72 and 73, and the connection mechanism may be freely "floating" between the at least one top layer 71 and the at least one bottom layer 74. Alternatively, the at least one bottom layer 74 and/or the at least one top layer 71 can surround the complete perimeter of the impact mitigating structure, the distribution plate and/or the at least one foam layer, completely enclosing the impact mitigation structure leaving a flange around the perimeter.

FIGS. 9A and 9B depict exemplary embodiments of a plurality of modular fit pods and/or fit pod assemblies coupled to an inner surface of an inner layer 900 in various desired positions. In this embodiment, the plurality of fit pods or fit pod assemblies are desirably module and/or removably coupled to the inner layer. The plurality of fit pods may comprise fit pods of different sizes, shapes and thickness, and may be used to provide the wearer with a more customized helmet and/or may be standard sizes used for a standard helmet. Standard helmet sizes may include small, medium, large and extra-large. Each of the standard sizes may include a plurality of modular fit pods and/or fit pod assemblies.

For example, a standard small helmet size may comprise at least 7 modular fit pods and/or fit pod assemblies, where 6 modular fit pods and/or fit pod assemblies are removably connected and one modular pod may be fixed, as depicted in FIGS. 9A and 9B. In alternative embodiments, other numbers and/or arrangements of fit pods and/or fit pod assemblies could be provided, including the use of more and/or less fit pods or fit pod assemblies within a given helmet and/or helmet liner. Desirably, the different sized helmet layers could be accommodated by differently spaced, oriented and/or positioned modular fit pods and/or fit pod assemblies of identical length and/or height. To accommodate differently shaped heads, one of more of the modular fit pods and/or fit pod assemblies in a given helmet inner shell can be replaced with different sized and/or shaped modular fit pods and/or fit pod assemblies. With four different thicknesses of modular fit pods and/or fit pod assemblies to choose from (as depicted in FIG. 4), the present system allows a single helmet shell to provide over 4000 different pad combinations. Where an exemplary helmet system included small, medium, large and extra-large helmet shells with 6 replaceable modular fit pods and/or fit pod assemblies each, this system could provide over 16,000 combinations to accommodate virtually any head size and/or shape. In at least one alternative embodiment, a helmet system could include a small shell with 5 or 6 replaceable modular fit pods and/or fit pod assemblies, medium and/or large shells with 6 replaceable modular fit pods and/or fit pod assemblies each, and an XL shell with 6 or 7 replaceable modular fit pods and/or fit pod assemblies.

In various embodiments, each helmet and/or helmet liner size (i.e., small, medium, large and extra-large) could include at least one non-removable fit pod and/or fit pod assemblies (i.e., the frontal pod), which could comprise a pad having a ½" thickness at a central location, tapering down to ¼" thickness at the offset sides. Alternatively, the frontal fit pod and/or fit pod assembly could be removeable and/or replaceable, if desired, including the ability to change the thicknesses of the front pods and/or front fit pod assembly in a manner similar to those described with the other modular fit pods and/or fit pod assembly herein. If desired, the frontal fit pod and/or frontal fit pod assembly could include optionally replaceable thin and/or thick versions and/or other shapes and/or sized of fit pod, including versions to accommodate unusual fit circumstances.

If desired, the front fit pod and/or front fit pod assembly could utilize a snap-fit connection to the shell (which could be similar to various other modular pod connections described herein), or the front fit pod and/or the frontal fit pod assembly could be attached to the shell by hook and loop type fasteners and/or held in by a cloth pouch attached to the front bumper and/or the shell using Velcro or some other fastening mechanism. Alternatively, other types of connection mechanisms may be utilized, which include Velcro (hook and loop), adhesives, snaps, screws, press-fittings, magnetic mechanisms, and/or any combination thereof.

By providing modular fit pods and/or fit pod assemblies of similar height and length, in 4 different thicknesses (i.e., ¼", ½", ¾" and 1" thicknesses), along with four different helmet liner sizes (i.e., small, medium, large and extra-large), the present system significantly reduces the cost and complexity of the system and its components (although the use of various other numbers of pod sizes and/or shell sizes is contemplated herein, including 2 sizes and/or 5 sizes of pods and/or shells). The modular fit pods and/or fit pod assemblies themselves can be manufactured in bulk, with each thickness change typically requiring little or no modification to the manufacturing and/or processing equipment, which greatly reduces the cost-per-unit for each modular pod. Moreover, an equipment manager would only need to stockpile four different shell sizes, along with some modular pads of the four differing thicknesses (i.e., a small bag of each size), which could be altered and interchanged at will to fit each player. In a similar manner, only a few liner sizes need be stockpiled to accommodate a wide range of players, such as S/M and L/XL liners for the S, M, L youth helmet and one liner for the M, L, XL varsity helmet, if desired.

If desired, the modularity of the fit pods and/or fit pod assemblies could provide "position-specific" features for a player wishing to provide supplemental and/or particularized protection with one or more enhanced principal impact zones and/or impact types that can be particularized to a specific player-position and/or the individual behavior of a specific player (i.e., supplemental protection from one or more directions and/or types of impacts that may be anticipated based on the player's position and/or type of play). For example, a player may wish to incorporate additional impact protection into a right side of the player's helmet, such as where the player tends to "lead with their right" in impact situations and/or where the location of the player's position tends to lead to a greater magnitude of right side impacts (i.e., the right-side guard position). If desired, the speed, direction, and magnitude of impact and/or player force could be collected during each player activity and analyzed to tailor impact protective elements for the specific player position.

In order to increase the amount of protection on the right side of the helmet, the player may simply replace one or more of the modular fit pods and/or fit pod assemblies on the right side of the helmet and/or helmet liner with thicker fit pods and/or fit pod assemblies, which could include replacement of modular fit pods and/or fit pod assemblies of the left helmet side with thinner fit pods (to balance the width reduction) and/or fit pod assemblies. Alternatively, the player may choose an "oversized" liner and/or helmet which may be slightly "too big" for the player, and then the player can replace the modular pods in one or more locations with thicker fit pods (to increase the impact absorbing layer depth and also to "fit" the helmet more appropriately) and/or fit pod assemblies.

The one or more modular fit pod assemblies may be desirably positioned around various locations of the wearer's head, such as covering much of the area between an inner shell of the helmet and the user's head. Such plurality of fit pod assemblies may include one or more of the following: a frontal assembly (or front), a crown assembly, an occipital assembly (or lower-back), a mid-back assembly, a parietal assembly (or midline), and a temporal assembly (right and/or left sides), and/or any combination(s) thereof. At least a portion of the fit pod assemblies may be removably coupled to at least one inner layer, impact mitigation layer, outer layer and/or any combination thereof to facilitate energy absorption, reduce angular motion and/or rotational motion of the wearer after impact, enhance fit and comfort.

The fit pod and/or fit pod assemblies may be manufactured in different ways. In one embodiment, the fit pod may comprise a top layer, a bottom layer, and at least one foam layer. The at least one foam layer is disposed between the top layer and bottom layer. Disposed being "free-floating" between the top and bottom layer and/or coupled to the top and/or bottom layer. The at least one foam layer may comprise a first foam layer and a second foam layer. The at least one foam layer may be a single, continuous piece of foam material. Alternatively, the at least one foam layer may be two or more segmented pieces of foam material. The top layer and the bottom layer may be the same materials or may be different materials. The top layer may be coupled to the bottom layer. The coupling may include adhesive, Velcro, ultrasonic or impulse welding, stitching, heat sealing, heat or hot melt, vacuumed formed, thermoformed, and/or any combination thereof.

FIGS. 14A through 14D, 15A through 15D and 16A through 16D depict various additional exemplary embodiments of fit pod assemblies comprising a fit pod and a connection mechanism.

Figure 10:
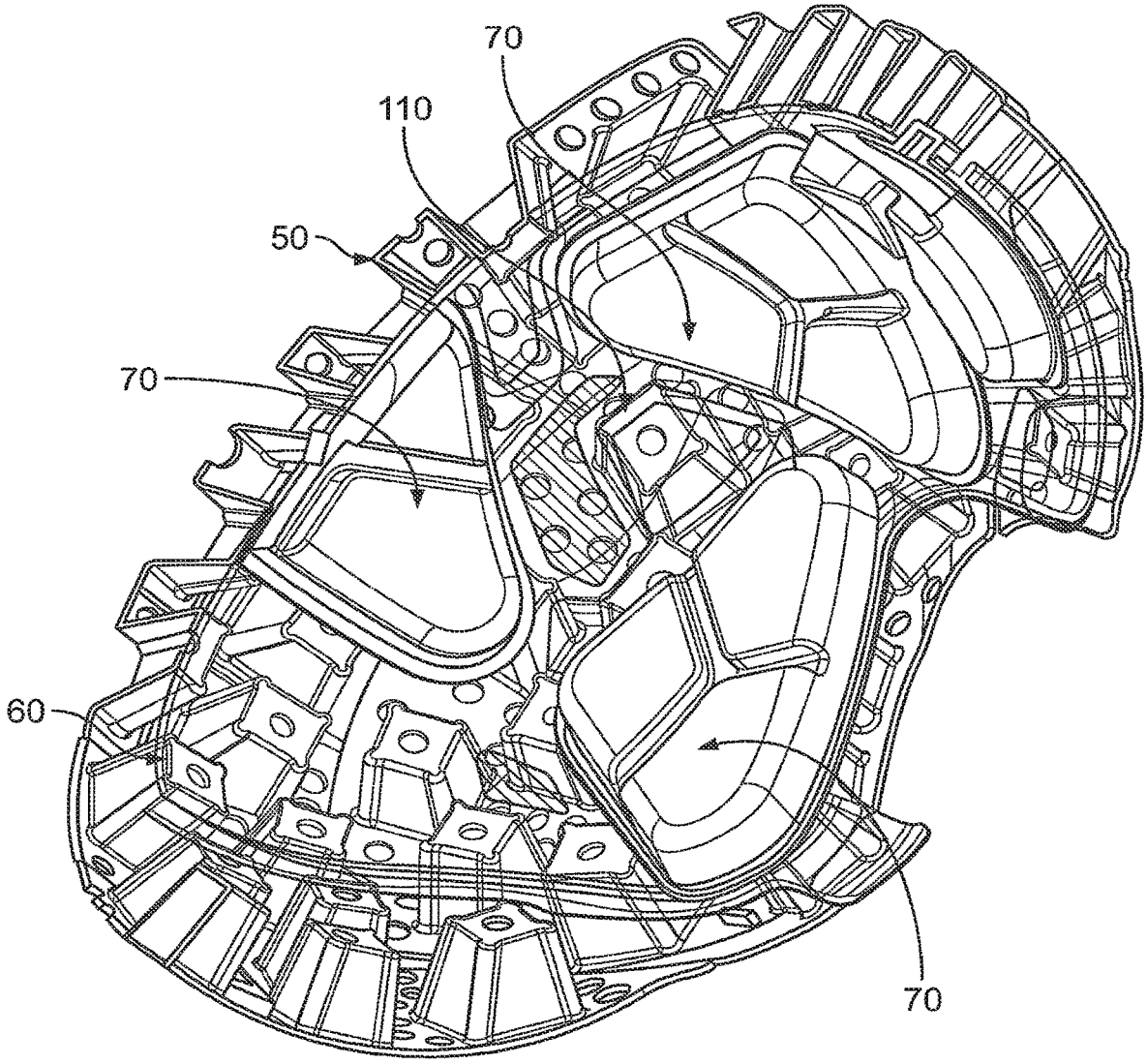
FIG. 10 depicts a bottom perspective view of a portion of one embodiment of a helmet system with various modular components installed, including a plurality of fit pods, an inner layer or cap (shown as transparent) and an energy absorbing impact layer.
Figure 11A:
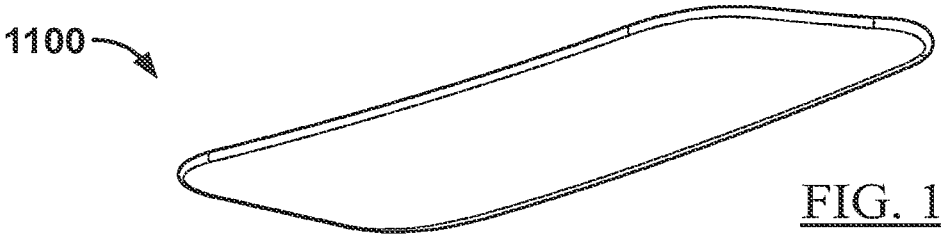
FIGS. 11A through 11D depict various embodiments of a plate member which can be secured to a corresponding plate mounting location on a helmet shell.
Figure 11B:
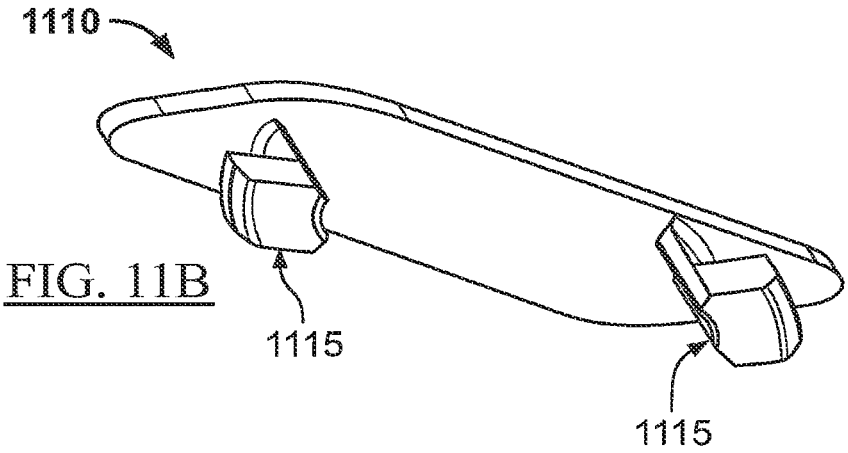
Figure 11C:
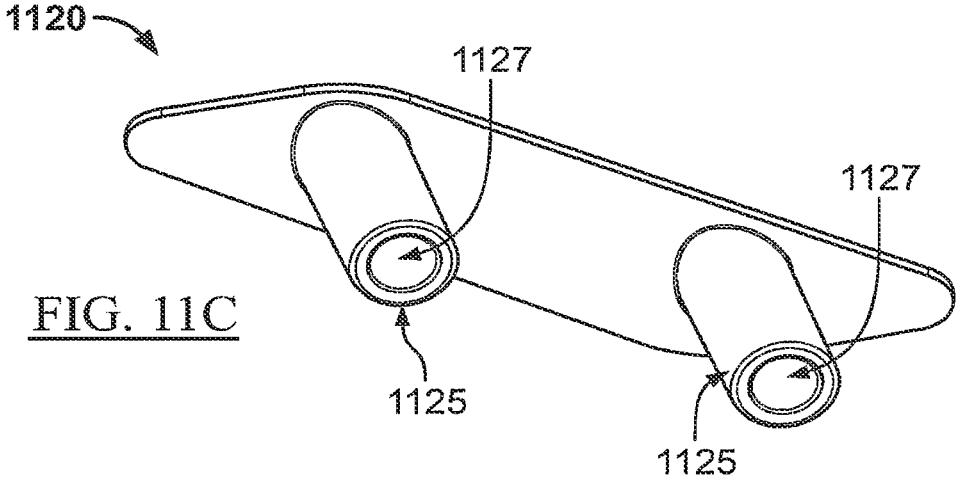
Figure 11D:
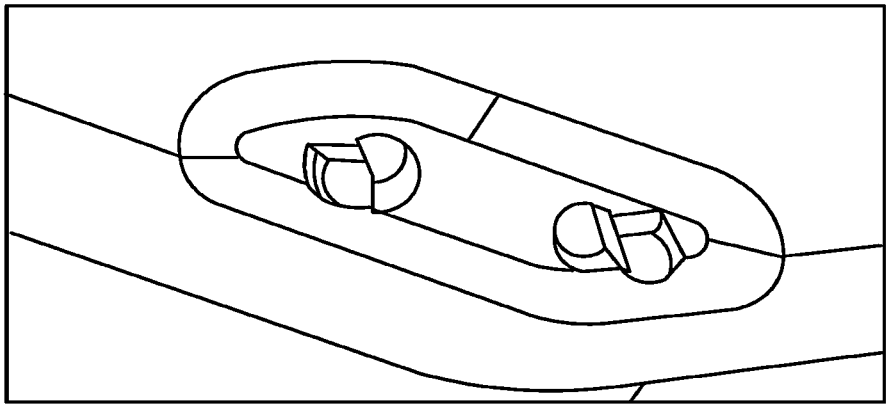

FIG. 10 depicts a bottom perspective view of a portion of the helmet system with various modular components installed, including a plurality of fit pods 70, an inner layer or cap 60 (shown as transparent in this figure) and an energy absorbing impact layer 50. Also depicted are base foam inserts 110, which can desirably provide additional coverage to the inner shell in locations between fit pods and/or vents, as well as being used to cover fastener heads and/or guide installation of fit pods in the helmet.

FIGS. 11A through 11D depict various embodiments of a plate member 1100 which can be secured to a corresponding plate mounting location 116 on a helmet shell 20 (see FIG. 1). The plate member 1100 may include a front plate 1110 with securement lugs 1115 which can "snap-fit" to secure the front plate into openings within the helmet shell (see FIG. 11D). If desired, the front plate 1110 may be utilized as aesthetic feature and/or a logo may be disposed onto the front plate. Alternatively, the front plate 1110 may comprise at least a portion of an impact mitigation structure, as disclosed herein, with the impact mitigation structure affixed to the shell 301. Alternatively, the front plate 1120 may have securement posts 1125 with holes 1127 formed therein, which could accommodate screws or posts or other securement features for securing the plate to the shell 20, such as for example add-on features that would add additional protection in specific locations which would be desirable to mitigate impact forces that certain players are more likely to be subject to (i.e., position-specificity). Alternatively, the securement holes and/or other features may comprise rivets, screws, snaps, Velcro, adhesive, press fit, and/or any combination thereof.

FIGS. 5A and 5B depict an exemplary facemask having a plurality of rod-like segments or bars that, when connected together and attached to the helmet system, can create a protective lattice, screen or "cage" to protect the wearer's face. The plurality of rod-like segments or plurality of bars may have a diameter range of ⅛ inch to 2 inches, or other diameters and/or cross-sectional shapes known in the art. In the disclosed embodiment, the facemask 80 can include an upper portion 500 and a lower portion 550, the upper portion 500 including a top bar 510 and a lower bar 520, the top bar 500 having a first arched section 503, a second arched section 507, and a central section 505, the first and second arched sections 503 and 507 being bent upwardly away from the lower bar 520. The lower portion 550 includes at least a top bar 555 and a lower bar 560, with one or more vertical bars 570 extending therebetween. Each of the one or more generally vertical bars 570 may be positioned equidistant and/or symmetric to the adjacent one or more vertical bars 570. Alternately, each of the one or more vertical bars 570 may be positioned non-equidistant and/or asymmetric to the adjacent one or more vertical bars 570.

Figure 12A:
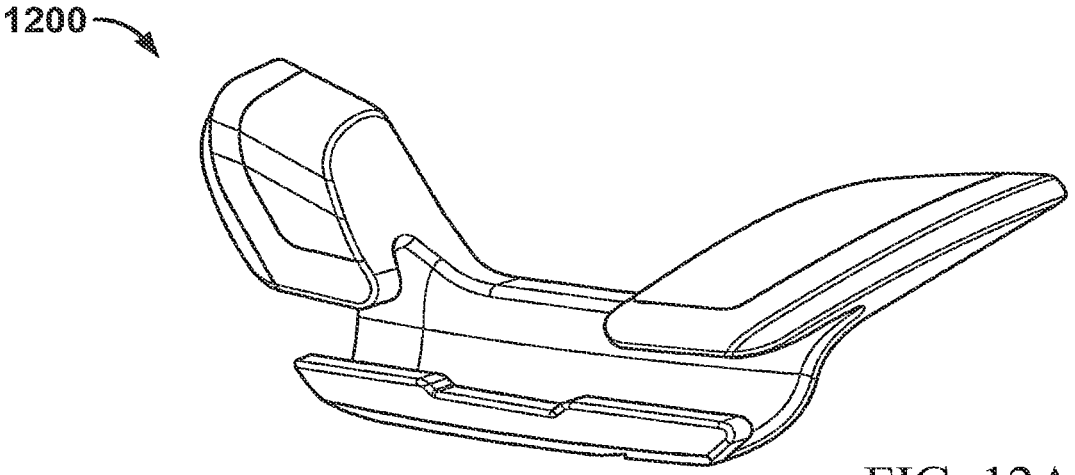
FIGS. 12A and 12B depict one exemplary embodiment of a facemask connector for use with the facemask of FIGS. 5A and 5B.
Figure 12B:
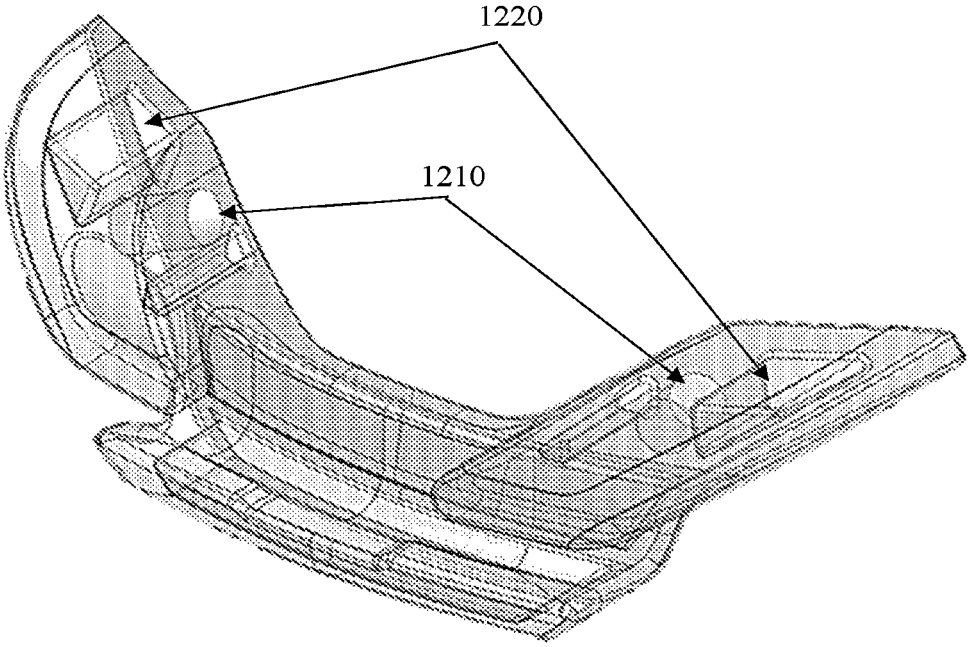

FIGS. 12A and 12B depict one exemplary embodiment of a facemask connector 1200 for use with the facemask of FIGS. 5A and 5B. In this embodiment, the connector 1200 can be attached to various openings in the front of the shell in a conventional manner using openings 1210 and 1220 in the connector, which can accommodate a variety of attachment modalities including posts, rods, screws, adhesives and the like. In use, the facemask connector can include flexible tabs 1230 which desirably allow the upper portion 500 and/or lower portion 550 of the facemask rods to slide into the connector and "snap lock" into place, with the flexible tabs 1230 retaining an upper portion of the facemask, which can include retention of up to 48% of the facemask bar by the flexible tabs. Additional securement tabs (not shown) can be utilized to attach various peripheral portions of the facemask to various locations of the shell 20 around the face opening in a known manner.

Figure 13A:
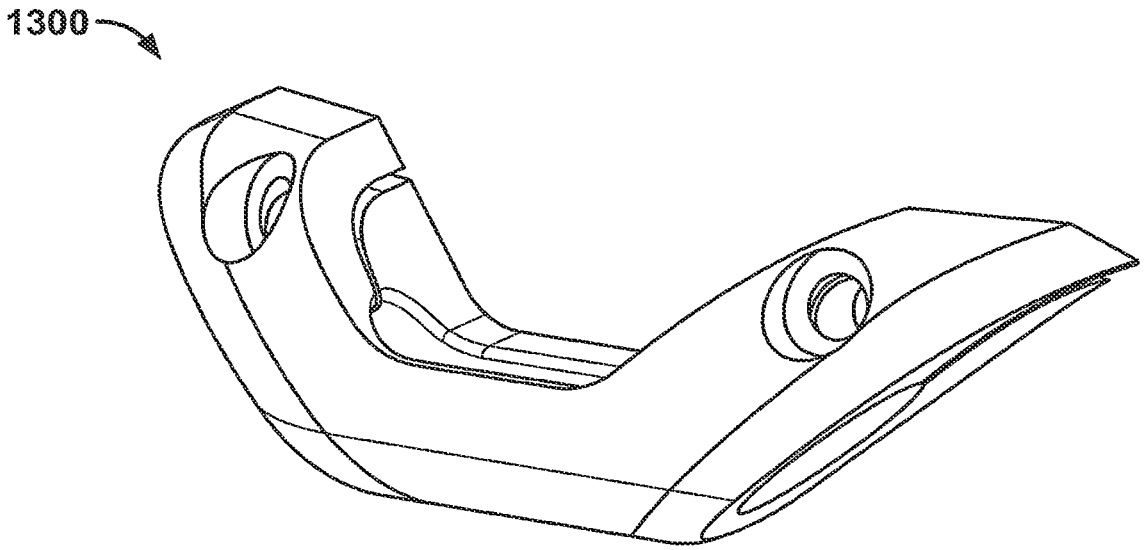
FIGS. 13A and 13B depict another alternative embodiment of a facemask connector for use with the facemask of FIGS. 5A and 5B.
Figure 13B:
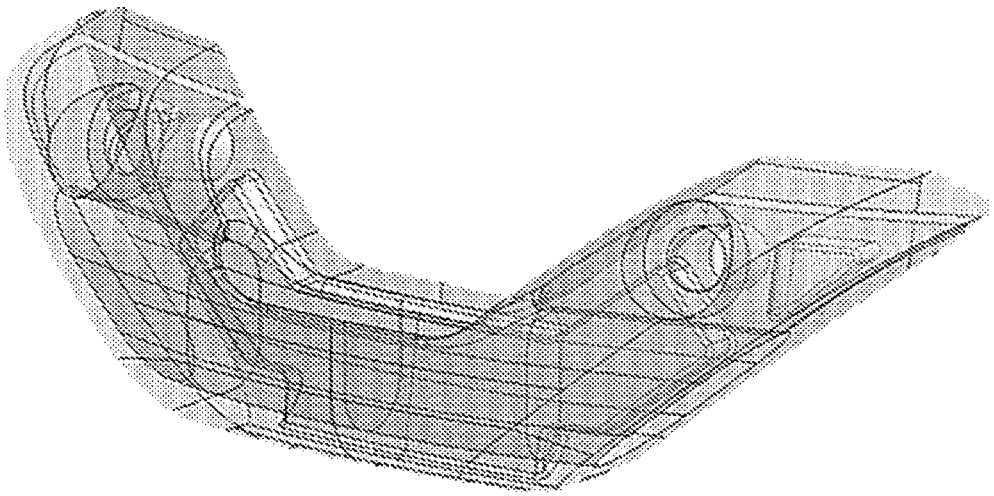
Figure 14A:
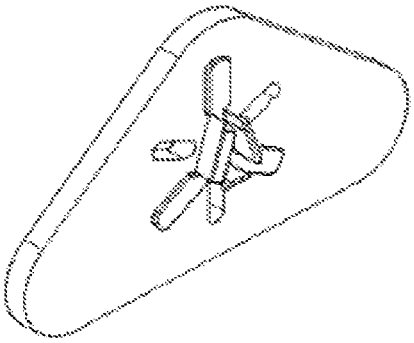
FIGS. 14A through 14D, 15A through 15D and 16A through 16D depict various additional exemplary embodiments of fit pod assemblies comprising a fit pod and a connection mechanism.
Figure 14B:
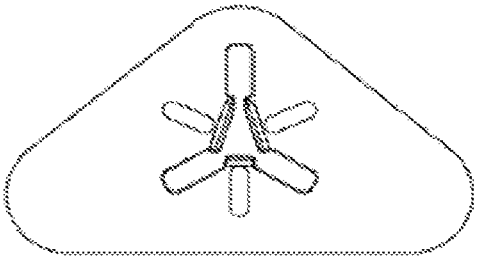
Figure 14C:
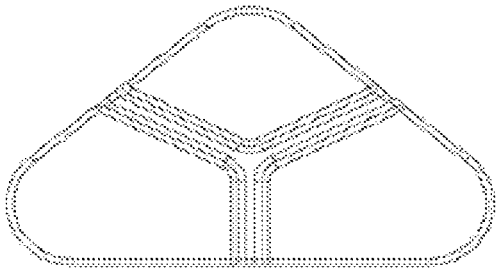
Figure 14D:
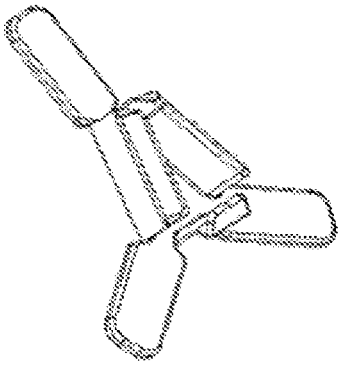
Figure 15A:
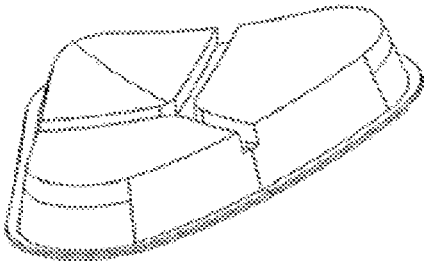
Figure 15B:
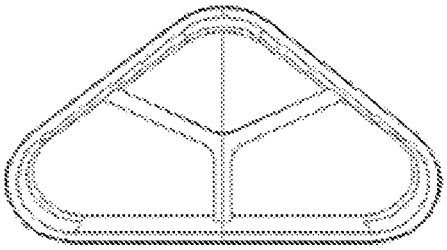
Figure 15C:
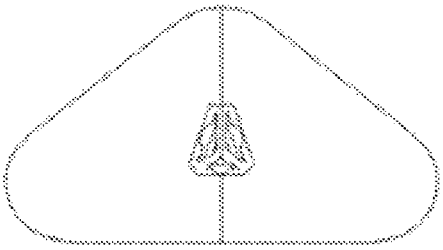
Figure 15D:
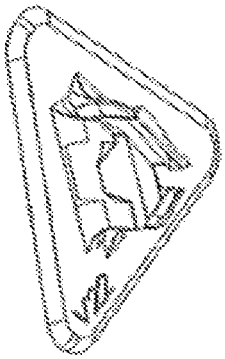
Figure 16A:
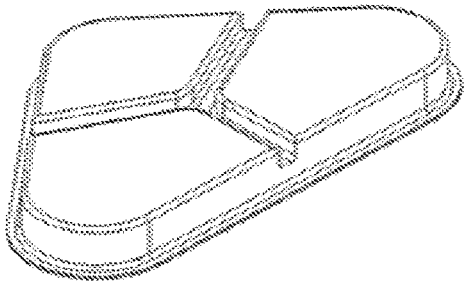
Figure 16B:
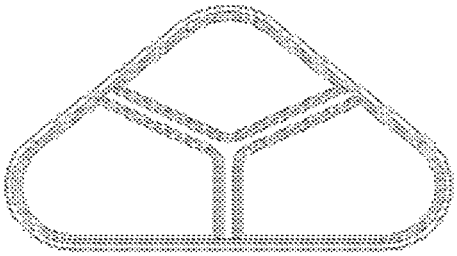
Figure 16C:
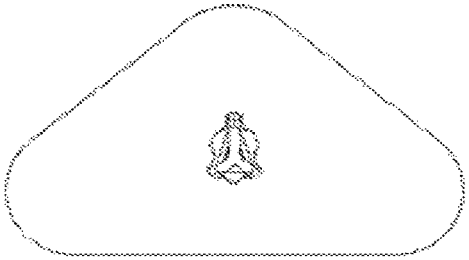
Figure 16D:
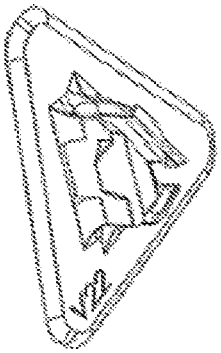

FIGS. 13A and 13B depict another alternative embodiment of a facemask connector 1300 for use with the facemask of FIGS. 5A and 5B. In this embodiment, the connector 1300 can include a conventional clamshell arrangement which opens to sandwich the facemask rods within the connector halves, and then the connector can be closed and secured to the helmet via a threaded connector through openings 1310 in the connector 1300, which can be attached to corresponding openings (not shown) in the helmet shell in a conventional manner. If desired, the connector 1300 could alternatively be attached to the shell by some type of bayonet-mounted feature, such that the facemask can be connected to the helmet in a quick release fashion that permits the facemask to be removed in a matter of seconds.

Figure 17A:
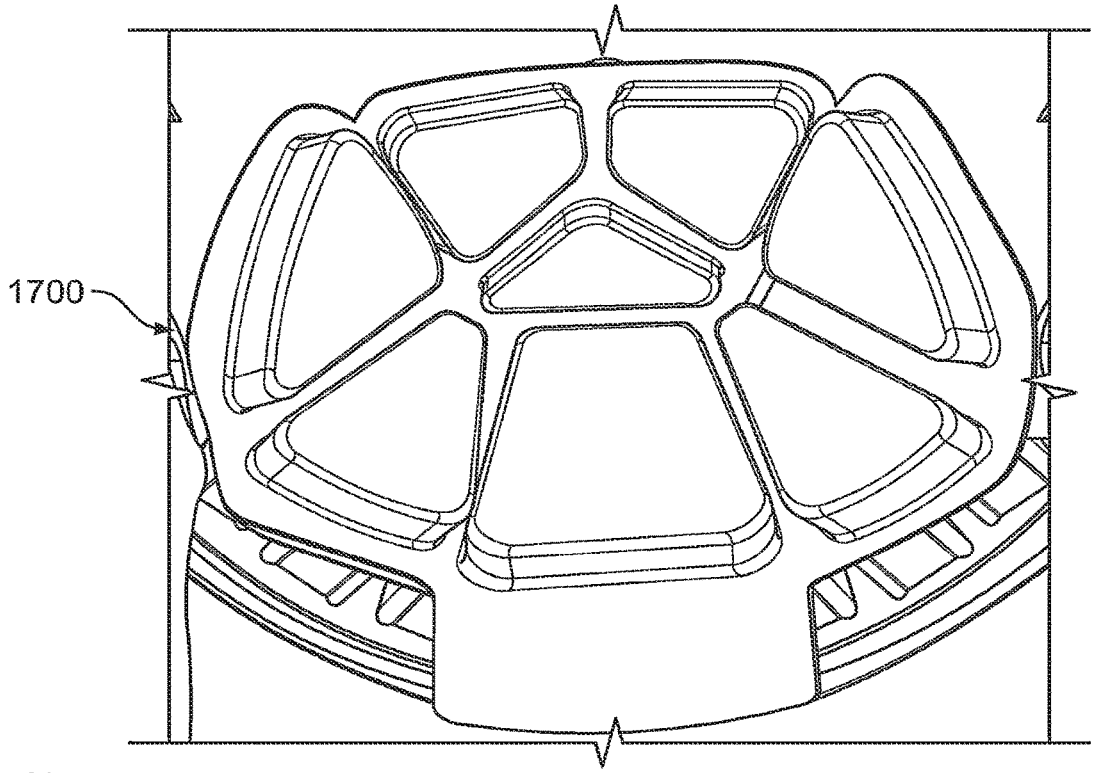
FIGS. 17A through 17C depict one exemplary embodiment of a front foam impact pad and an additional layer or shield of plastic material which can be attached to an inner surface of the front foam impact pad.
Figure 17B:
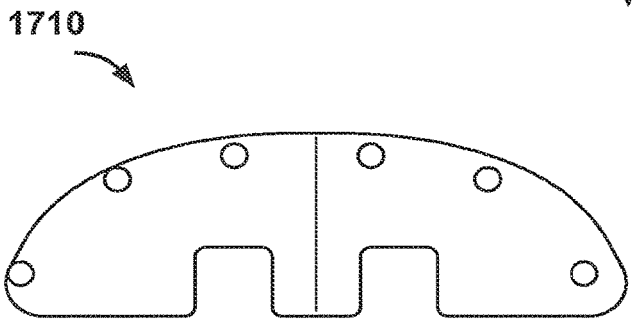
Figure 17C:
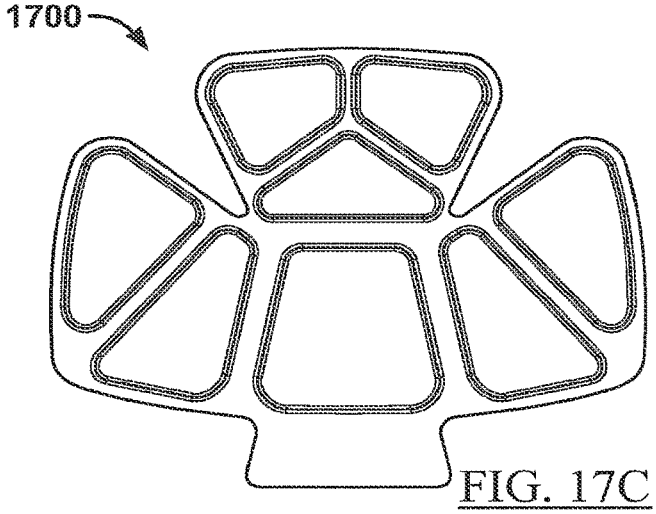

FIGS. 17A through 17C depict one exemplary embodiment of a front foam impact pad 1700 and an additional layer or shield 1710 of substantially rigid plastic material which can be attached to an inner surface of the front foam impact pad. Such front foam impact pad can be positioned within a face opening of the inner shell of the helmet, with the front foam impact pad attached to an inner surface of an impact absorbing array, such as a surface of the front modular array 800 shown in FIG. 8C. In this embodiment, the shield 1710 can comprise a layer or sheet of polycarbonate material, with the front foam impact pad comprising a bottom layer of TPU film, PVC film and/or Polyurethane-coated fabric, a middle layer of one or more die cut impact foam pieces, and a top layer of TPU film, PVC film and/or Polyurethane-coated fabric (or any combinations thereof). If desired, the outer material layers may completely encase the comfort foam layer and/or pieces, or alternatively the pad may not be completely sealed if vent holes are deemed necessary or desirable to allow the pad to breathe and/or to avoid 'bubbling' of the material. In various embodiments, the various materials may be sealed, welded and/or bonded together, if desired.

In various embodiments, the front foam impact pad 1700 and/or shield 1710 may be attached to various components of the helmet using Velcro or other attachment means. In one desired embodiment, the shield can weigh approximately 0.23 ounces, with the foam pad weighing approximately 2.4 ounces. Desirably, the front foam pad and shield height will approximate and/or match the stack up height of the corresponding fit pods in other locations of the helmet. Desirably the front pad will wrap around the front of the wearer's head and desirably improve the impact resistance and/or comfort and fit of the helmet system on the player or wearer. The front foam pad may comprise a plurality of pads, if desired.

Figure 18A:
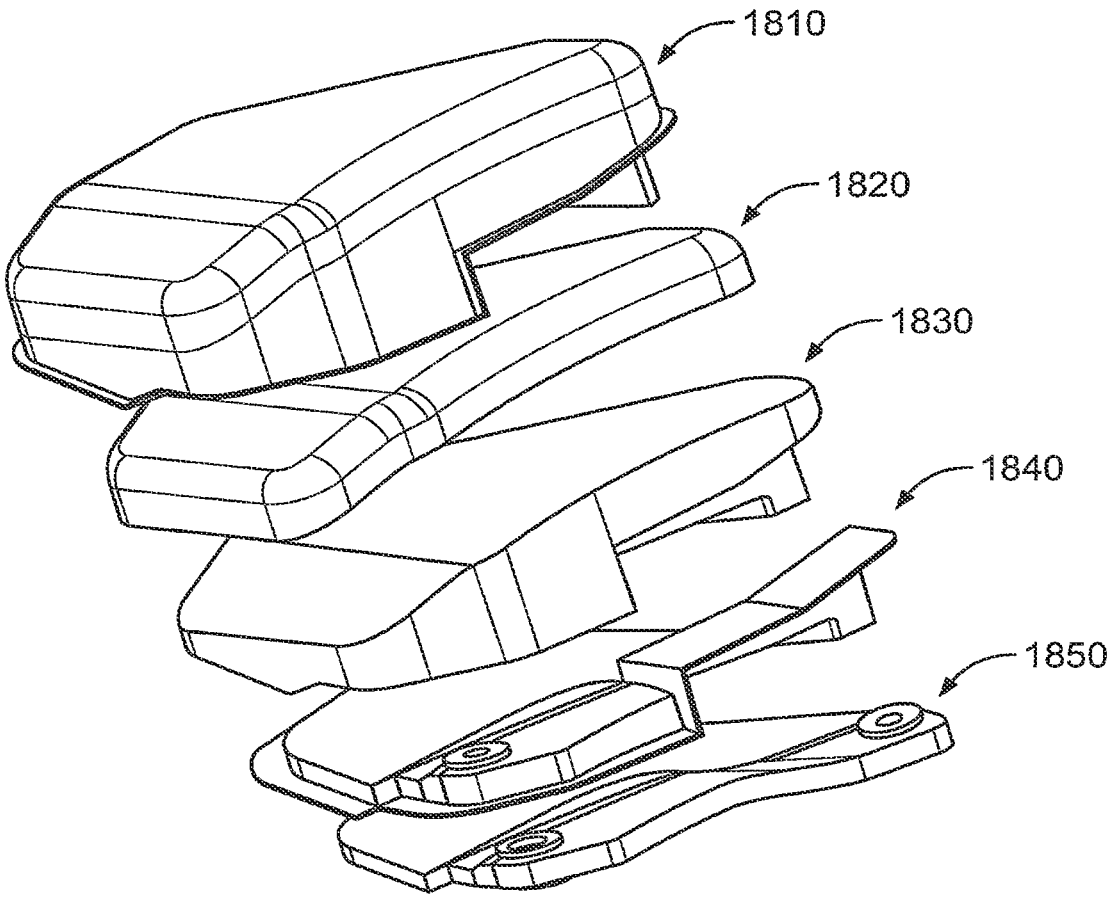
FIGS. 18A and 18B depict exploded and cross-sectional views, respectively, of a modular jaw fit pod assembly for use with various helmet system components.
Figure 18B:
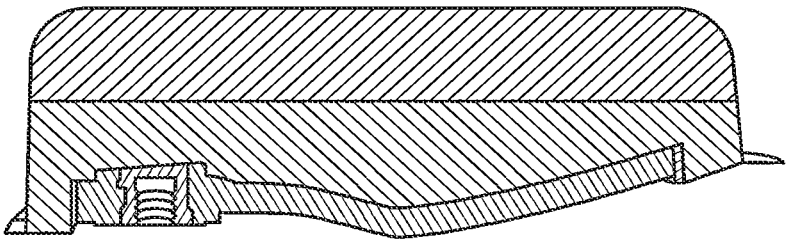

FIGS. 18A and 18B depict exploded and cross-sectional views, respectively, of a modular jaw fit pod assembly for use with various helmet system components. The jaw fit pod assembly can comprise a base plate that can accommodate hardware for connection to a helmet jaw region (not shown), which can be bonded or attached via mechanical means (such as Velcro, screws, posts . . . ) to an impact mitigation foam/structure. The impact mitigation/comfort foam or structure can be covered with a top and bottom layer of material, such as TPU. In various embodiments, the base plate and/or impact mitigation structure combination can be removed from the helmet in emergencies when the helmet needs to be removed without moving the head or neck of the player. Various inserts can be provided which fits within the impact mitigation structure, comprising comfort and/or impact mitigation foam layers. In various embodiments, the insert may comprise a modular piece, offered in multiple thicknesses and/or configurations, so a user could "fine tune" tune the jaw pad fit.

As depicted in FIG. 18A, the various layers of the jaw pad assembly can include (1) an outer layer 1810 of Polyurethane coated fabric, (2) A layer 1820 of comfort foam, (3) a layer 1830 of thermoformed EVA or equivalent foam, (4) a vacuum formed TPU film layer 1840, and (5) an injection molded jaw plate 1850 with stainless inserts. The jaw pad assembly can comprise a jaw pad and a plate, the jaw pad having a top layer, a bottom layer, and a first and second foam layer disposed between the top and bottom layer. The first foam layer can be comfort foam, the second foam layer is impact foam. All layers can be thermoformed together and/or glued to each other. The jaw pad can be coupled to the plate.

A protective enclosure base can also be incorporated into the jaw pad, with a base plate and various connective mechanisms such as screws and or clips (not shown) to attach the base to the helmet. If desired, an impact mitigation structure (including the various pods described herein) or similar devices may be removably coupled to and/or within the protective enclosure base, and the protective enclosure base may be coupled to the base plate. In various alternative embodiments, the jaw pad may attach to the jaw plate using removable connectors such as Velcro.

Figure 19A:
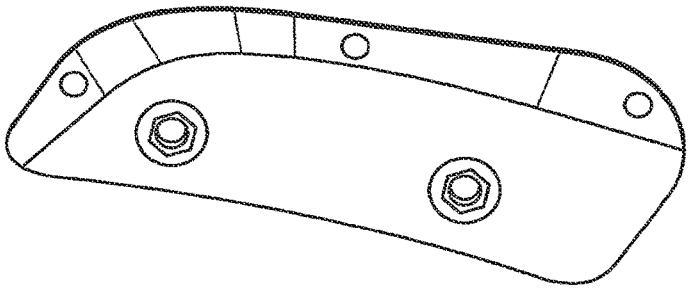
FIGS. 19A through 19B depict views of one exemplary embodiment of a bridge connection plate.
Figure 19B:
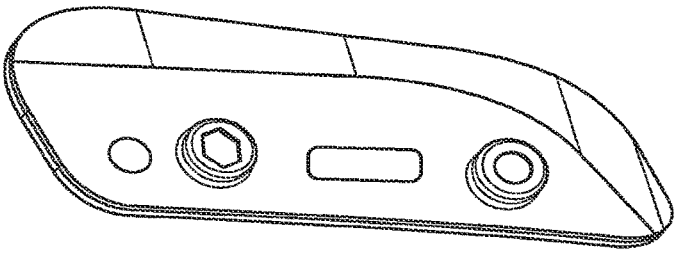
Figure 19C:
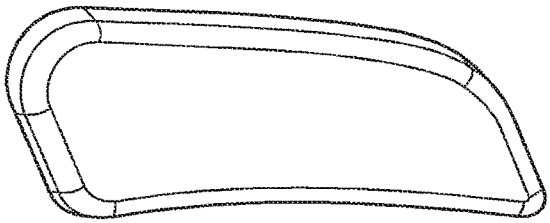
FIGS. 19C and 19D depicting an embodiment of a bridge fit pod assembly having at least one foam layer.
Figure 19D:
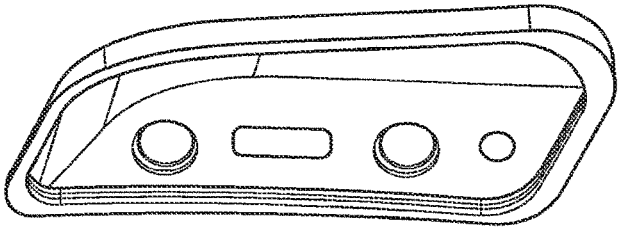
Figure 20A:
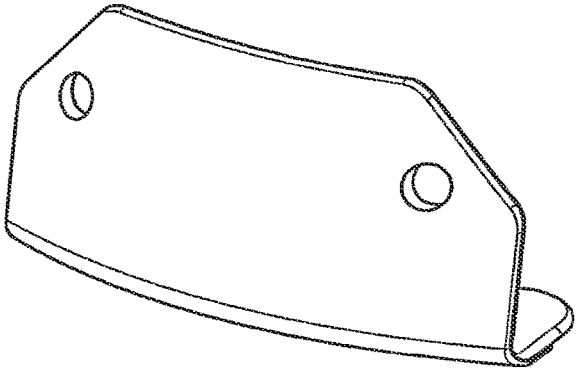
FIGS. 20A through 20D depict front and rear bumpers which can be attached to a helmet in a conventional manner.
Figure 20B:
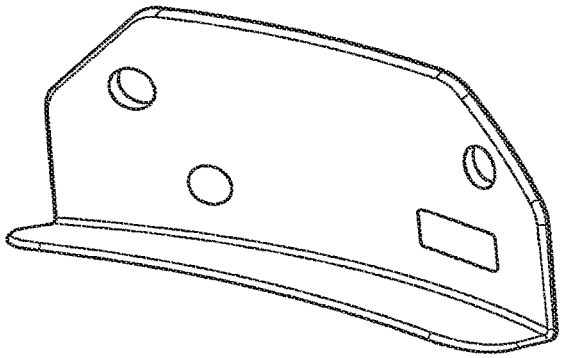
Figure 20C:
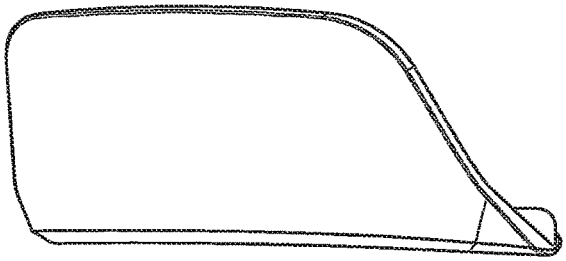
Figure 20D:
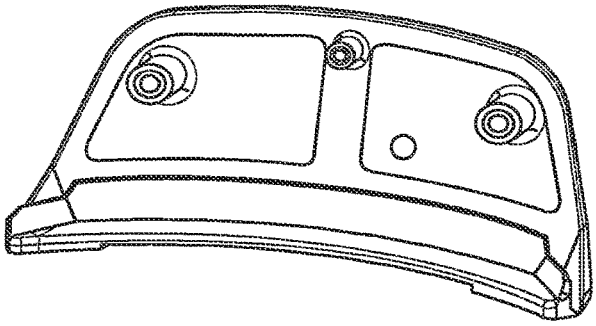
Figure 21A:
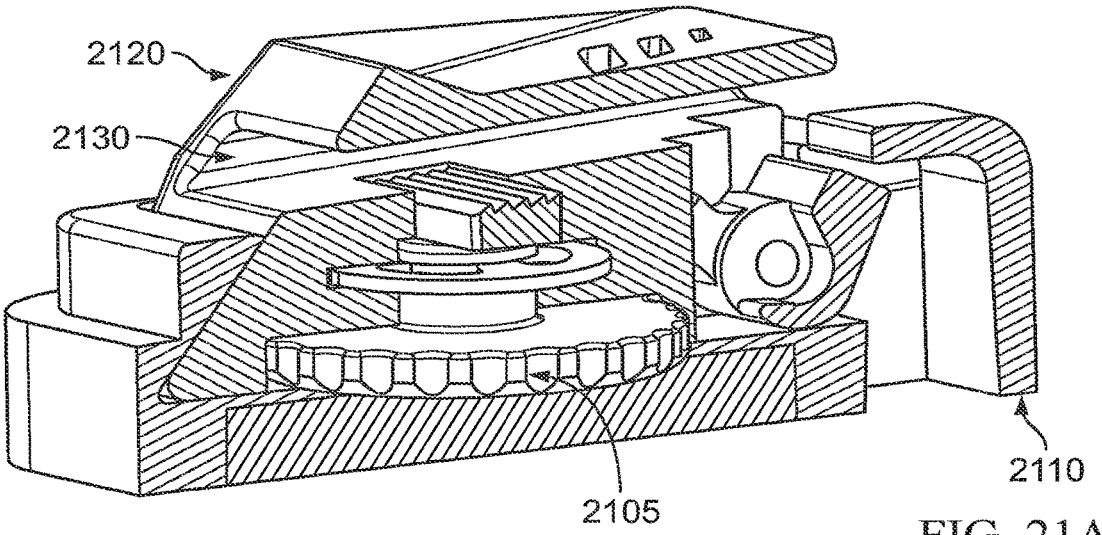
FIGS. 21A through 21G depict various views of embodiments of chinstrap closure and adjustment mechanisms, including a helmet base and a strap lock.
Figure 21B:
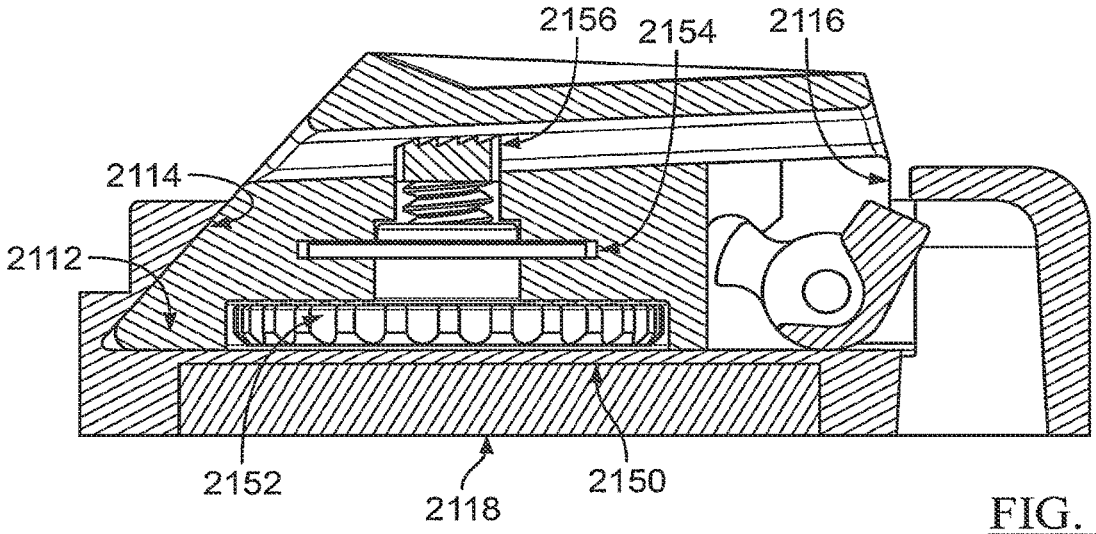
Figure 21C:
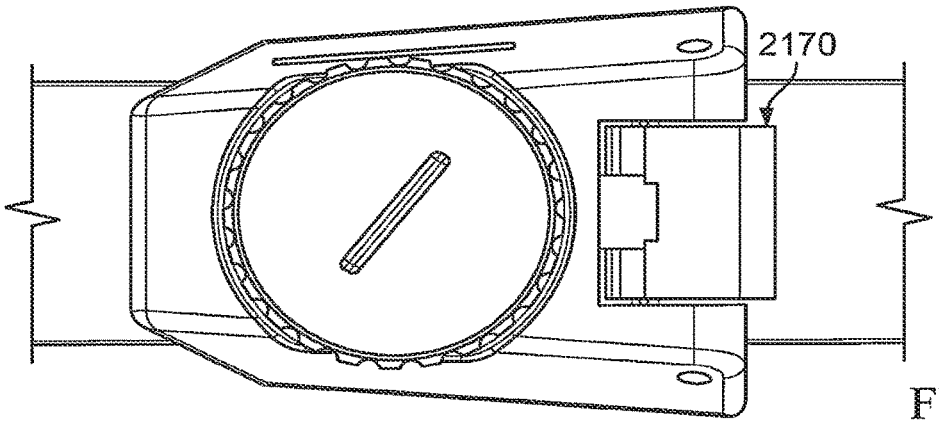
Figure 21D:
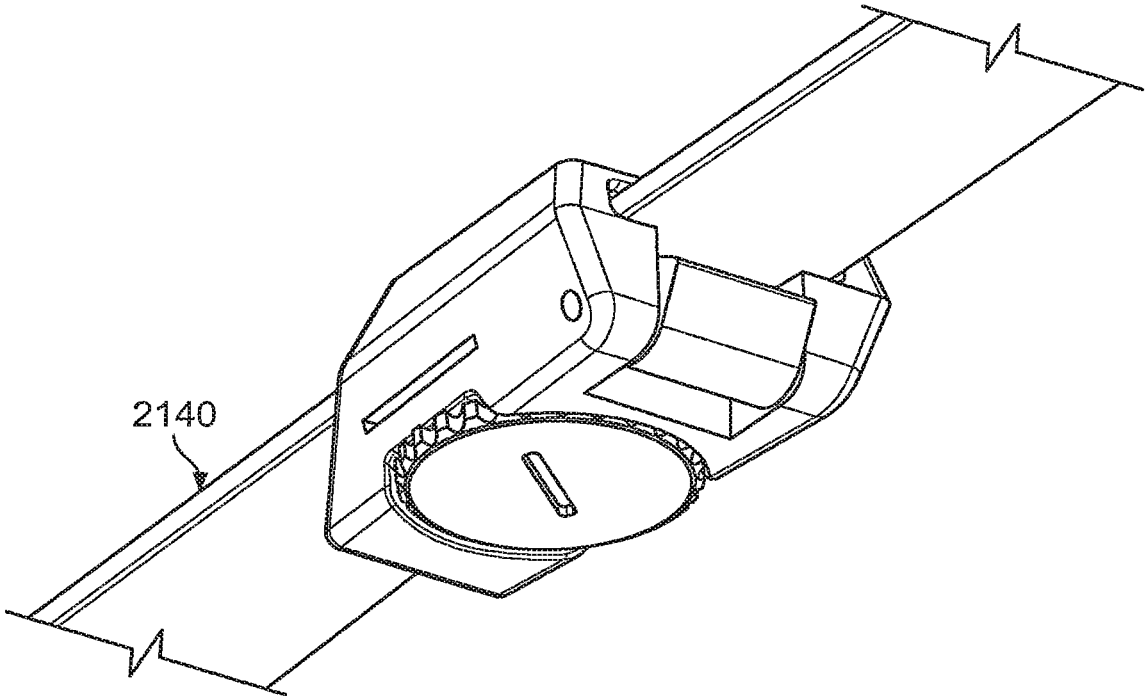
Figure 21E:
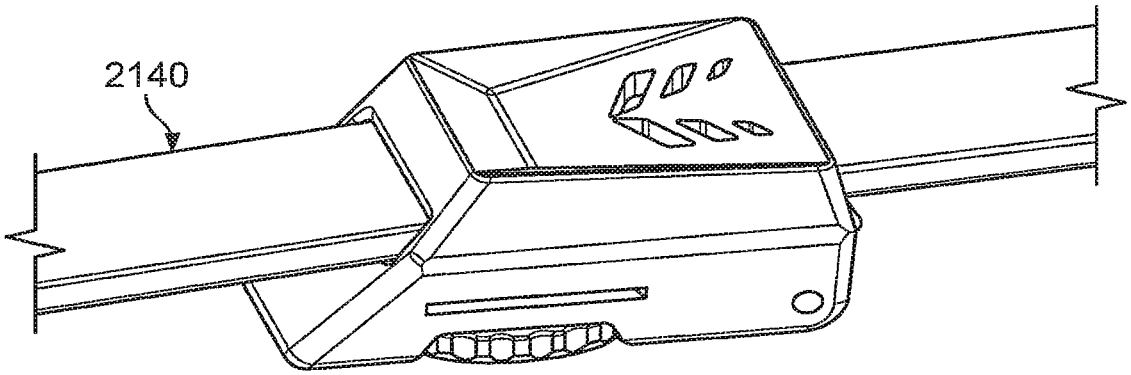
Figure 21F:
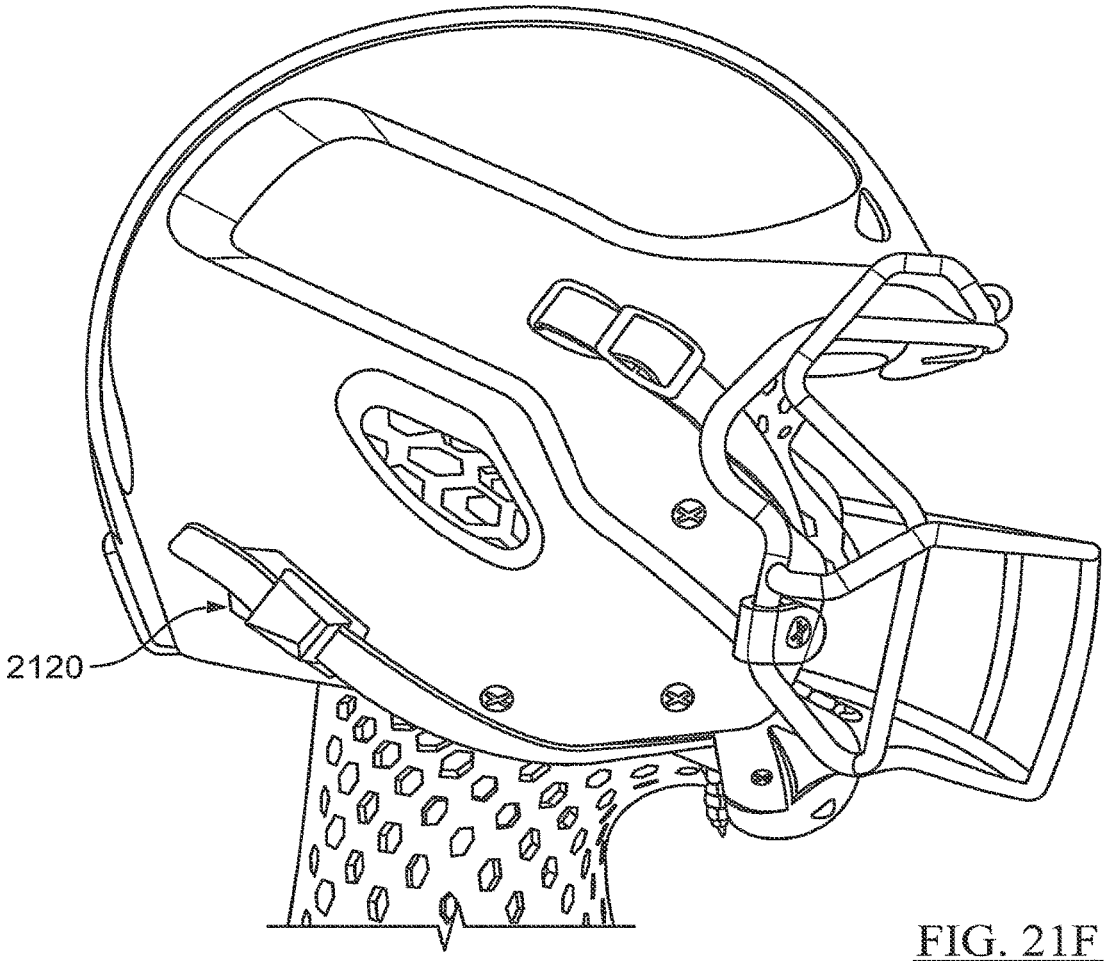
Figure 21G:
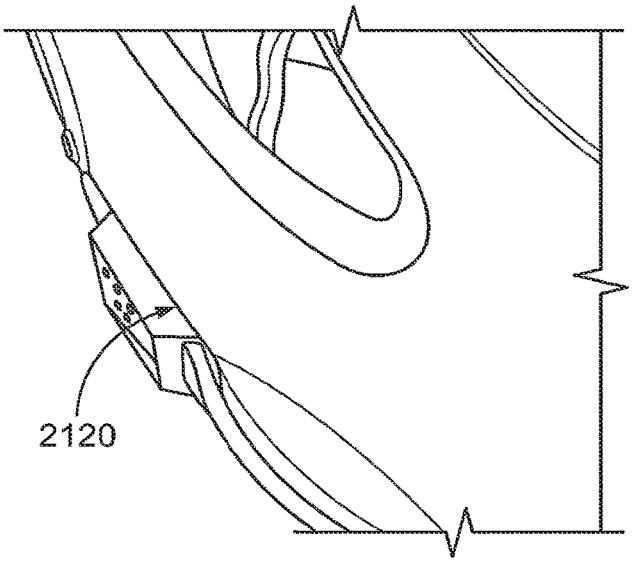

FIGS. 19A through 19B depict views of a bridge connection plate, with FIGS. 19C and 19D depicting an associated bridge fit pod assembly having at least one foam layer. The bridge fit pod assembly and/or the bridge connection plate are desirably removably coupled to the helmet. The bridge fit pod assembly can extend planar with the surface of the helmet towards the back of the head or the back of the player's jaw.

FIGS. 20A through 20D depict front and rear bumpers which can be attached to the helmet in a conventional manner.

FIGS. 21A through 21G depict various views of a chinstrap closure and adjustment mechanism 2100, which includes a helmet base 2110 and a strap lock 2120. The strap lock includes a strap slot 2130 for accommodating a strap 2140 therethrough, a toolless tension adjustment feature 2150 and a spring-loaded retention mechanism 2170 having a set spring positioned therein (not shown). The toolless tension adjustment feature 2150 includes a rotating adjustment wheel 2152, a retention clip 2154 and an externally threaded tension element 2156 having externally facing teeth. Rotation of the rotating adjustment wheel 2152 desirably raises and lowers externally facing teeth in contact with the strap 2140, locking and/or unlocking the strap relative to the strap slot 2130. The helmet base 2110 desirably includes a wedge-shaped opening 2112, an overhanging frontal lip 2114, a rearwardly positioned detent lip 2116, and a magnetic element 2118 positioned within the base 2110.

Prior to use, the strap lock 2120 can desirably be secured in a chosen position on the strap by tightening of the rotating adjustment wheel 2152, and the strap lock can be positioned near the helmet base 2110. Desirably, the magnetic element 2118 will attract the rotating adjustment wheel 2152 (which can partially and/or fully comprise a magnetic metal such as iron, nickel, cobalt and/or some other are earth metal alloy, stainless steel, other ferrous metals, certain arrangements of copper, manganese and Buckyballs, ceramics and/or electromagnets) towards the helmet base, and may also desirably align the strap lock with the wedge-shaped opening 2112 of the helmet base. Once the strap lock enters the wedge-shaped opening, the proximal end of the strap lock will desirably engage with the overhanging frontal lip 2114, and the spring-loaded retention mechanism 2170 at the rear portion of the strap lock 2120 will desirably engage with the rearwardly positioned detent lip 2116, with these features desirably engaging due to attraction of the rotating adjustment wheel 2152 to the magnetic element 2118.

During employment on a helmet shell (see FIGS. 21F and 21G), the relative shapes of the strap lock 2120 and the wedge-shaped opening 2112 of the helmet base will desirably retain the strap lock within the helmet base, as expected forces acting on the chin strap of the helmet during game play and/or impact events are anticipated to be primarily causing tension on the chin strap in a direction towards the face opening of the helmet (which tends to seat the strap lock deeper into the wedge-shaped opening during normal impact events). If removal and/or readjustment of the chin strap is desired, the wearer or another player or assistant can pull on a distal tail of the chinstrap (which is the untethered end of the chin strap), with a quick pull up and away from the helmet desirably being sufficient to disengage the spring-loaded retention mechanism from the rearwardly positioned detent lip 2116, allowing the strap lock to be removed from the helmet base and adjusted.

Desirably, the disclosed arrangement grants a wearer the ability to easily adjust chin strap positioning and/or tension using a single hand, with the locking mechanism providing self-alignment without requiring direct visualization by the wearer. In addition, the present invention allows the wearer to use very little and/or no additional force to engage the locking device to the helmet, with the requirement for an intentional and significant application of force to disengage the locking mechanism to remove and/or readjust the chin strap.

Figure 22A:
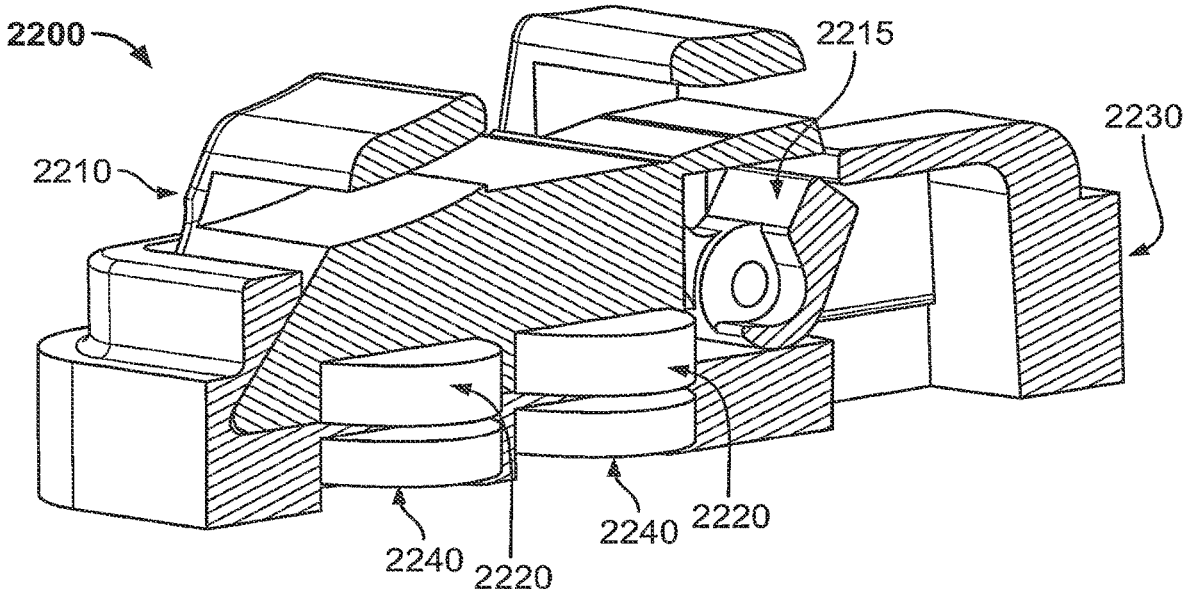
FIGS. 22A and 22B depict various views of an alternative embodiment of a chinstrap closure and adjustment mechanism.
Figure 22B:
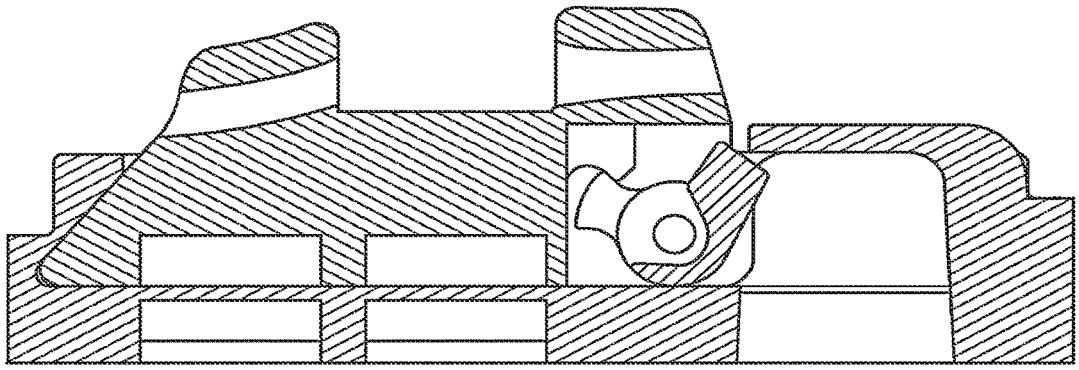

FIGS. 22A and 22B depict various views of an alternative embodiment of a chinstrap closure and adjustment mechanism 2200, which includes a wedge-shaped strap lock 2210 having a pair of magnetic elements 2220 and a spring-loaded retention mechanism 2215, with the helmet base 2230 having a wedge-shaped opening, an overhanging frontal lip, a rearwardly positioned detent lip, and a pair of corresponding magnetic base elements 2240 positioned within the base. In this embodiment, the magnetic elements 2220 can be arranged such that they are reversed in polarity (i.e., the distal magnet can be positioned with the North pole downward, with the proximal magnet positioned with the North pole upwards), with a reversed arrangement of the corresponding magnetic base elements 2240, such that strap lock 2210 will be attracted to and only align in one direction with the helmet base 2230, thereby allowing the strap lock to enter and lock in the base as previously described.

Figure 23A:
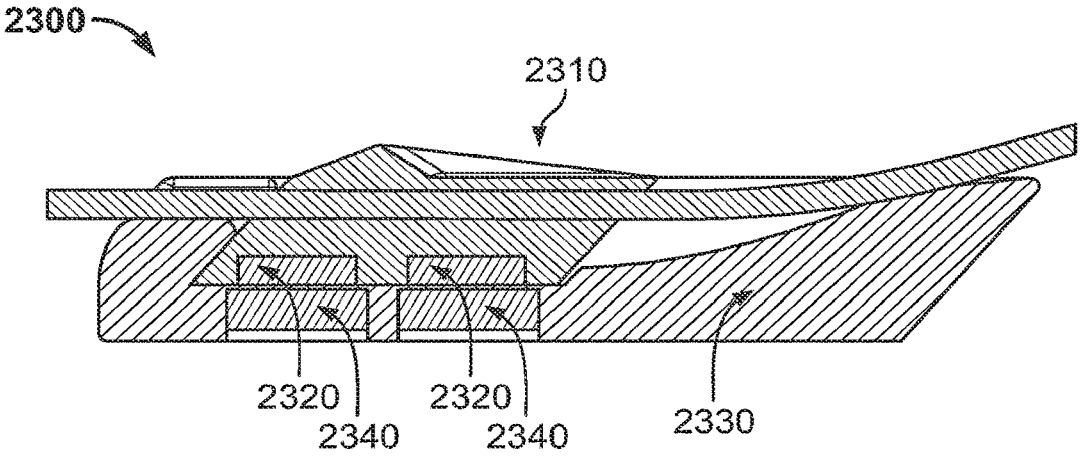
FIGS. 23A through 23C depict various views of another alternative embodiment of a chinstrap closure and adjustment mechanism.
Figure 23B:
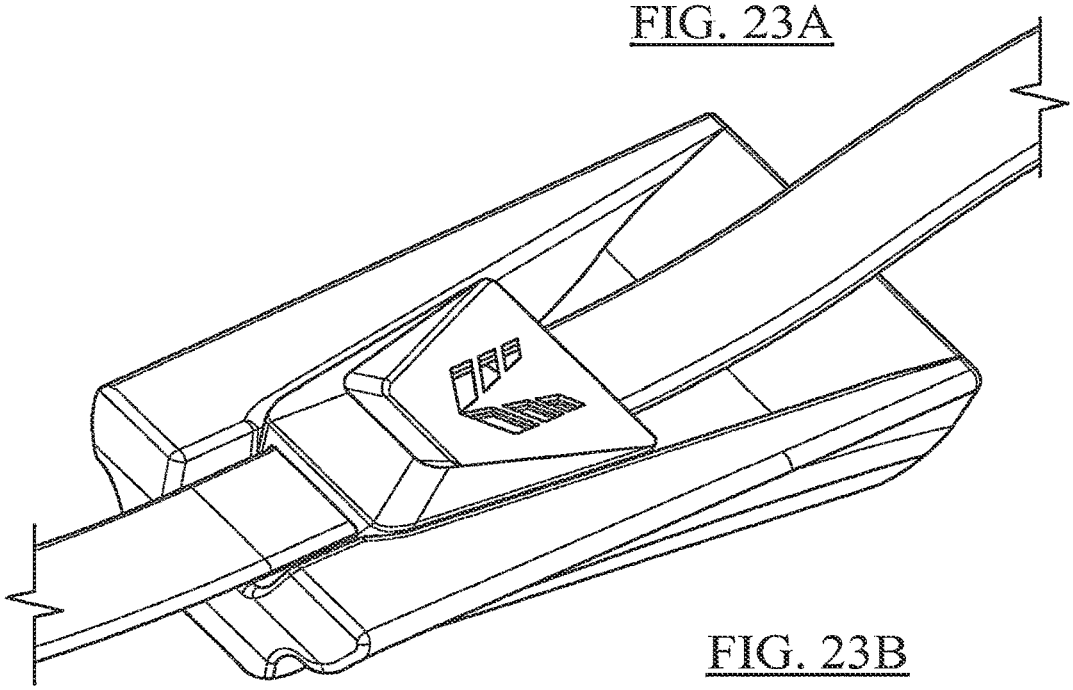
Figure 23C:
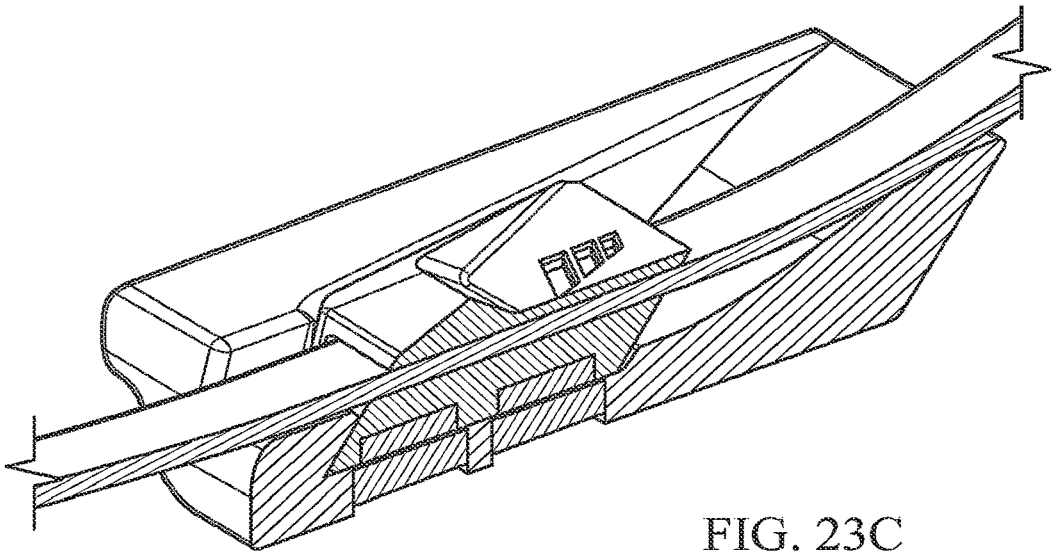

FIGS. 23A through 23C depict various views of another alternative embodiment of a chinstrap closure and adjustment mechanism 2300, which includes a wedge-shaped strap lock 2310 having a pair of magnetic elements 2320, and a helmet base 2330 having a wedge-shaped opening and a pair of magnetic base elements 2340. If desired, the magnetic elements 2320 can be arranged such that they are reversed in polarity (i.e., the distal magnet can be positioned with the North pole downward, with the proximal magnet positioned with the North pole upwards), with a reversed arrangement of the corresponding magnetic base elements 2340, such that strap lock 2310 will be attracted to and only align in one direction with the helmet base 2230, thereby allowing the strap lock to enter and lock in the base as previously described. In this embodiment, the various magnetic elements will desirably provide a sufficiently strong attraction force to retain the strap lock within the wedge-shaped opening of the helmet base 2330 without the requirement for a supplemental locking mechanism. Such attractive forces may be provided by a variety of magnets, including by rare-earth magnets such as Neodymium disc magnets (commercially available from Omega Magnets of Carpinteria, CA, USA) or similar magnets and/or magnet materials.

FIGS. 26A through 26F depict one exemplary embodiment of a supplemental impact protection element system 2600 which is shown affixed over an existing helmet outer layer, to desirably achieve a desired Player Specific and/or Position Specific (PS) helmet design. In this embodiment, the supplemental impact protection element system may be sized and/or configured to accommodate the outer layer of the CA helmet and can be positioned on top of the surface of the outer layer of the CA helmet. The at least one individual impact protection pads on each assembly may have a first surface and a second surface. The first surface may conform to the curvature of the helmet, with the first surface affixed to and/or through the helmet. The second surface may be affixed to a base membrane and/or the first surface. Furthermore, the supplemental impact protection element system may be additionally affixed by attaching to the existing front/back bumpers, face mask features, ventilation openings 2605 and/or using a screw, insert, grommet or other fixation device 2610 through any existing features on the CA helmet (or any modified features ion the helmet, which may include an opening or other feature created to accommodate the device). Conversely, some minor modifications may be necessary, and a secondary drilled hole or threaded-hole or adhesive may be added to ensure that the impact protection element(s) are fully secure.

The addition of the supplemental impact protection element system 2600 allows a new outer layer to be provided over the CA helmet, which could include a provision for uniformity of helmet design, color, surface texture, and/or application of graphics, text and/or logos. The supplemental impact protection element system 2600 may be manufactured from a variety of materials, including from a polymer similar to the outer layer helmet or different than that of the outer helmet layer. The supplemental impact protection element system may also have impact resistant coatings or layers to dissipate and/or decrease the magnitude of the impact force. The supplemental impact protection element system may be affixed to at least a portion of the at least one of the individual impact protection pads, if desired. The supplemental impact protection element system may be rigid, flexible or substantially rigid or flexible.

The supplemental impact protection element system 2600 may be broken down into various individual impact protective element assemblies and may be desirably positioned in a variety of positions and/or orientations to manufacture a PS helmet design. For example, a position-specific helmet for an individual player may comprise one or more supplemental impact protection elements helmet individual assemblies, which may include differently designed and/or placed systems for different layers and/or different player positions. The one or more supplemental impact protection element helmet individual assemblies may include at least one of a front impact protection assembly 2600, suitable to accommodate the frontal impacts experienced by most linemen (for example), and which may include non-flexible and/or flexible connections. The flexible connection may comprise a leather material, a 2 way-stretch fabric, a 4-way stretch fabric, and/or any elastic material. Similarly, the supplemental impact protection elements helmet individual assemblies may include at least one of a ridge impact protection assembly which may optionally include a variety of features, including a base membrane. Of course, the supplemental impact protection element system may comprise any combination(s) thereof.

For example, the one or more supplemental impact protection element individual assembly may comprise a frontal protection assembly 1100 as shown in FIGS. 26A through 26F. The frontal protection assembly may comprise a base membrane, one or more impact protection pads, and/or a bumper assembly. The one or more impact protection pads may comprise one or more impact mitigation structures. The one or more impact mitigation structures may comprise one or more of filaments, laterally supported filaments, auxetic structures, zig-zag structures, chevron structures, herringbone structures, and/or any combination thereof. The one or more impact protection pads may further comprise a first layer and a second layer. The first and/or second layer may comprise polycarbonate, a 2-way stretch fabric, a 4-way fabric, a foam layer, and/or any combination thereof.

In various embodiments, each of the supplemental impact protective elements within each assembly can include at least one or more individual impact protection pads and optionally at least one base membrane (not shown), with the at least one or more individual impact protection pads desirably optionally affixed to the base membrane (if present). Each of the at least one or more individual impact protection pads may be sized and configured to the helmet. Each of the at least one or more individual impact protection pads may be sized and configured differently than the proximate individual impact protection pads.

In various optional embodiments, each of the supplemental impact protective element assemblies may be linked by a flexible linkage to the helmet and/or other structures. The flexible linkage may be elastic to allow for size adjustments, and the flexible linkage may include through-holes to allow affixation to the helmet's existing features using attachment mechanisms known in the art.

Figure 26A:
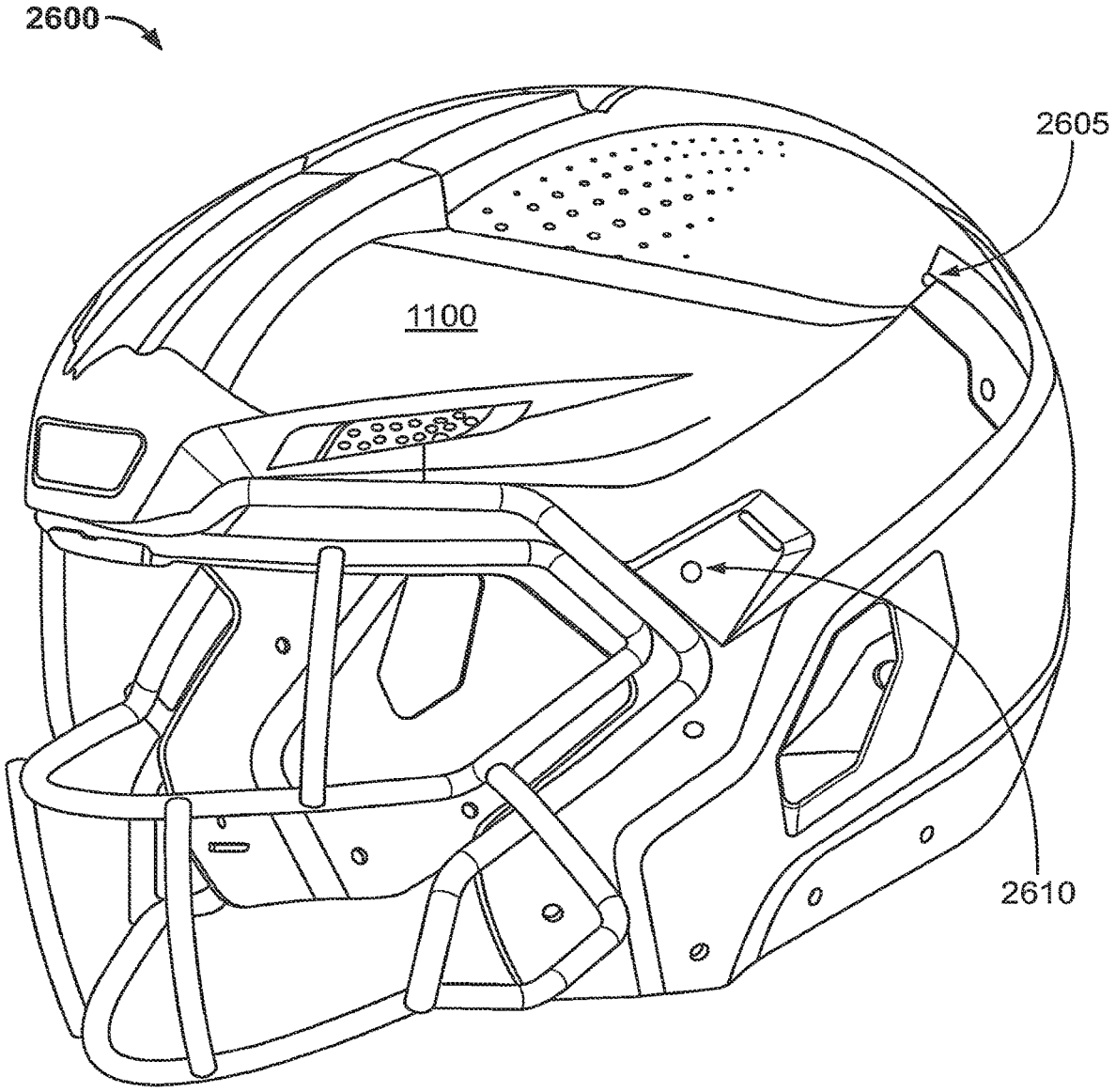
FIGS. 26A through 26F depict one exemplary embodiment of a supplemental impact protection element system affixed over an existing helmet outer layer.
Figure 26B:
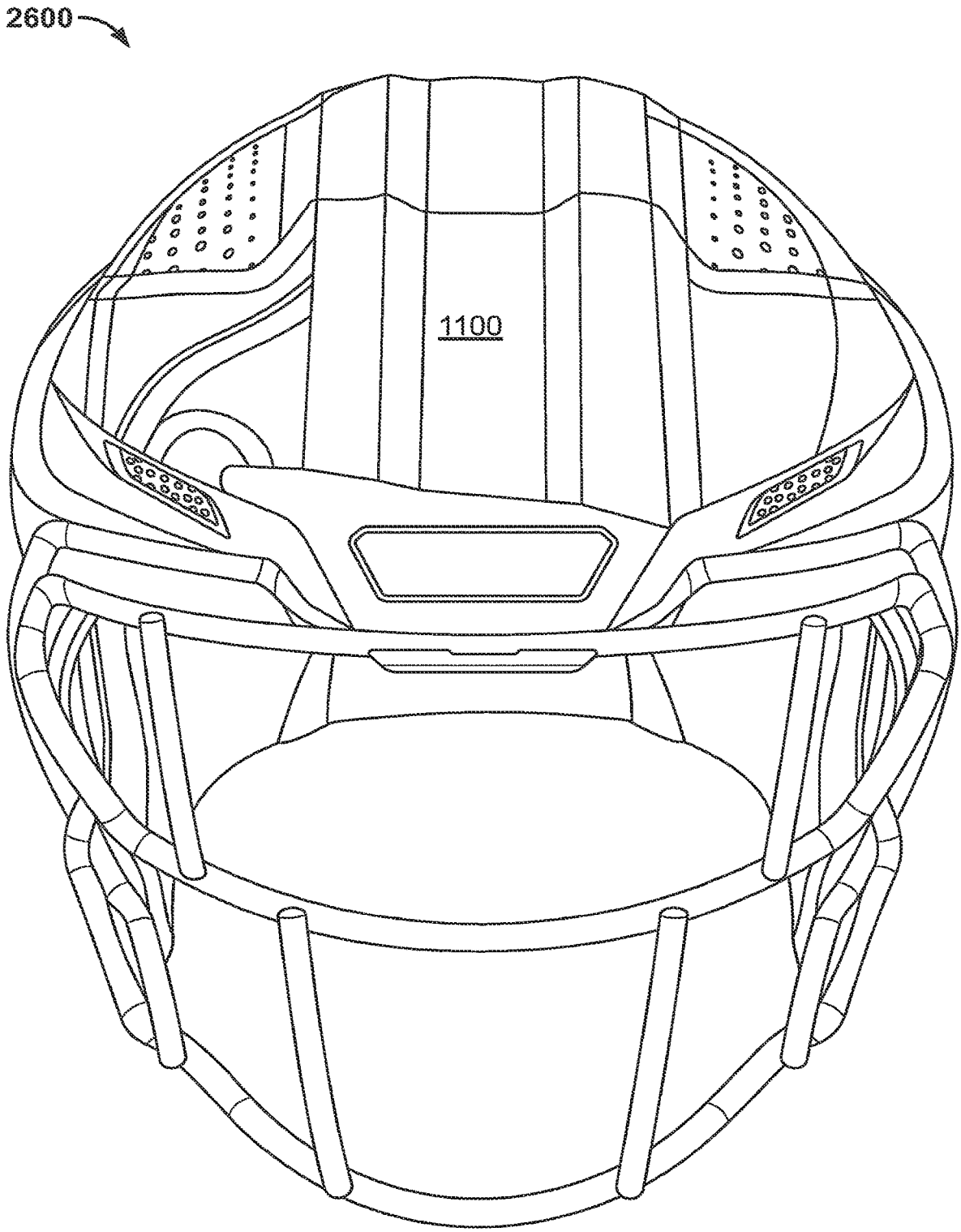
Figure 26C:
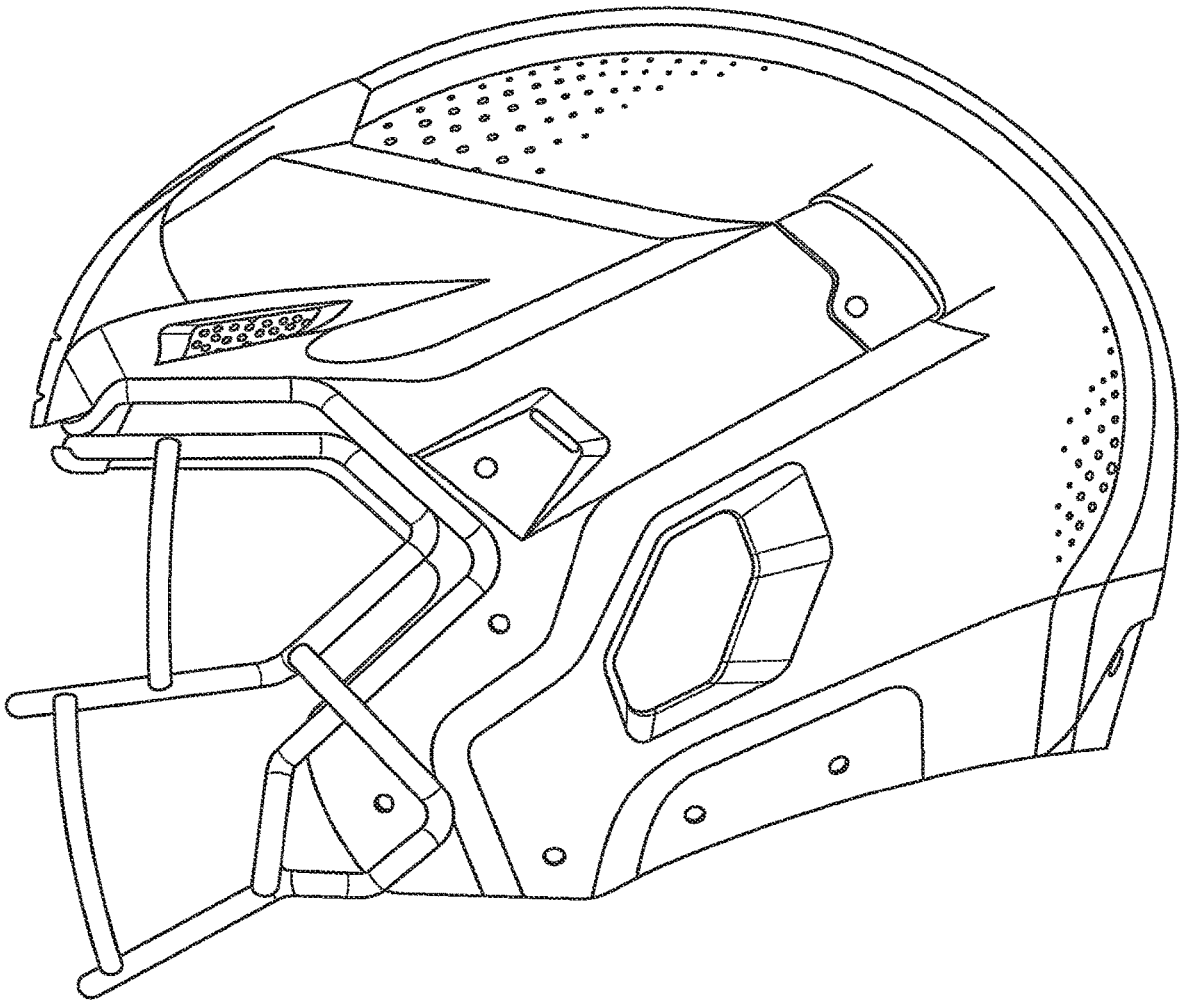
Figure 26D:
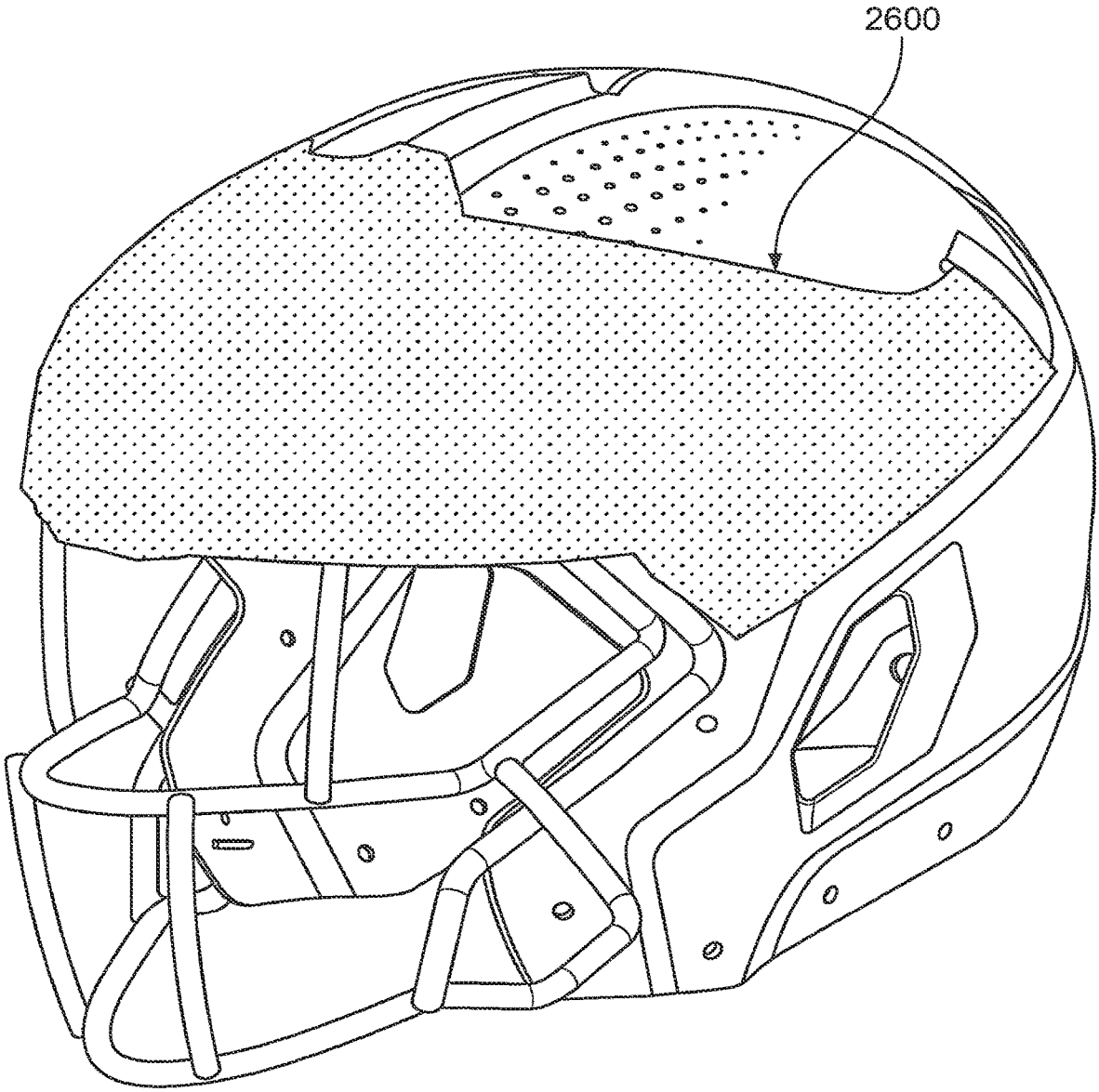
Figure 26E:
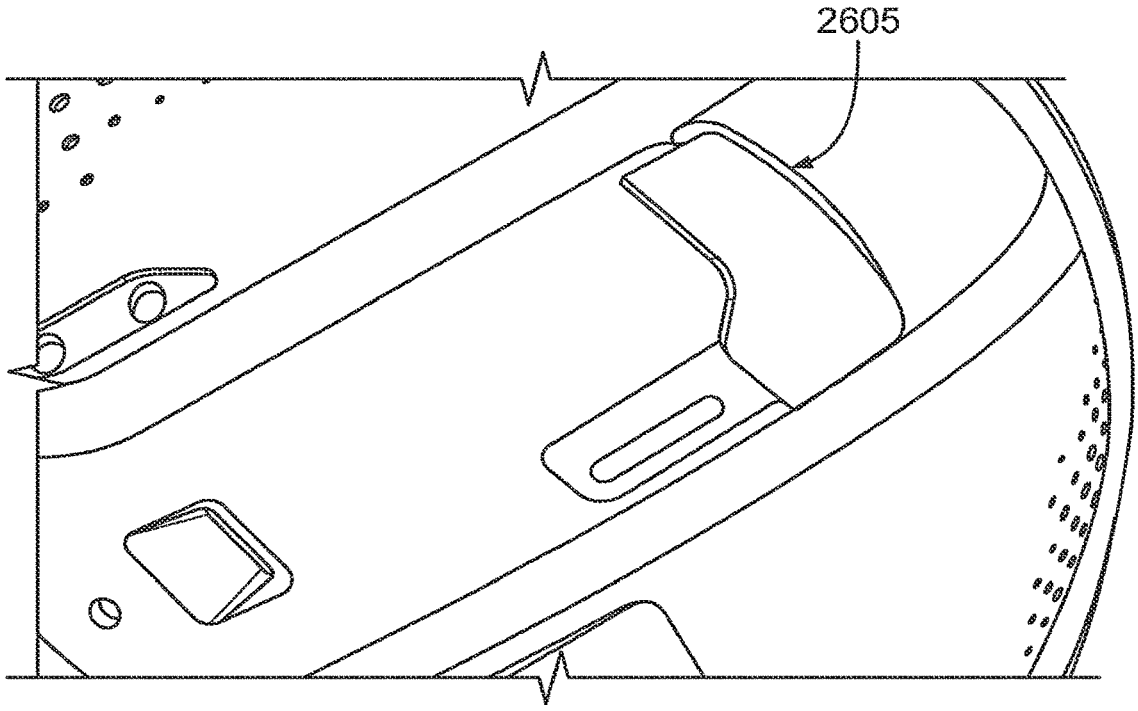
Figure 26F:
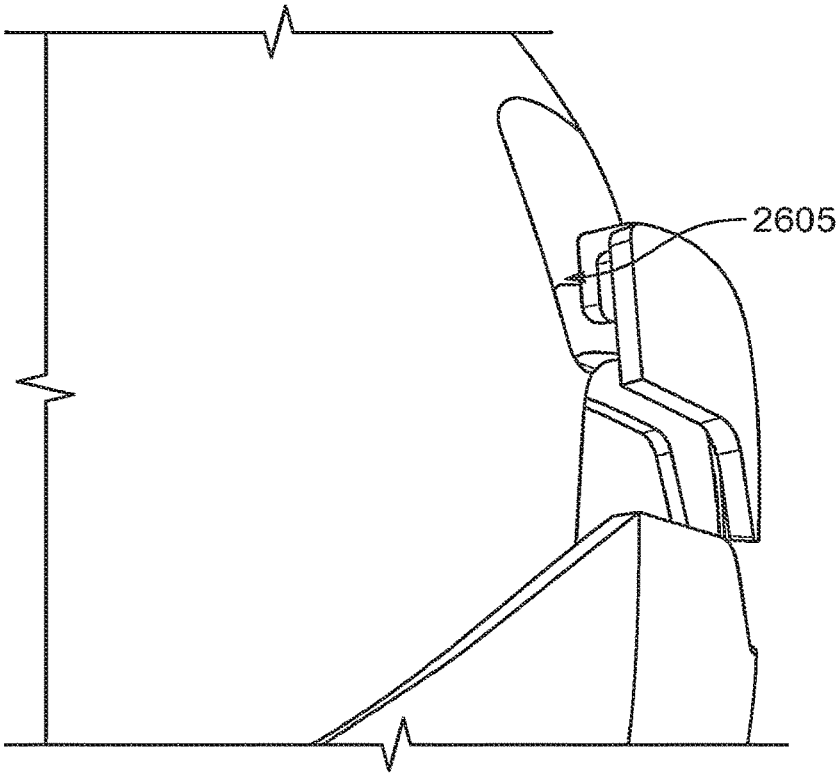
Figure 26G:
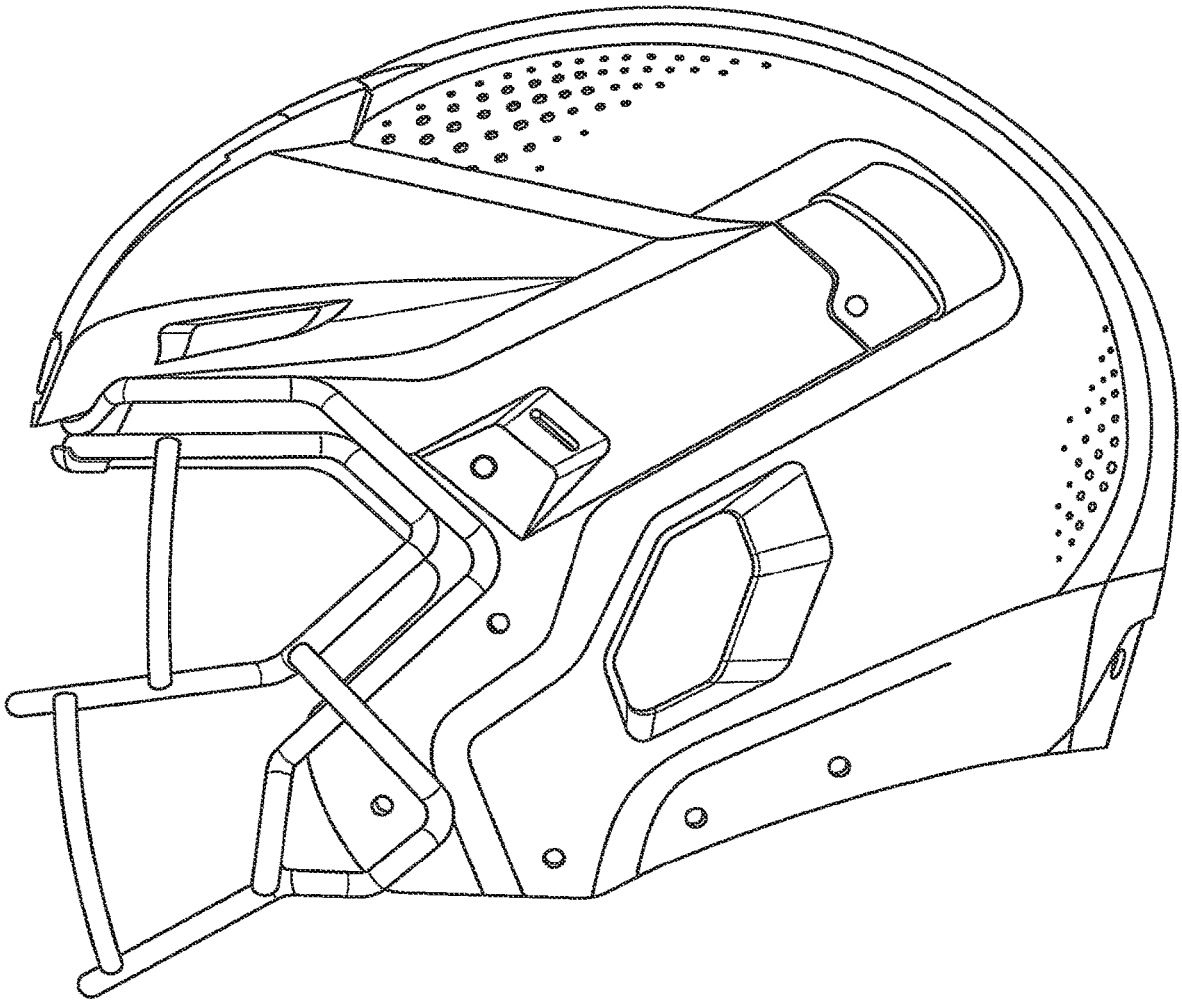
FIG. 26G depicts a side view of a helmet and a supplemental impact protection element system having a combined or overlapping logo.

As previously noted, the addition of a supplemental impact protective element assembly can desirably allow for a new outer layer over the helmet, providing uniformity of helmet design, color, surface texture, and/or application of graphics, text and/or logos (See FIG. 26G for a logo that partially covers the supplemental impact protective element assembly). The supplemental impact protective element assembly or portions thereof may be manufactured from a polymer similar to the outer layer helmet or different than that of the outer layer helmet. The supplemental impact protective element assembly may also have at least one impact resistant coating disposed on a surface or be coupled to at least one foam layer to dissipate and/or decrease the magnitude of the impact force. The supplemental impact protective element assembly may be affixed to at least a portion of the at least one of the individual impact protection pads, if desired. The supplemental impact protective element assembly may be rigid, flexible or substantially rigid or flexible. In addition, the supplemental impact protective element assembly may be "floating" (i.e., not affixed to the helmet) or may be further affixed to and/or through the helmet (as well as affixed to layer within the helmet).

If desired, a variety of supplemental impact protection element system components may be utilized, which desirably comprise impact mitigating structures. Each individual impact protection pad may be regionally placed on a helmet to create a desired PS helmet. The at least one individual impact protection pad(s) may be regionally placed in different locations. The different locations may comprise in at least one of the front and/or back, right and/or left, ridge, mid-back region, a parietal region (or midline), and a temporal region (right and/or left sides), the orbit region (not shown), the mandible (front, right and/or left side) region (not shown), the maxilla region (not shown), the nasal region (not shown), zygomatic region (not shown), the ethmoid region (not shown), the lacrimal region (not shown), the sphenoid region (not shown), and/or any combination thereof of the helmet. The at least one or more assemblies may be desirably positioned within a region. Each of the at least one or more individual impact protection pads may be sized and configured to one or more locations within and/or on the helmet. Each of the at least one or more individual impact protection pads may be sized and configured differently than the proximate individual impact protection pads. Optionally, each of the assemblies may be linked by a flexible linkage (not shown). The flexible linkage may be elastic to allow for size adjustments, and the flexible linkage may include through-holes to allow affixation to the commercially, available helmet existing features.

Although described throughout with respect to a helmet or similar item, the impact absorbing structures described herein may be applied with other garments such as padding, braces, and protectors for various joints and bones, as well as non-protective garment and non-garment applications.

While many of the embodiments are described herein as constructed of polymers or other plastic and/or elastic materials, it should be understood that any materials known in the art could be used for any of the devices, systems and/or methods described in the foregoing embodiments, for example including, but not limited to metal, metal alloys, combinations of metals, plastic, polyethylene, ceramics, cross-linked polyethylene's or polymers or plastics, and natural or man-made materials. In addition, the various materials disclosed herein could comprise composite materials, as well as coatings thereon.

Structural Modifications and Perforations

One significant advantage presented by some newer helmet designs is that structural rigidity and/or integrity of the outer shell component need not be critical to proper protection of the wearer. In many instances, the outer shell component can include significant regions of flexibility, ductility and/or malleability without significantly degrading the helmet's impact performance. This presents the potential for significant reductions in outer shell component thickness (if desired) and/or the potential for removal and/or piercing of various shell components without compromising user protection, greatly enhancing the design flexibility for the helmet.

For example, in some exemplary helmet designs, one or more openings in the outer helmet could be utilized for a variety of functions, including to create graphical or design elements on the helmet, to provide connection and/or anchoring points for helmet components and/or attachments, to reduce helmet weight and/or size, to provide ventilation for the helmet and/or wearer, to improve sound transmission, to provide access for wires, etc., to improve and/or increase the wearer's field of view, to expose internal components of the helmet to the external environment and/or stimuli (i.e., allow a camera or microphone located inside of the helmet to view/hear external environment and/or surroundings around the helmet, or to display internal helmet lights to external viewers), to provide external access to internal helmet components, and/or to improve and/or alter aerodynamics of the helmet. In various embodiments, various combinations of one or more these functions could be provided by three or more openings in the outer helmet shell.

In various embodiments, the protective helmet may comprise an outer shell. The outer shell having an outer surface and an inner surface. The protective helmet may further comprise an impact mitigation layer. The impact mitigation layer being disposed onto the inner surface of the outer shell. The impact mitigation layer comprises a plurality of impact mitigation structures. The protective helmet may further comprise an inner shell. The protective helmet may further comprise helmet accessories, including a comfort liner, a facemask, a chin strap, a visor and/or any combination thereof. The outer shell may comprise a rigid material, and/or a deformable, flexible material. The deformable, flexible material having a localized elastic deformation region in response to an incident force. The inner shell may comprise a relatively rigid and/or rigid material.

Where a new design helmet includes an outer surface of one or more colors and one or interior structures of differing colors, the removal of outer surface portions of the helmet in a deliberate fashion (and the resulting color contrast between the outer surface and the interior structures revealed through the opening) can be utilized in a variety of ways to create geometric and/or graphical designs, logos and/or other representations on the helmet. Moreover, the shape, size, arrangement and/or distribution of the openings could vary between openings on a single helmet, and in various embodiments these differences could be utilized to create shading, texturing and/or other features. In many instances, three or more openings in an outer helmet could be shaped, sized and/or arranged for stippling and/or creation of a pattern on the helmet simulating varying degrees of solidity or shading of graphics. If desired, indentations, depressions and/or protrusions on the outer surface could be similarly used to create graphical or design elements on the helmet. These graphical or design elements could be utilized for a variety of reasons, including functional helmet elements as well as identification of a player, position and/or team, as well as various marketing and/or sales reasons such as identifying a sponsor, selling a product or service, promoting a charity or social cause, etc. Moreover, this type of graphical or design element is much less likely to fade, degrade and/or smear than standard helmet graphics, in that the graphic or design elements can be created structurally in the helmet rather than by use of pigments on the helmet and/or on a polyurethane (or other material) wrap, which can be easily degraded and/or faded by sunlight.

In some exemplary embodiments, a protective helmet can includes an outer surface of one or more colors and one or interior structures of differing colors, where the removal of outer surface portions of the helmet in a deliberate fashion (and the resulting color contrast between the outer surface and the interior structures revealed through the opening) can be utilized in a variety of ways to create geometric and/or graphical designs, logos and/or other representations on the helmet. Moreover, the shape, size, arrangement and/or distribution of the openings could vary between openings on a single helmet, and in various embodiments these differences could be utilized to create shading, texturing and/or other features. In many instances, three or more openings in an outer helmet could be shaped, sized and/or arranged for stippling and/or creation of a pattern on the helmet simulating varying degrees of solidity or shading of graphics. If desired, indentations, depressions and/or protrusions on the outer surface could be similarly used to create graphical or design elements on the helmet. These graphical or design elements could be utilized for a variety of reasons, including functional helmet elements as well as identification of a player, position and/or team, as well as various marketing and/or sales reasons such as identifying a sponsor, selling a product or service, promoting a charity or social cause, etc. Moreover, this type of graphical or design element is much less likely to fade, degrade and/or smear than standard helmet graphics, in that the graphic or design elements can be created structurally in the helmet rather than by use of pigments on the helmet and/or on a polyurethane (or other material) wrap, which can be easily degraded and/or faded by sunlight.

Figure 27A:
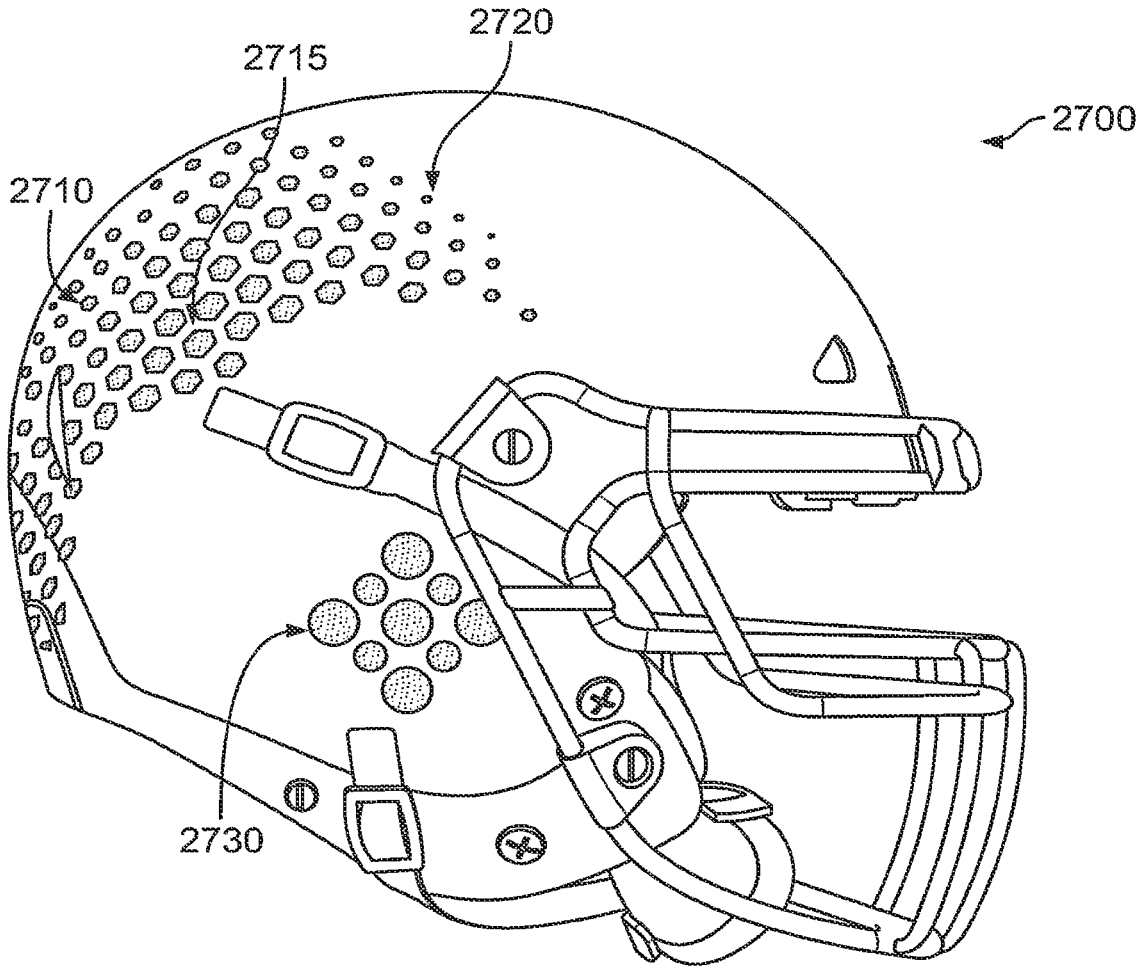
FIG. 27A depicts a side view of one exemplary embodiment of a helmet outer shell incorporating a series of physical openings and/or perforations extending through an outer surface of the helmet.

FIG. 27A depicts a side view of one exemplary embodiment of a helmet outer shell 2700 incorporating a series of physical openings and/or perforations 2710 extending through an outer surface of the helmet, exposing various internal helmet structures and/or shadowed regions. In this embodiment, the internal structures/shadow regions are generally darker than the white outer shell, and this presents readily viewable graphic or design elements, which include a more densely packed (i.e., darker) central region 2715 and more widely spaced region 2720 (with smaller openings) towards the middle of the helmet, which creates a visual impression that the openings are "fading away" or disappearing towards the front of the helmet. In addition, the openings 2730 on the side of the helmet, near to the wearer's ear, can present a graphical pattern as well as provide sound transmission for the wearer. In various embodiments, the size and/or shape of the ear openings may be selected to reduce transmission of various sound wavelengths and/or promote transmission of other sound wavelengths, such as to minimize the passage of crowd noise to the player's ear but allow and/or facilitate transmission of play calls and/or audible signals from other teammates.

Figure 27B:
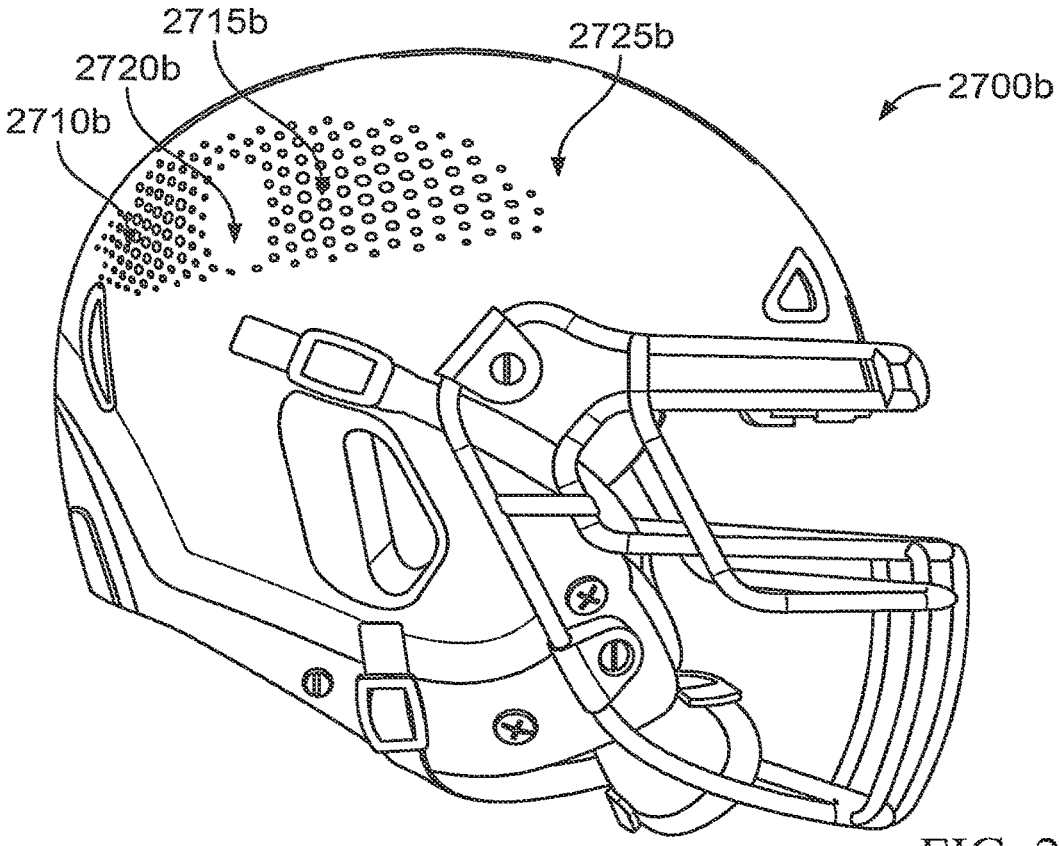
FIG. 27B depicts a side view of an alternative exemplary embodiment of a helmet outer shell incorporating a series of physical openings and/or perforations extending through an outer surface of the helmet.

FIG. 27B depicts one alternative embodiment of an outer helmet shell 2700*b* incorporating a series of physical openings and/or perforations 2710*b* through the outer surface of the helmet, exposing various internal helmet structures. In this embodiment, the internal structures are generally darker than the white outer shell, and this presents readily viewable graphic or design elements, which include a more densely packed (i.e., darker) region 2715*b* adjacent to the center region, with an unperforated center section 2720*b* that appears to form a white oval shape. This arrangement also includes more widely spaced (and smaller) regions 2725*b* near the central oval and near the periphery of the graphic, which makes the graphic appear to "fade away" at the edges of the pattern.

Figure 27C:
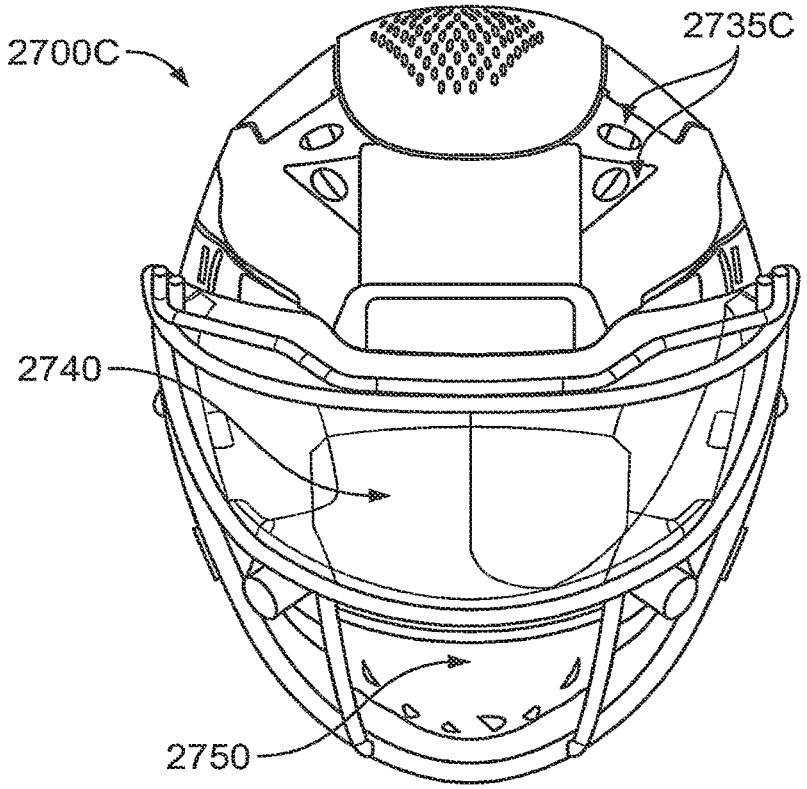
FIG. 27C depicts a side view of another alternative exemplary embodiment of a helmet outer shell incorporating a series of physical openings and/or perforations extending through an outer surface of the helmet.
Figure 28A:
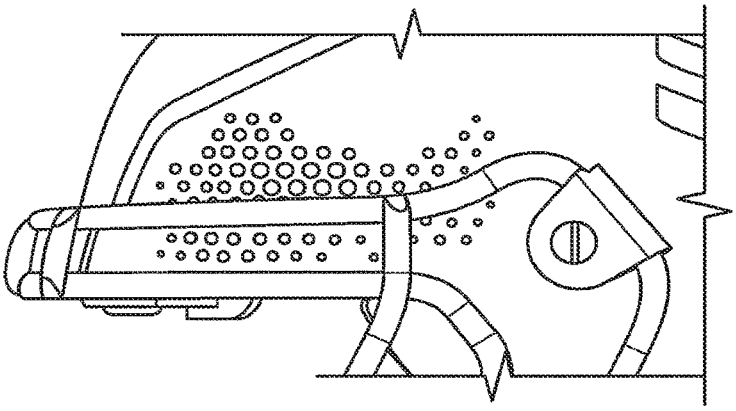
FIGS. 28A through 28L and 29A through 29J illustrate various exemplary embodiments of different decorative patterns that may be disposed onto the outer shell, with the decorative pattern optionally include functional openings in the helmet such as vent holes, mounting locations and sound transmission openings.
Figure 28B:
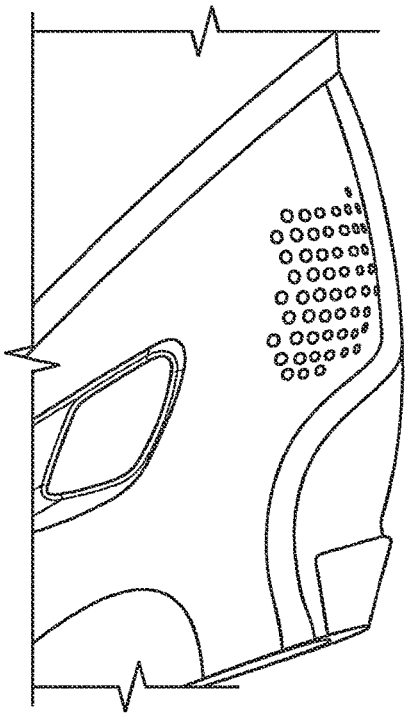
Figure 28C:
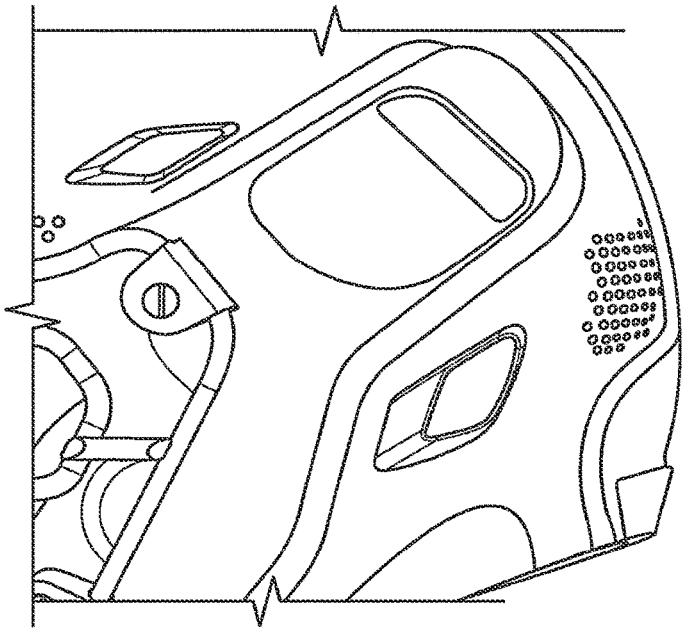
Figure 28D:
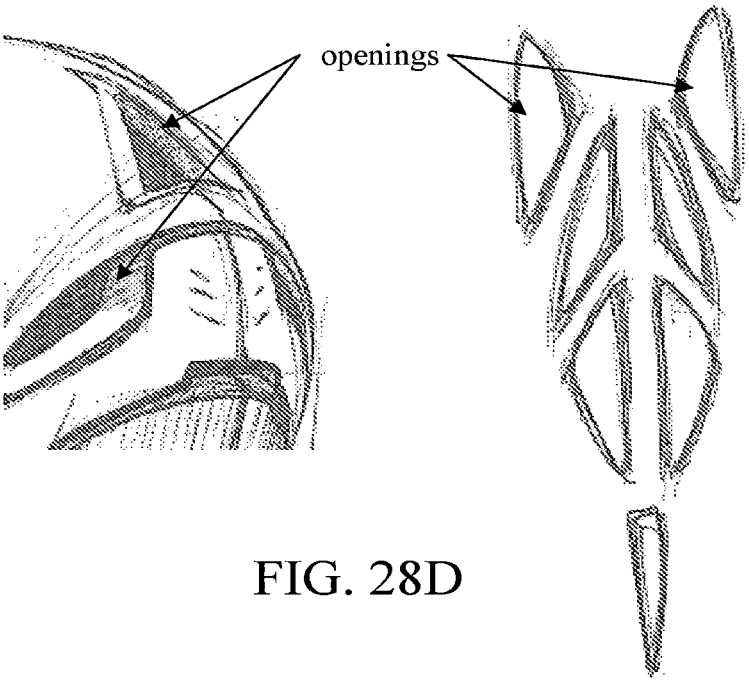
Figure 28E:
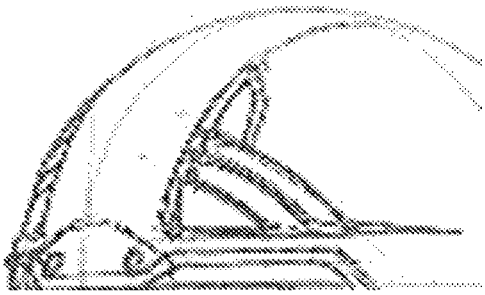
Figure 28F:
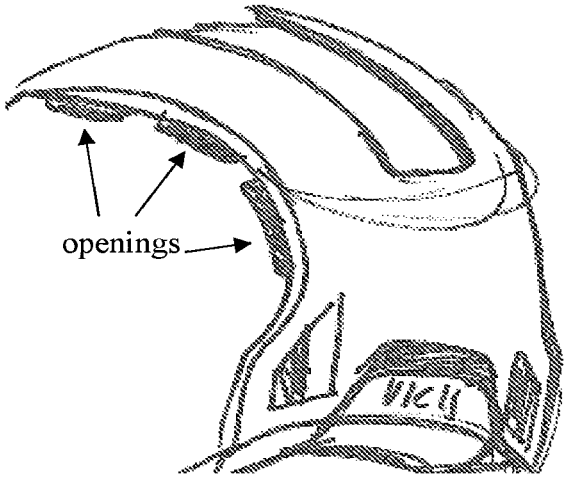
Figure 28G:
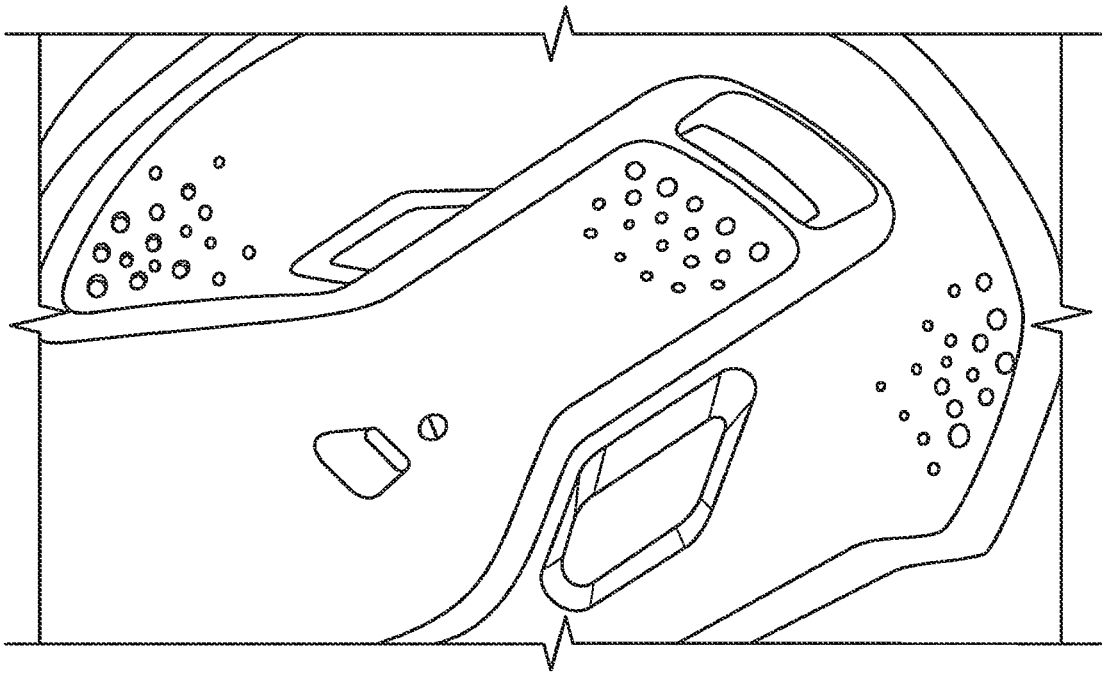
Figure 28H:
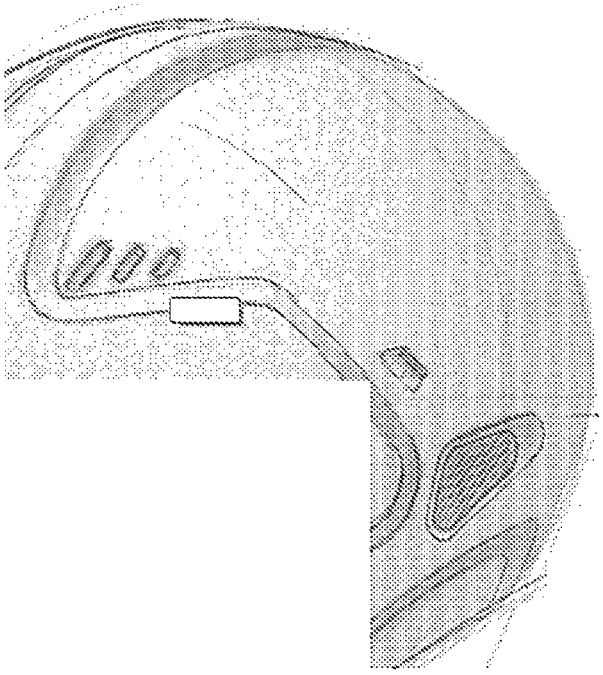
Figure 28I:
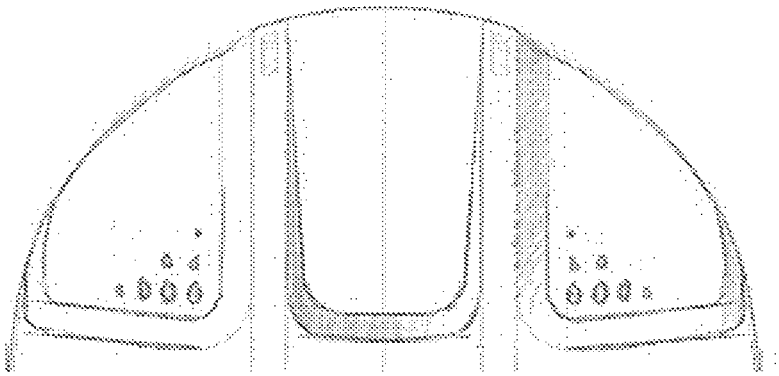
Figure 28J:
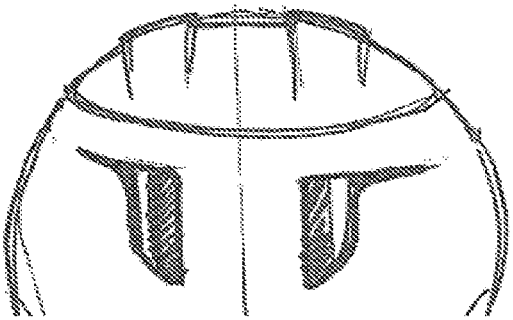
Figure 28K:
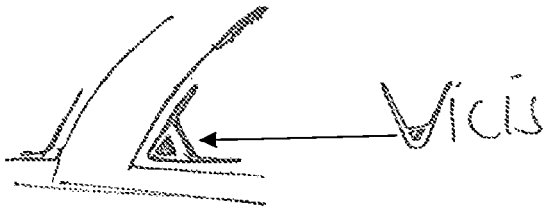
Figure 28L:
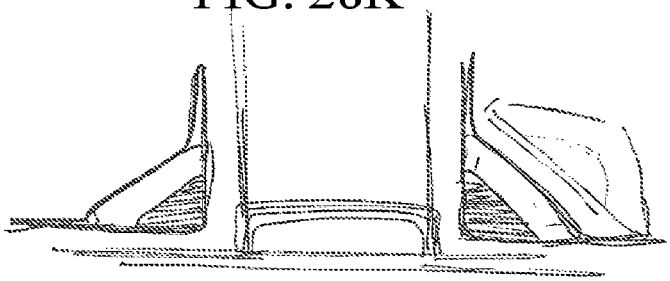
Figure 29A:
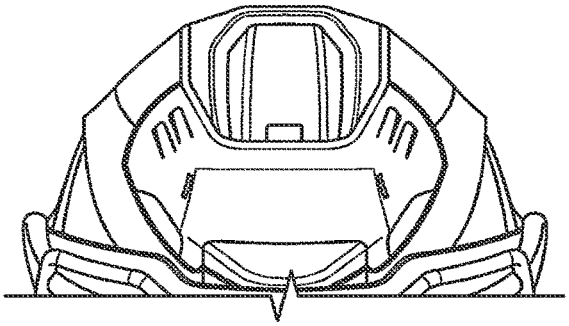
Figure 29B:
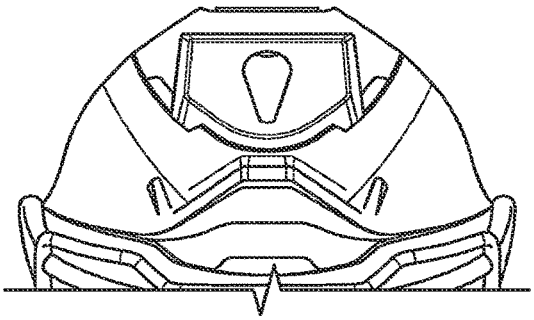
Figure 29C:
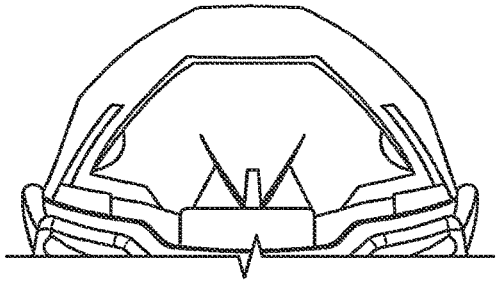
Figure 29D:
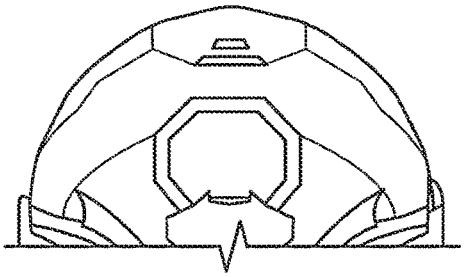
Figure 29E:
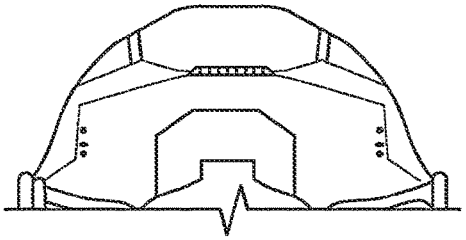
Figure 29F:
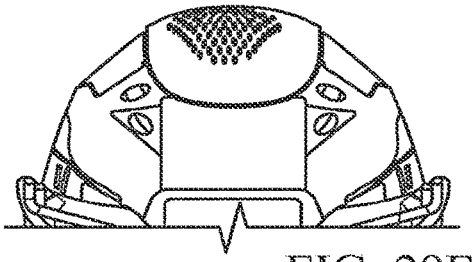
Figure 29G:
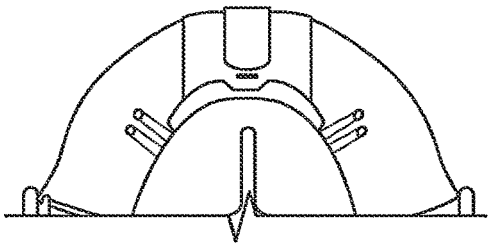
Figure 29H:
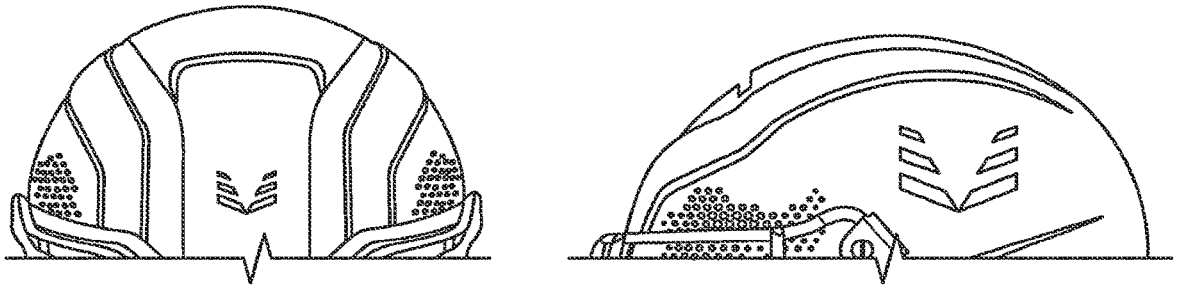
Figure 29I:
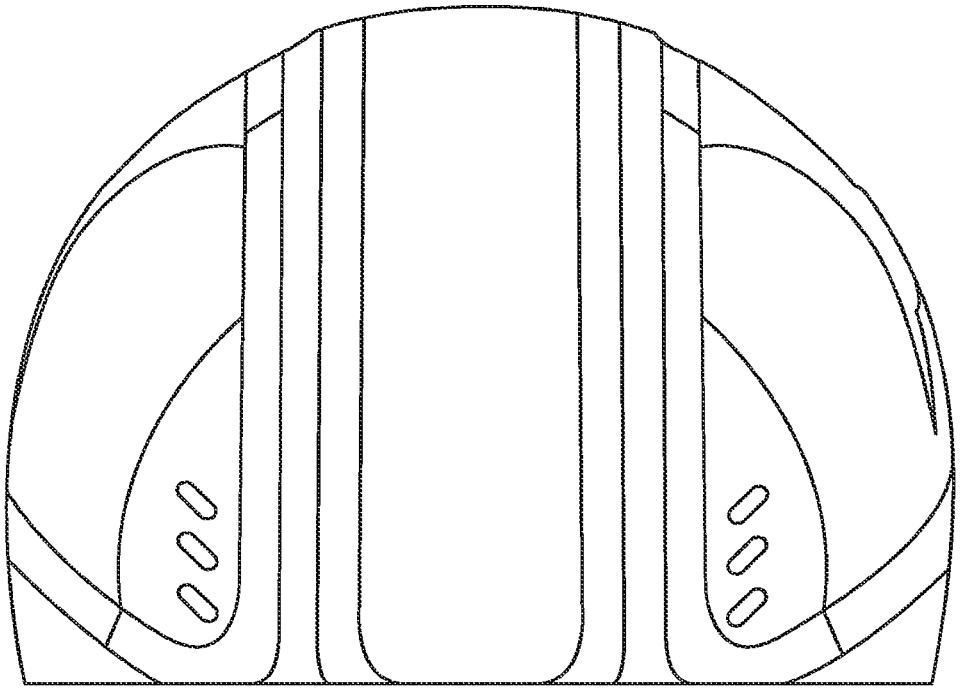
Figure 29J:
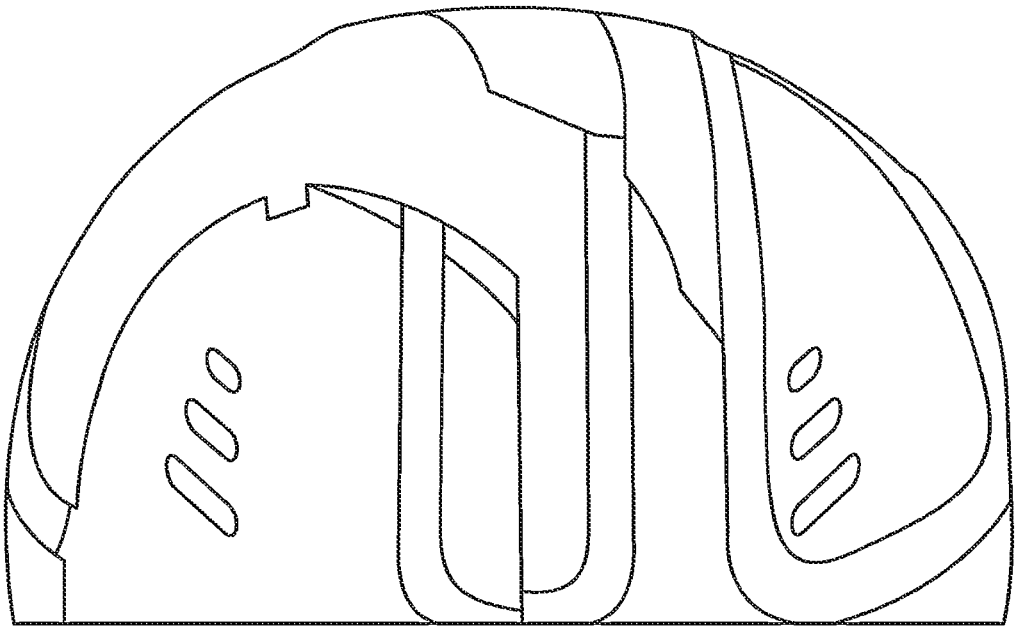

FIG. 27C depicts another alternative embodiment of an outer helmet shell 2700*c* incorporating a series of physical openings and/or perforations 2710*c* through the outer surface of the helmet, exposing various internal helmet structures. In this embodiment, the internal structures are generally darker than the white outer shell, and this presents readily viewable graphic or design elements, which include a more densely packed (i.e., darker) region over the central region of the helmet forming a "mohawk" shape 2730*c*. In addition to its aesthetic features, this arrangement and positioning of perforations can also have particular utility for ventilation of the helmet internals. In addition, a plurality of oval openings 2735*c* are positioned along the frontal lobes of the helmet, with lighter gray structures viewable therein. Of course, any of the disclosed helmet designs can include a visor 2740 and chin protector 2750, as known in the art, if desired.

As best seen in FIGS. 1B through 1H, a preferred embodiment of a helmet outer shell can incorporate a series of physical openings and/or perforations through the outer surface of the helmet, which is various embodiments will exposing various internal helmet structures and/or shadowed regions. In this embodiment, the plurality of openings or perforations may represent a random pattern, and/or a viewable graphic or design element, which include a more densely packed (i.e., darker) central region and a more widely spaced region (with smaller openings) originating from the frontal portion towards the back. The plurality of openings may appear to "fade away" towards the front of the helmet. In addition, the openings on the side of the helmet, near to the wearer's ear, can present a graphical pattern as well as provide sound transmission for the wearer.

As previously noted, the outer shell 20 may comprise a front or frontal region, a central region, a side region (right and left sides) and a back region. The outer shell 20 may further comprise an external surface and an internal surface. The outer shell may further comprise a plurality of perforations 201. The frontal region describes the forehead region of the helmet. In this frontal region, the edge or perimeter of the helmet is proximate to the brow region of the wearer or disposed within the brow region of the wearer. Furthermore, the frontal region typically comprises one or more holes 21 and a front bumper (not shown). The front bumper may comprise one or more posts, the one or more posts desirably being sized and configured to fit within the one or more holes 21, with the front bumper having a front surface and a back surface. The bumper posts will typically be inserted through the one or more holes until the back surface of the front bumper mates with the exterior surface of the helmet. The front bumper front surface may further comprise a nameplate or logo. In various embodiments the frontal region may also include portions of the central region.

Figure 1B:
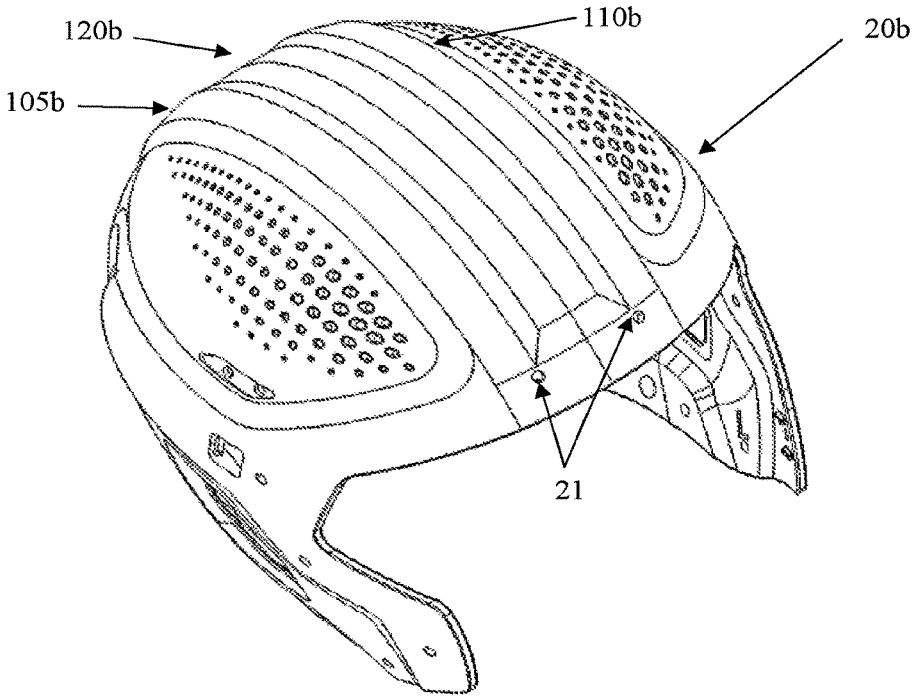
FIGS. 1B through 1H depict various views of another exemplary embodiment of a helmet shell of a modular protective helmet assembly.
Figure 1C:
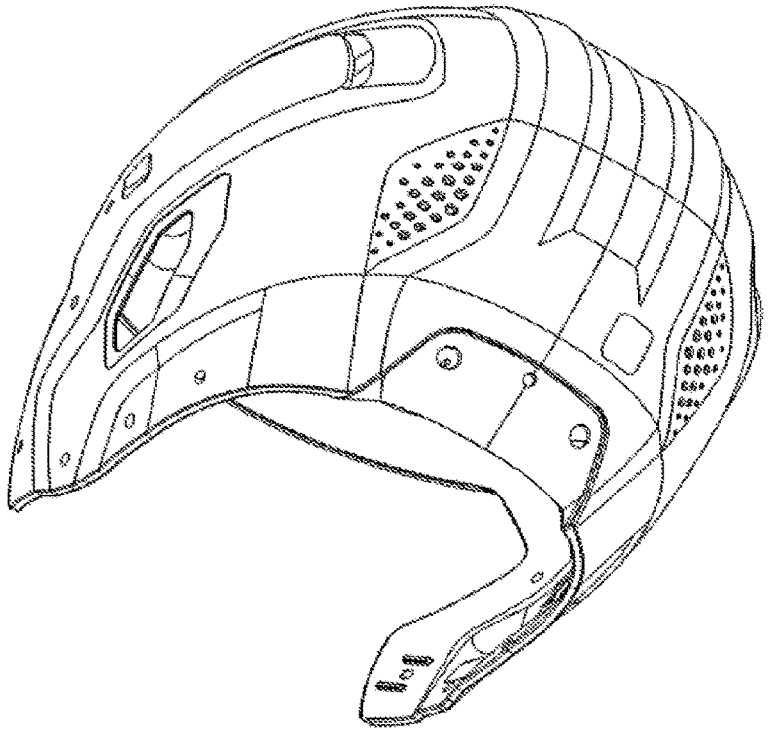
Figure 1D:
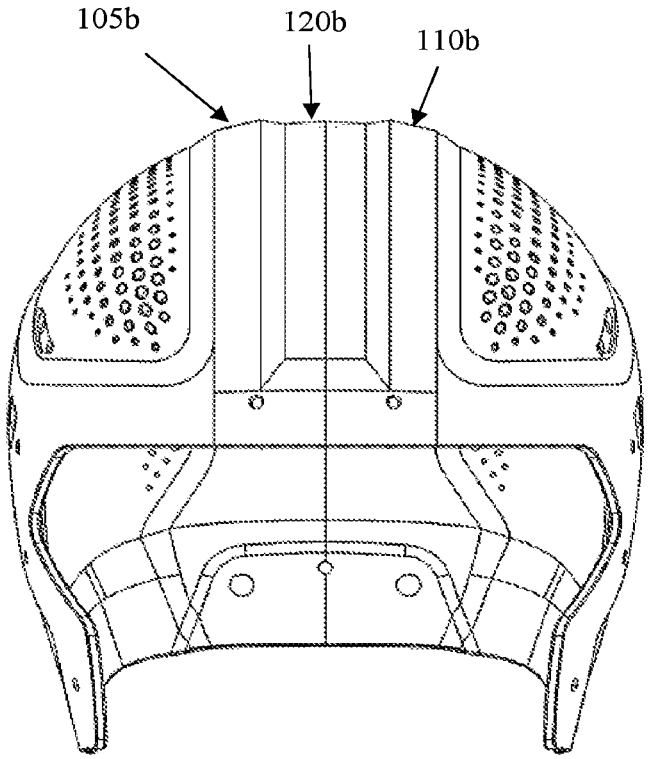
Figure 2A:
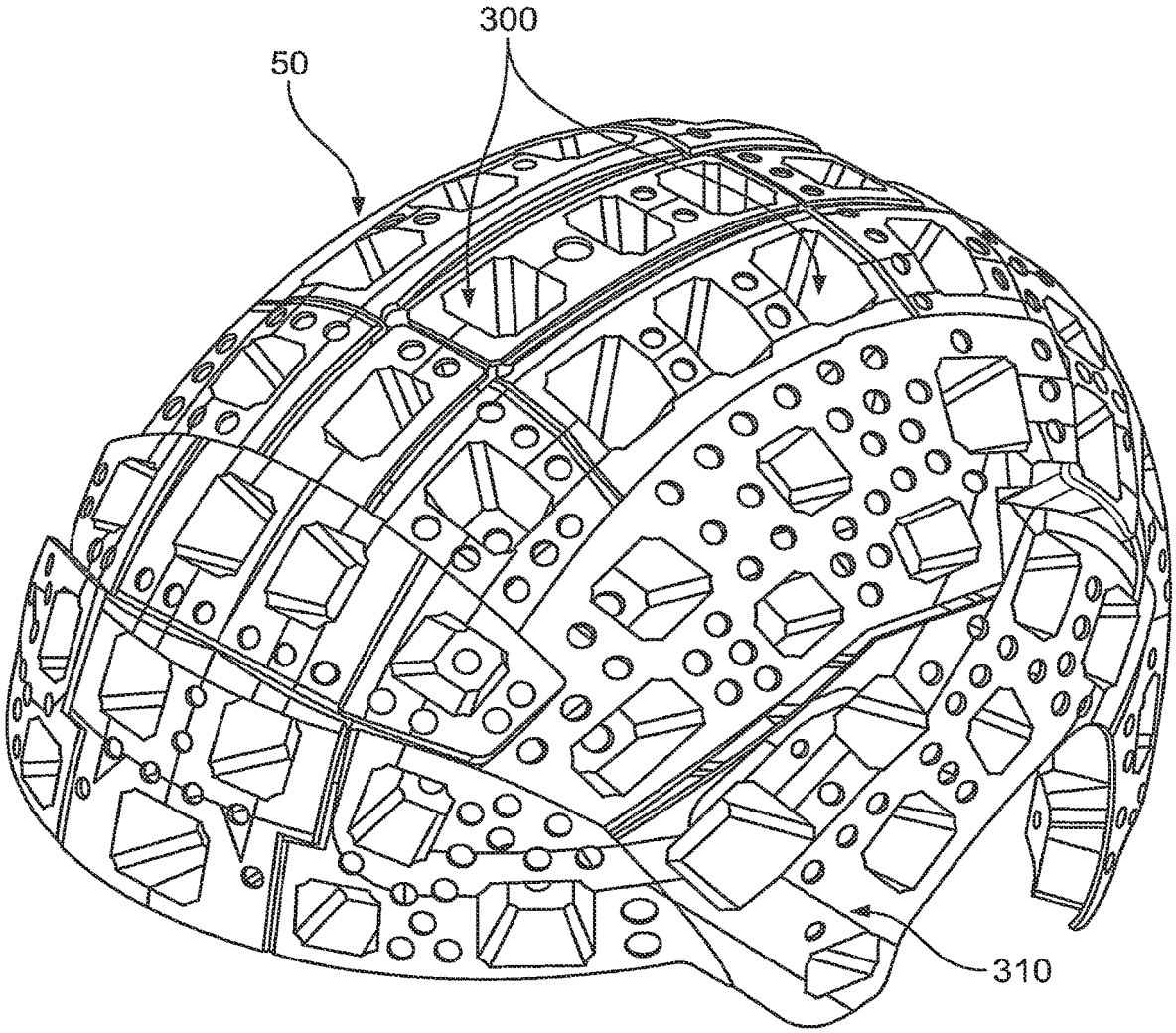
FIGS. 2A through 2I depict various views of an energy absorbing impact layer include a plurality of impact absorbing elements.
Figure 2B:
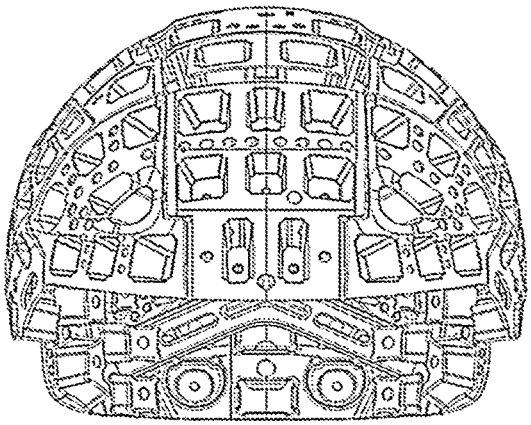
Figure 2C:
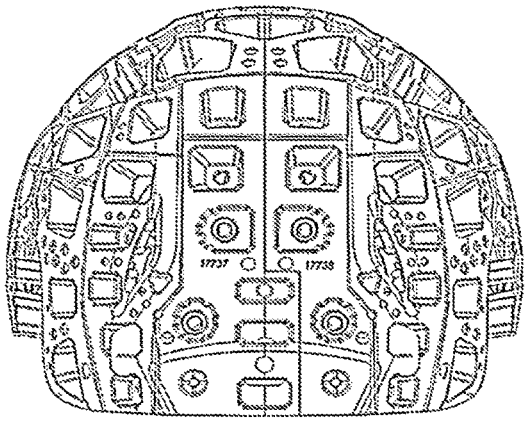
Figure 2D:
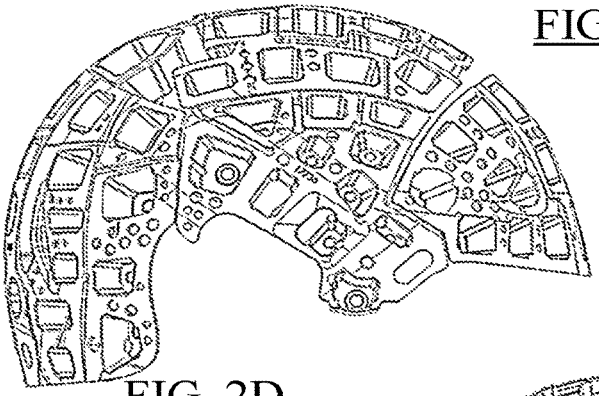
Figure 2E:
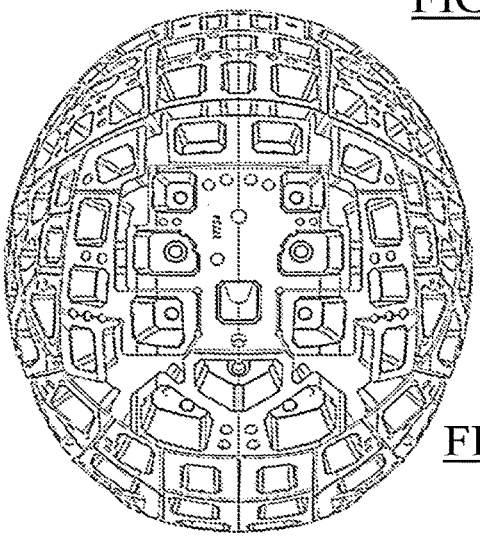
Figure 2F:
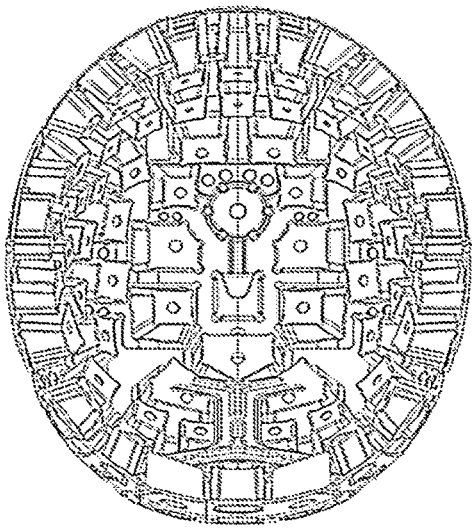
Figure 2G:
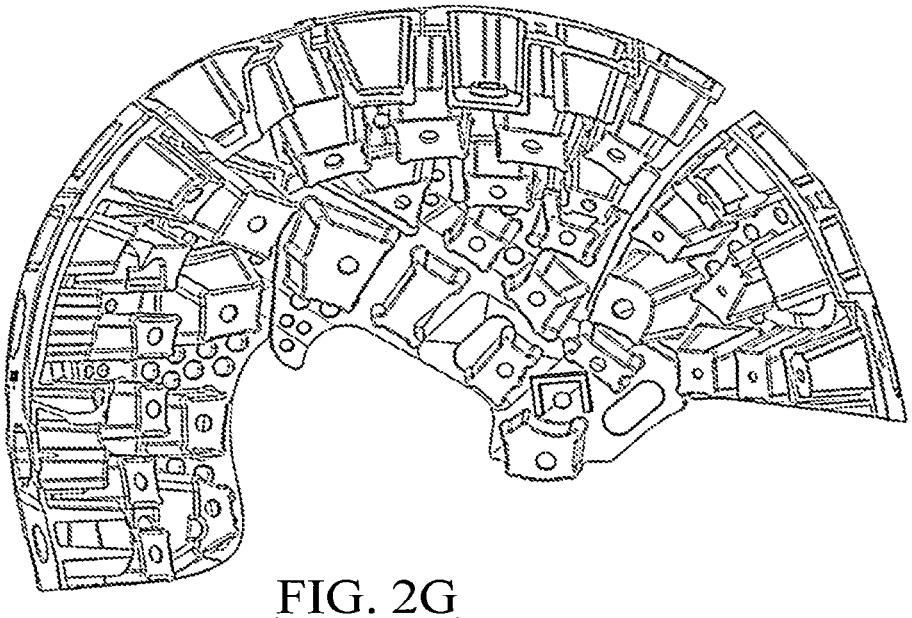
Figure 2H:
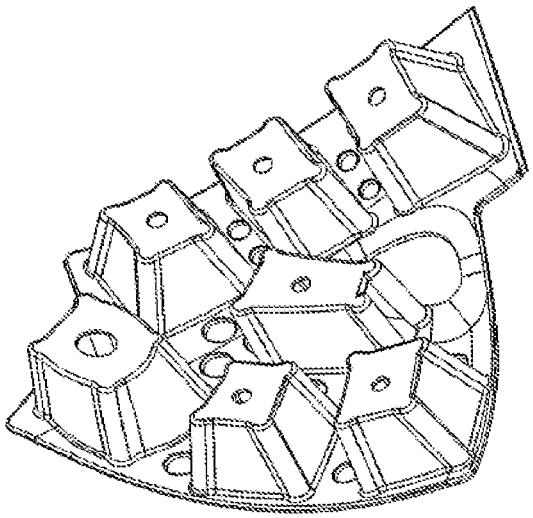
Figure 2I:
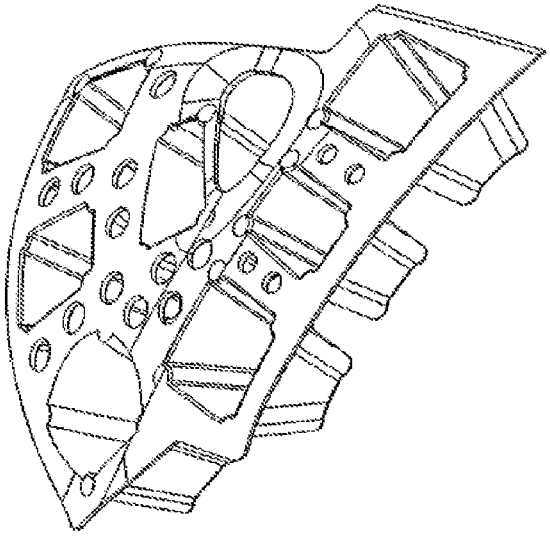
Figure 3A:
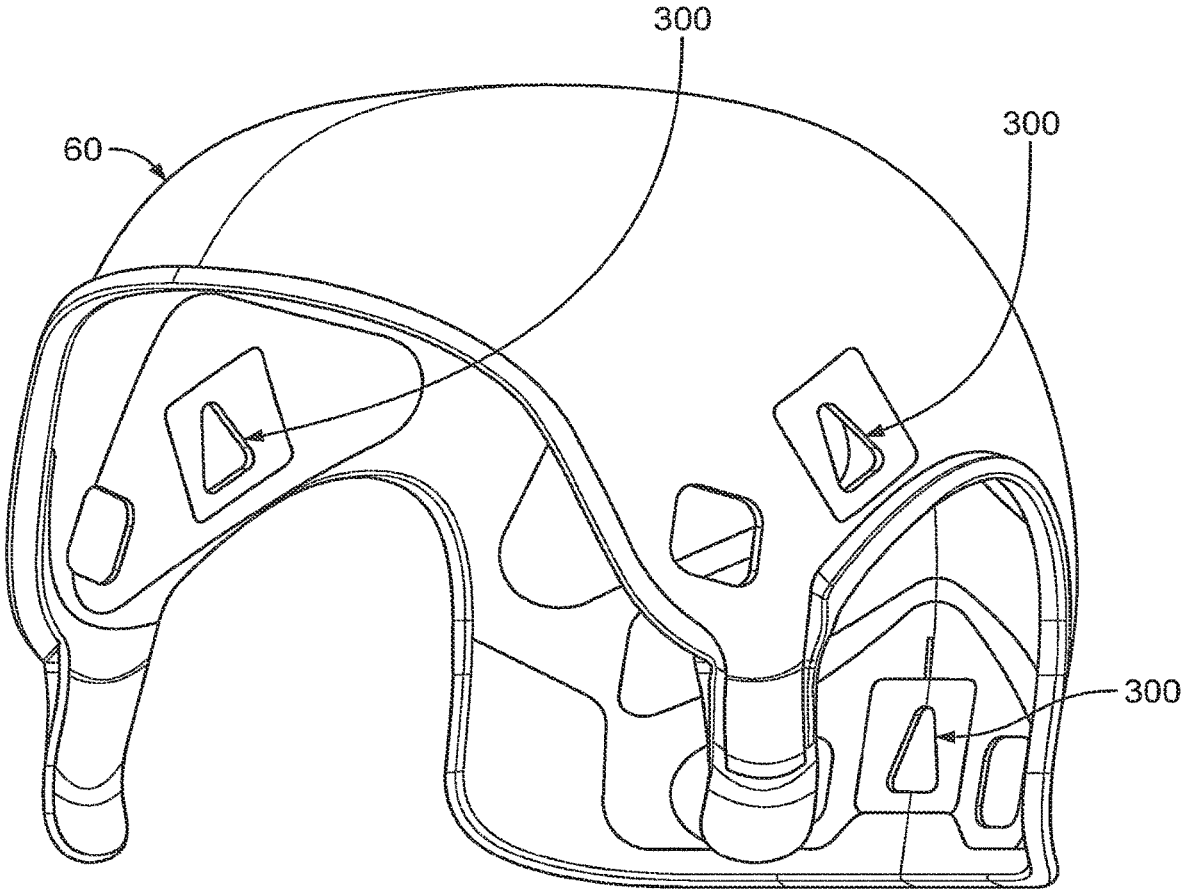
FIGS. 3A through 3F depict various views of one exemplary embodiment of an inner shell or cap.
Figure 3B:
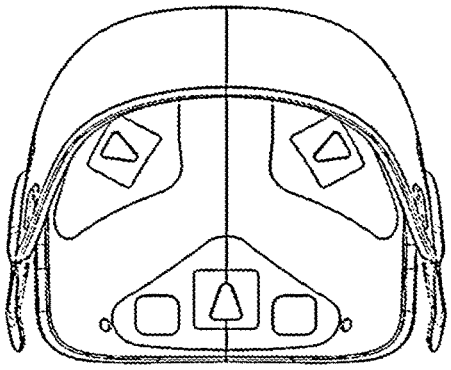
Figure 3C:
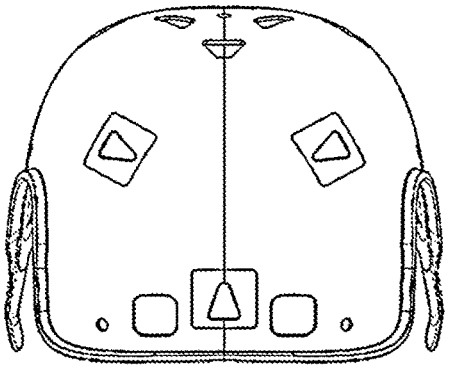
Figure 3D:
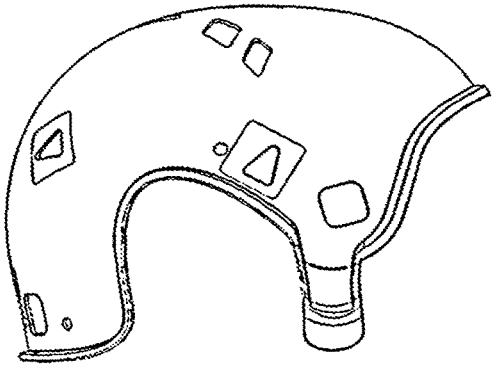
Figure 3E:
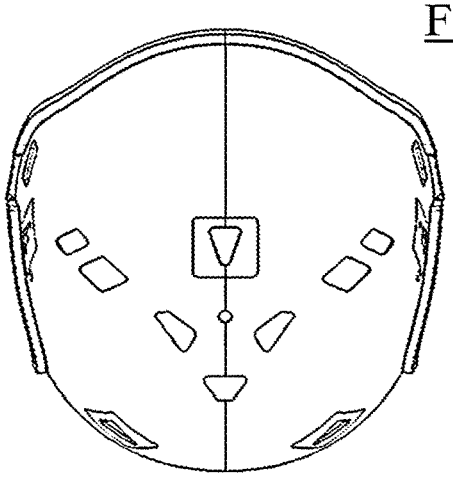
Figure 3F:
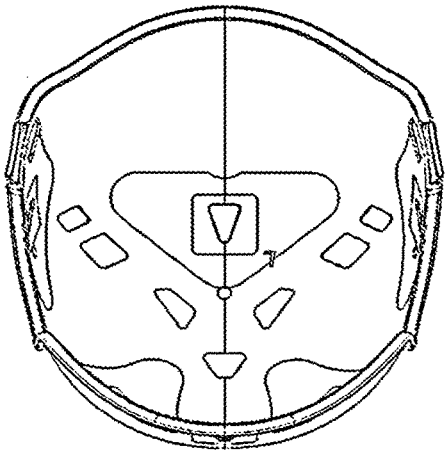

The central region of the helmet can include one or more surface features, including raised and/or lowered portions relative to the hemispherical or generally rounded shape of the helmet. As shown in FIG. 1B, the helmet 20*b* includes a central hemispherical section 120*b* (i.e., a non-raised central strip), with a pair of lateral strips 105*b* and 110*b* positioned on either side of the central section 120*b*. In various alternative embodiment, a central strip may be raised and/or lowered from the external surface of the outer shell, while in the disclosed embodiment the central strip can be formed coincident with the external curvature of the outer shell 20. In some additional embodiments, the central section may include one or more portions where some or all of the portion is raised and/or lowered (not shown) from the external surface of the outer shell. FIG. 2B depicts the central section 120*b* extending forward into the frontal region. The central section may originate anywhere from the edge or perimeter of the helmet within the frontal region and/or proximate or adjacent to the edge or perimeter of the helmet within the frontal region over the crown region and/or towards the back region. More specifically, the central section may extend anywhere from 1 to 7 inches from an edge or perimeter of the helmet within the frontal region. The central section may terminate within the back region of the helmet. Alternatively, the central section may terminate at an edge or perimeter of the helmet within the back region. The central section and/or raised/lowered sections may have uniform widths and/or non-uniform widths, or any combinations thereof. In one embodiment, a non-uniform width may comprise a tapered width, with the taper beginning in a frontal region and/or back region. In one embodiment, the central section may comprise a first width and a second width, with the second width being greater or smaller than the first width. At least a portion of the second width may be disposed within the back region and/or the front region of the helmet. The uniform width of the entire central section may be approximately from 2.5 inches to 5 inches wide. The first width may be 2.5 inches to 5 inches wide, and the second width may be 2.5 inches to 8 inches wide. The central section and/or any raised/lower regions may further comprise one or more beveled edges on one or more side regions—i.e., the right and left sides of the portion and/or the front and/or back sides, with beveled edges having a width. The beveled edge width may comprise 0.25 inches to 1 inch. In some embodiments, a central section may comprise at least one raised band, while in other embodiments it may comprise two or three or more bands and/or the central section comprises a first portion and a second portion, the first portion having a constant or uniform shape or width, the second portion having a different shape or different width than the first portion. The second portion width may be greater than the first portion width.

In another exemplary embodiment, a crown region of the helmet may include a plurality of raised portions, such as at least two raised medial/lateral belts. The at least two raised belts may be raised from the external surface of the outer shell. At least a portion of the at least two raised belts may originate within the frontal region, extend over the crown region, and extend towards back region. At least a portion of the at least two raised belts may terminate within the back region. Alternatively, the at least two raised strips may terminate at the edge or periphery of the helmet within the back region and/or proximate or adjacent to the edge or periphery of the helmet within the back region. More specifically, proximate or adjacent to comprise 1 to 7 inches from the edge or perimeter of the helmet within the frontal region. The at least two raised belts may further comprise at least two beveled edges, the at least two beveled edges may be positioned on opposing sides of the at least two raised belts. Alternatively, each of the at least two raised strips may further comprise a first beveled edge and a second beveled edge. The first beveled edge and the second beveled edge are positioned on opposing sides of each of the at least two raised strips—e.g., on the right and left sides of each of the at least two raised belts. At least a portion of the first beveled edge can originate in the fontal region of helmet, the first beveled edge may be adjacent to an edge or perimeter within the frontal region. Furthermore, the first beveled edge may extend over the crown towards the back region, and a portion of the first beveled edge may terminate within a back region of the helmet. At least a portion of the second beveled edge may originate in the fontal region of helmet, the second beveled edge may be adjacent to the edge or perimeter within the frontal region. Furthermore, the second beveled edge may extend over the crown towards the back region, and a portion of the second beveled edge may terminate at the edge or periphery within the back region of the helmet. In another embodiment, the second beveled edge may comprise a first portion, a second portion and a third portion. The first portion of the second beveled edge can originate from the edge or periphery within the back region of the helmet, and optionally extend at an oblique angle, the oblique angle being anywhere from 1 degree to 60 degrees. The second portion of the second beveled edge may extend from the first portion, the second portion may extend obliquely and/or perpendicularly or substantially perpendicular from the first portion, where the second portion may be parallel or substantially parallel to the edge or periphery the beveled edges and/or each of the at least two belts. "Substantially" may comprise 1-10 degrees change. The third portion of the second beveled edge can extend from the second portion, with the extension comprising an oblique angle from the second portion and/or substantially perpendicular, wherein the oblique angle may be approximately from 1 degrees to 60 degrees from the second portion, and optionally following the contours of each of the at least raised belts (right and left sides) over the crown region and extending to the frontal region. The third portion may terminate within the frontal region or at the edge or periphery of the helmet within the frontal region.

In another exemplary embodiment, the protective helmet may comprise a crown region, the crown region having a pair of raised lateral belts and a central region even with the circumference of the helmet. The central region may contain a first raised belt, a second raised belt, and an intermediate, centrally positioned belt. The intermediate belt can be positioned between and/or separated by the first and second raised belt. The intermediate belt may have a width, such as a width of approximately 0.50 inches to 4 inches. The first raised belt and the second raised belt may be raised relative to the external surface of the helmet. The intermediate belt may be recessed relative to the at least two raised belts, and/or the first and second raised belts and/or at least matches or substantially matches the external surface diameter of the helmet. At least a portion of the intermediate belt may be disposed within the frontal region of the helmet, and extending over the crown region of the helmet, and a portion of the intermediate belt may terminate within the back region of the helmet. In one specific embodiment, at least a portion of the intermediate belt may originate in the frontal region and is adjacent and/or proximate to an edge or periphery of the frontal region of the helmet. A length of the intermediate belt may be 1 to 7 inches. The first and second raised belts can be raised relative to the external surface diameter of the helmet. Each of the first and second raised belts may further comprise a first beveled edge and a second beveled edge. Alternatively, each of the at least two raised strips may further comprise a first beveled edge and a second beveled edge. The first beveled edge and the second beveled edge can be positioned on opposing sides of each of the at least two raised strips—e.g., on the right and left sides of each of the at least two raised belts. At least a portion of the first beveled edge may originate in the frontal region of helmet, with the first beveled edge being adjacent to the edge or perimeter within the frontal region. Furthermore, the first beveled edge may extend over a crown region towards the back region, with a portion of the first beveled edge terminating within a back region of the helmet. At least a portion of the second beveled edge may originate in the fontal region of helmet, the second beveled edge may be adjacent to the edge or perimeter within the frontal region. Furthermore, the second beveled edge may extend over the crown towards the back region, and a portion of the second beveled edge can terminate at the edge or periphery within the back region of the helmet.

In another embodiment, the second beveled edge may comprise a first portion, a second portion and a third portion. The first portion of the second beveled edge may originate from the edge or periphery within the back region of the helmet and extend at an oblique angle, the oblique angle being anywhere from 1 degree to 60 degrees. The second portion of the second beveled edge may extend from the first portion, the second portion may extend obliquely and/or perpendicularly or substantially perpendicular from the first portion, where the second portion may be parallel or substantially parallel to the edge or periphery the beveled edges and/or each of the at least two central belts. "Substantially" may comprise 1-10 degrees change. The third portion of the second beveled edge may extend from the second portion, the extension may comprise an oblique angle from the second portion and/or substantially perpendicular, with the oblique angle approximately from 1 degrees to 60 degrees from the second portion, and optionally following the contours of each of the at least raised belts (right and left sides) over the crown region and extends to the frontal region. The third portion may terminate within the frontal region or at the edge or periphery of the helmet within the frontal region.

Figure 1E:
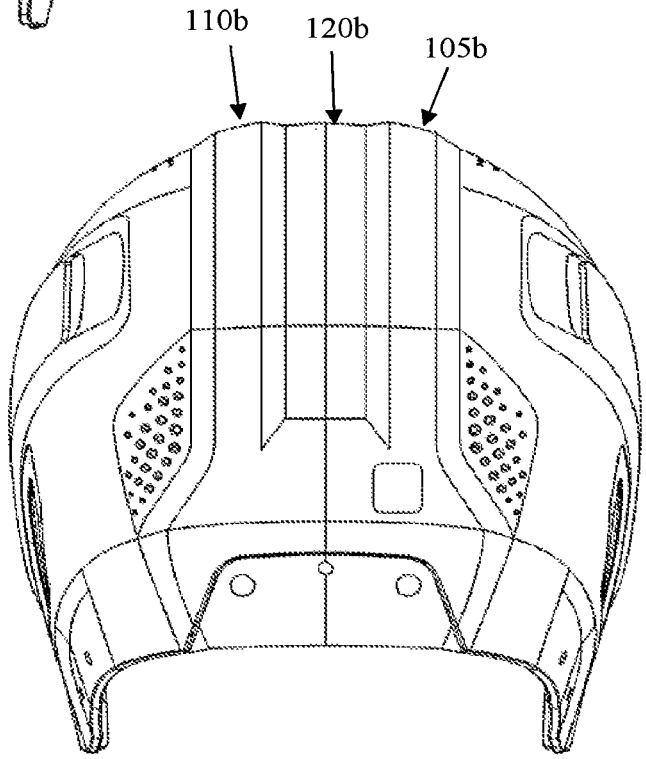
Figure 1F:
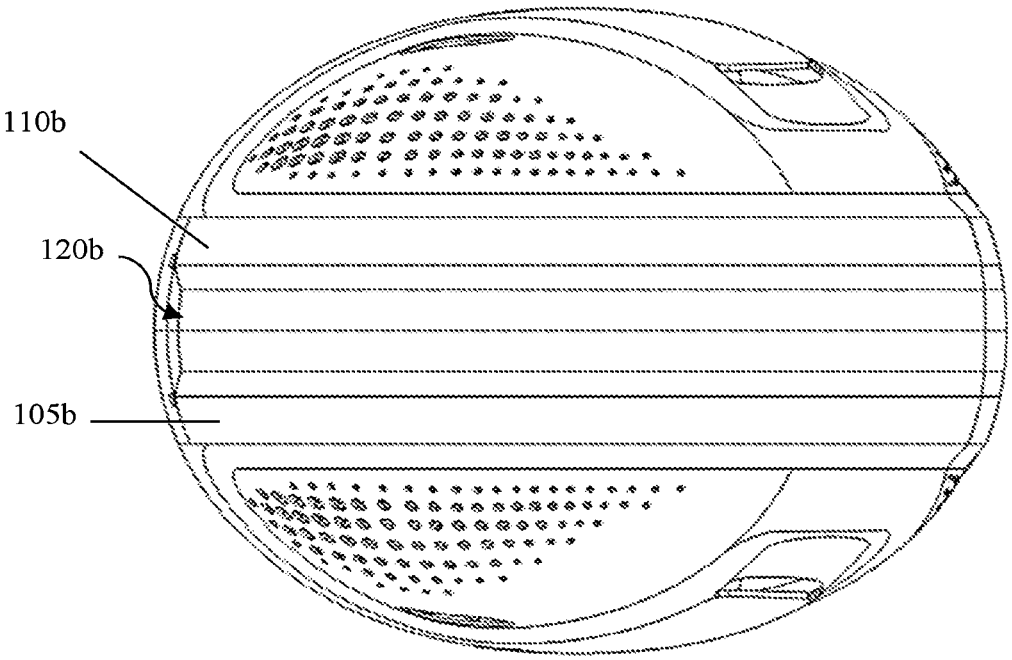
Figure 1G:
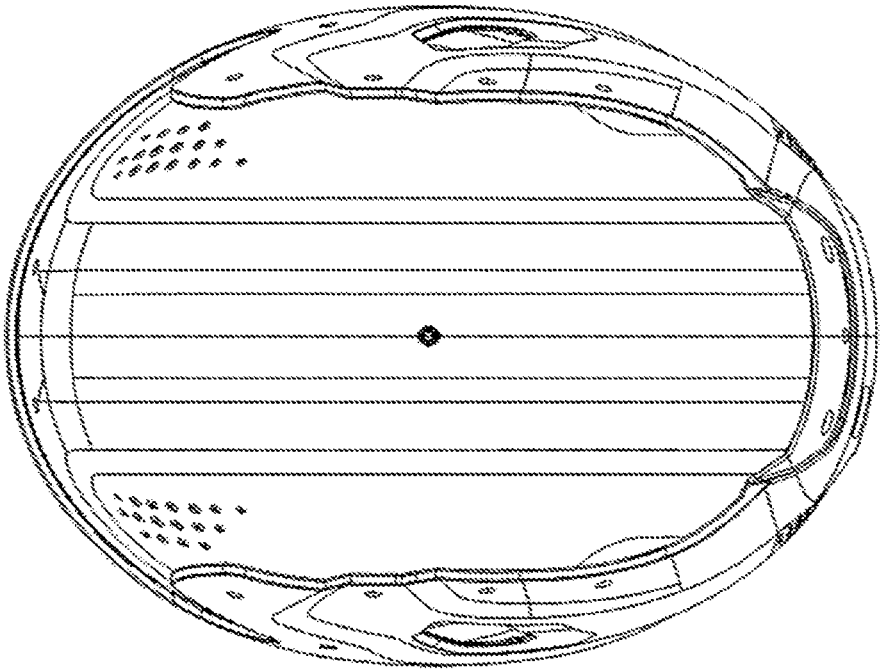
Figure 1H:
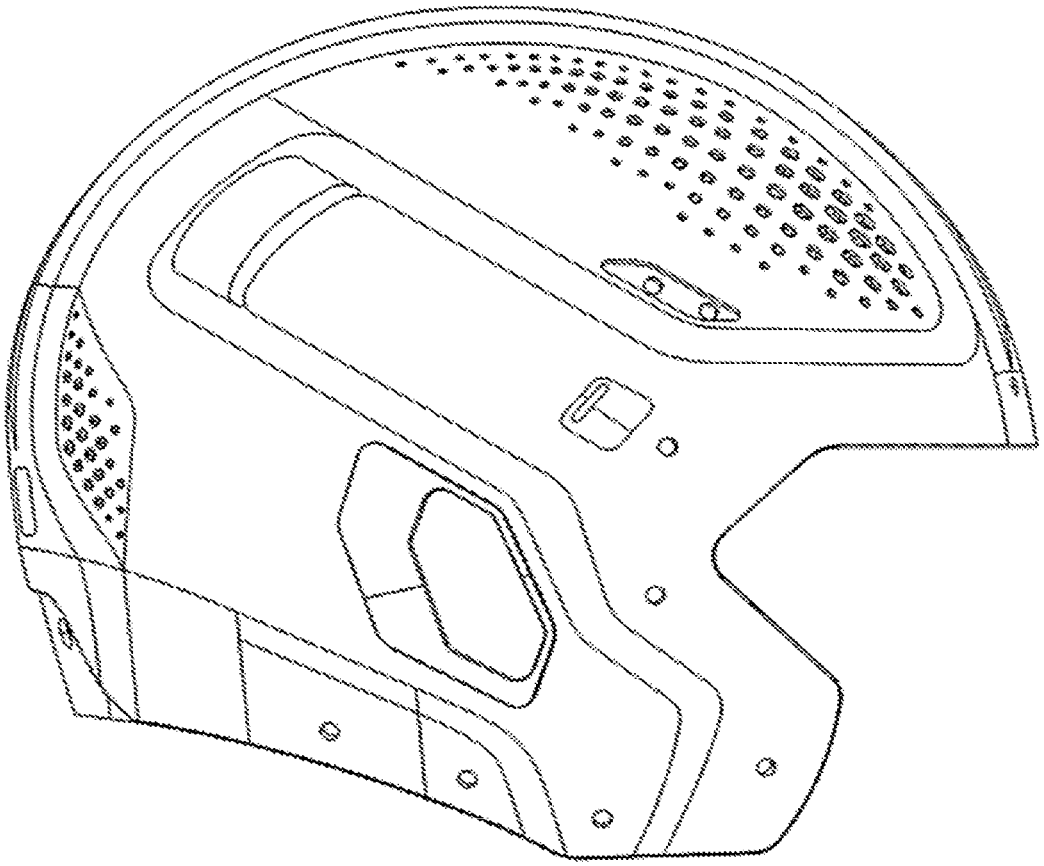

As best seen in FIG. 1H, a side region of the helmet may comprise a raised side belt (with corresponding structure or similar construction on both right and left sides of the helmet). The raised side belt may originate from the edge or periphery of the helmet face opening within the side region of the helmet and extending obliquely towards the back region of the helmet. The raised side band can have a width, with the width ranging from 1 inch to 3 inches. The raised side band may further comprise one or more vent openings and/or one or more chin strap openings. Furthermore, the raise side band may further comprise a chin strap recess, with the one or more chins strap openings disposed within the chinstrap recess. The chin strap opening may be sized and configured to receive at least a portion of the chinstrap band. The one or more chinstrap openings may be elongated openings. The at least one elongated vent opening may be used for ventilation, and/or be sized and configured to receive a portion of a chinstrap or other connection feature. The one or more vent openings may be elongated or other shapes. In at least one alternative embodiment, the raised side belt may comprise a main body, a first leg and a second leg. The main body can comprise one or more vent openings and/or one or more chin strap openings. Furthermore, the main body may further comprise a chin strap recess, the one or more chins strap openings disposed within the chinstrap recess. The chin strap opening may be sized and configured to receive at least a portion of the chinstrap band. The one or more chinstrap openings may be an elongated opening or other shaped openings. The one or more vent openings may be elongated. The main body, the first leg and the second leg may be raised relative to an outer surface of the helmet. In various embodiments, the first leg having a first end and a second end, the first end extending from the main body obliquely, and the second end mating or abutting a central section or raised strip within the frontal region. A portion of the main body can be parallel or substantially parallel to the edge or perimeter of the helmet within the frontal region. The second leg having a first end and a second end. The first end of the second leg extending from the main body, and extending obliquely, and following the contours the edge or periphery of the helmet within the side region. The second end of the second leg may terminate at the bottom edge or periphery of the side region, if desired.

As best seen in FIG. 1E, a back region of the helmet may comprise at least a portion of the central section 120*b* and/or the at least two raised bands 105*b* and 110*b*, a back bumper (not shown) and/or a recessed area. The back bumper may comprise one or more posts, the one or more posts being sized and/or configured to be disposed within a plurality of holes within the recessed area. The recessed area comprises the plurality of holes disposed within. The recessed area is sized and configured to receive the back bumper, the back bumper having a front surface and a back surface. The one or more posts of the back bumper can be inserted through the plurality of holes until the back surface of the bumper mates with the recessed area, with the back bumper thereby secured to the helmet.

The helmet may comprise a plurality of perforations, which can include vent openings as well as other openings in the helmet. The plurality of perforations can extend through the helmet shell from the external surface of the helmet through the inner surface of the helmet. Alternatively, the plurality of perforations may extend from the external surface of the helmet towards a portion of the inner surface of the helmet, namely an indentation and/or depression. The plurality of perforations and/or indentations may comprise a center, a diameter/width, the diameter/width being a range from 0.5 mm to 2 cm, if desired. The plurality of perforations may comprise a circle, a regular polygon, an irregular polygon, and/or any combination thereof, including (but not limited to) those shapes shown in FIGS. 6A through 6C. The plurality of perforations may the same size and shapes, and/or the plurality of perforations may be different sizes and shapes. The plurality of perforations may be positioned in a plurality of patterned repeating rows. Each of the patterned rows may be spaced apart from the adjacent or preceding patterned row. The spacing and/or bar width may the same and/or different from the adjacent or preceding patterned repeating row. Each of the plurality of patterned row may comprise different sizes and shapes. The plurality of perforations may vary in center, size, shape, spacing/bar width, diameter, perforations per square inch and/or any combinations thereof. The plurality of perforations may be disposed onto the helmet in a random, symmetrical pattern and/or an asymmetrical pattern. The plurality of perforation may be disposed on the outer shell in a straight line, with repeating rows that have an identical number of perforations in each preceding row. Alternatively, the plurality of perforations may be disposed on the outer shell in a staggered and/or offset pattern, with repeating rows that are diagonal, offset and/or staggered alignment from the adjacent or preceding rows. The offset and/or staggered alignment may be a 30 to 60 degree staggered or offset alignment. In another embodiment, the plurality of perforations may be disposed onto the outer shell in a custom pattern, where each repeating row is not identical to the adjacent or preceding row—it may not be identical with respect to size, shape, spacing, diameter, width, perforations per square inch, patterned rows, and/or any combination thereof. The plurality of perforations may follow the contours of the outer shell, being in an arched or arched pattern. The one or more vent openings may be disposed within the frontal region, side regions (right and left sides), crown region, back region, and/or any combination thereof.

In one embodiment, the outer shell may comprise a first plurality of perforations and a second plurality of perforations. The first plurality of perforations is positioned adjacent and/or proximate to the right and left sides of the central region. At least a portion of the first plurality of perforations can be disposed within the frontal region and extend to the side regions (right and left sides) of the helmet. At least a portion of the first plurality of perforations may terminate within the side regions. The first plurality of filaments can be positioned in patterned rows, where each of the patterned rows have a similar or the same spacing between the adjacent or preceding patterned row. The first plurality of filaments may follow the contours of the central section. The plurality of perforations within each of the patterned rows having a shape and size, the shape and size is different than the adjacent or preceding row. The second plurality of perforations can be disposed within the back region, the second plurality of perforations positioned adjacent and/or proximate to the right and left sides of the central region within the back region. The second plurality of filaments can be positioned in patterned rows, where each of the patterned rows have a similar or the same spacing between the adjacent or preceding patterned row. The first plurality of filaments may optionally follow the contours of the central region and/or any structures therein. The plurality of perforations within each of the patterned rows having a total number of perforations, a shape and a size, the total number of perforations, the shape and the size is different than the adjacent or preceding row. In another embodiment, the plurality of perforations may be disposed onto or adjacent to the at least two raised bands, on or adjacent to a central strip, and/or on or adjacent to the side band(s).

In another embodiment, the plurality of perforations and/or vent openings may be disposed on the outer shell to create a decorative pattern. The decorative pattern may comprise a custom shape, an object, a person, a logo, and/or any combination thereof. FIGS. 28A through 28L, 29A through 29I and 6A through 6C illustrate exemplary embodiments of different decorative patterns that may be disposed onto the outer shell, wherein the decorative pattern may optionally include functional openings in the helmet such as vent holes, mounting locations, sound transmission openings and/or the like.

Figure 6A:
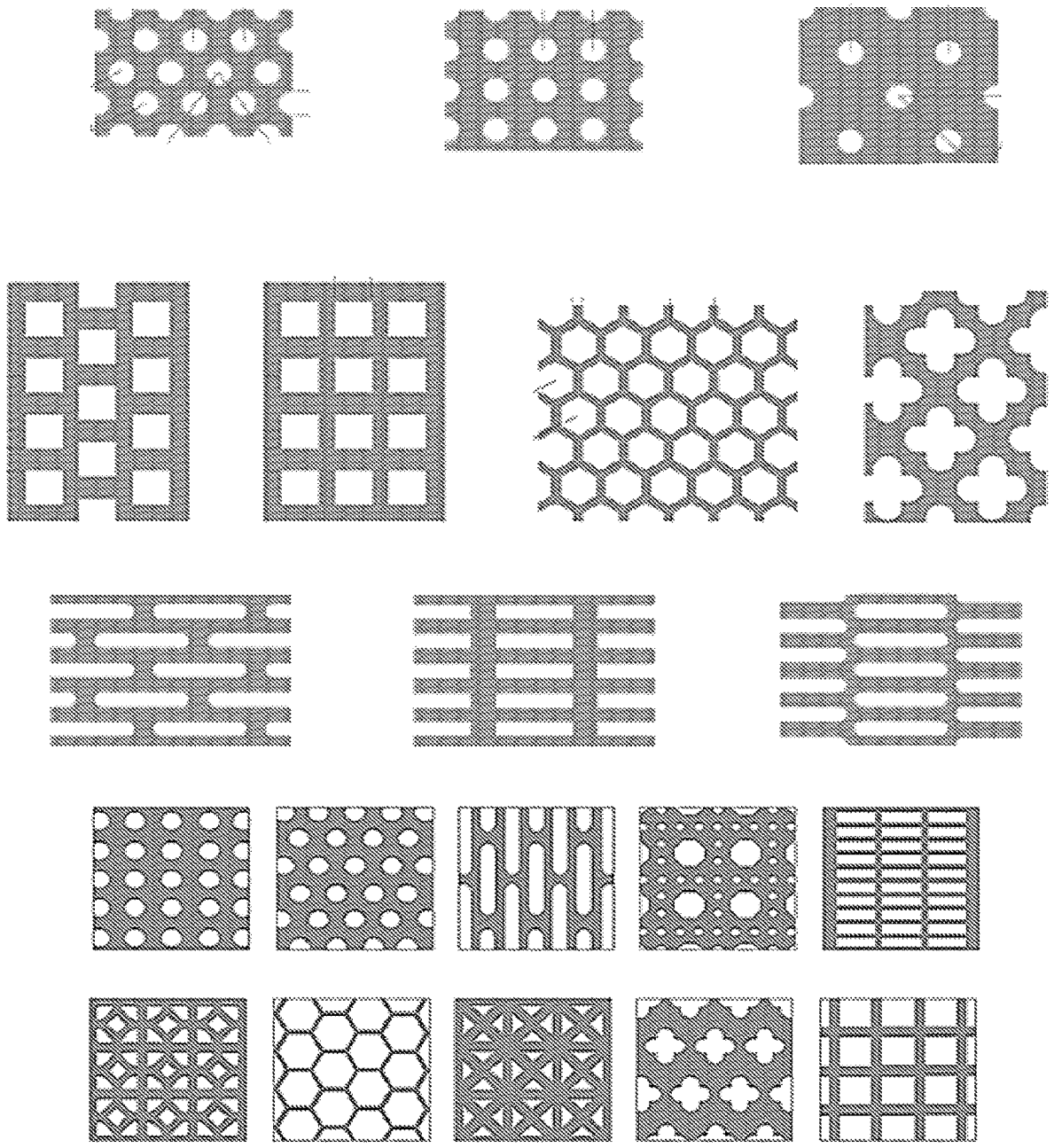
FIGS. 6A and 6B depict various exemplary perforation shapes, sizes and/or configurations that can be utilized in various embodiments of the disclosed inventions.
Figure 6B:
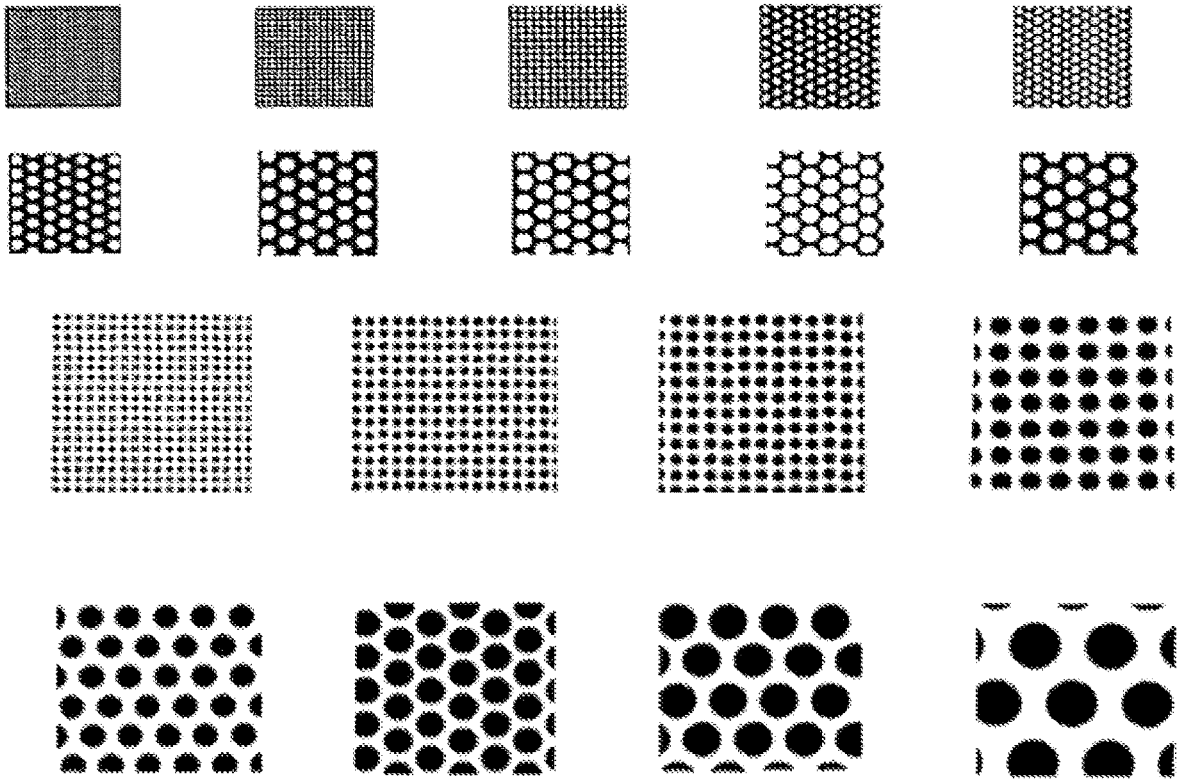
Figure 6C:
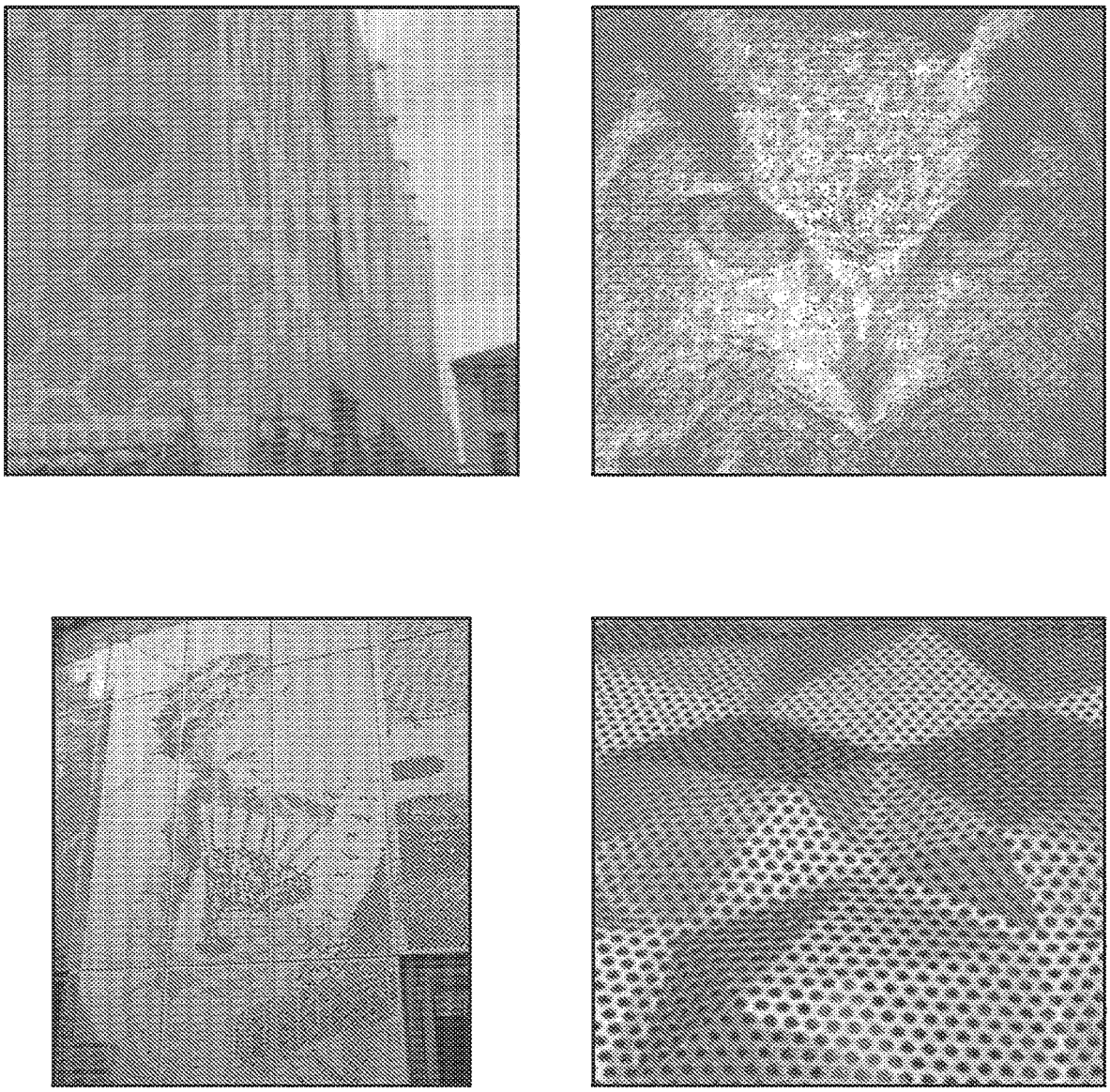
FIG. 6C depicts views of various representative decorative patterns that may be created on a helmet shell using a plurality of perforations.

In one embodiment, the outer shell may comprise a plurality of protrusions, the protrusions may comprise a portion that is raised or angled that are disposed onto the frontal region, side regions (right and left sides), crown region, back region, and/or any combination thereof (see FIG. 6C). The plurality of raised or angled portions may be in symmetrical patterned rows or asymmetrical patterned rows. The plurality of raised or angled portions are raised or angled from the external or outer surface of the outer shell. The plurality of raised or angled portions patterned rows may have a different height and/or different angle or the same angle or same height than the preceding and/or adjacent patterned row. Each of the plurality of raised and/or angled portions may comprise a plurality of perforations.

Figure 30:
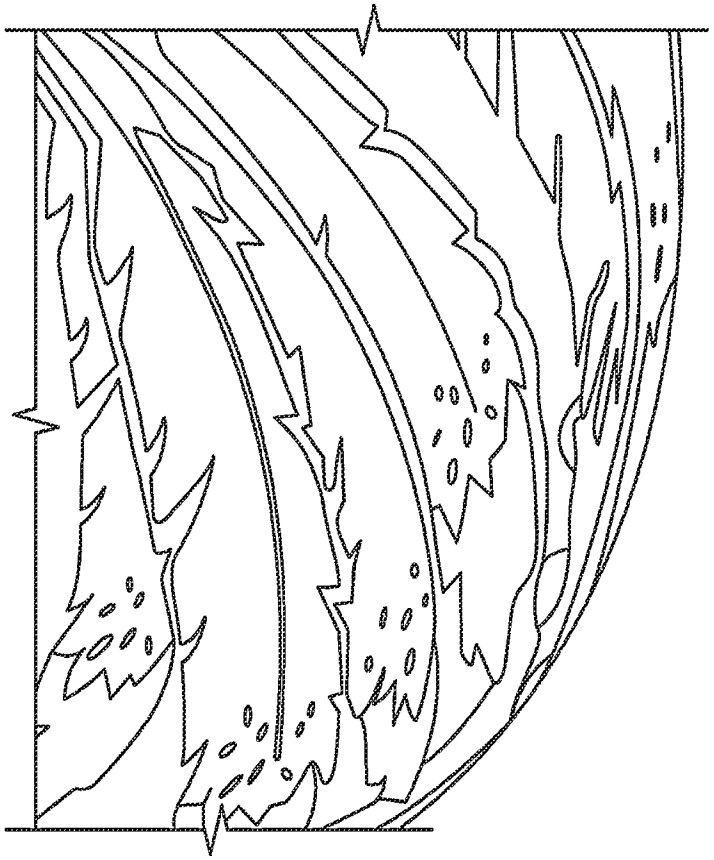
FIG. 30 depicts one exemplary embodiment of a helmet comprising a multi-layer outer shell which includes at least two layers of plastic or other materials. Wherein portions of the outer layer are removed to expose the inner layer.

FIG. 30 depicts one exemplary embodiment of a helmet comprising a multi-layer outer shell which includes at least two layers of plastic or other materials, wherein each layer comprises a different color, and the overlying layer(s) of the helmet can be removed, machined and/or "etched" to render the underlying layer(s) visible through the etched or machined "opening." In this arrangement, the various openings created may not extend completely through the outer shell in a variety of locations, which can result in a very complex and/or durable graphic design for the helmet, including the use of multiple colors and potentially three-dimensional design elements (if desired). In a manner similar to "Etch" drawings, virtually any design and/or feature could be incorporated into a helmet or other article in this manner.

In various alternative embodiments contemplated herein, an outer helmet shell could include micro perforations and or other structural elements with patterns on a tiny scale, which reflect light to make some wavelengths brighter and/or others darker. Such "structural color elements" formed into and/or on the helmet surface could comprise microscopically structured surfaces fine enough to interfere with visible light, which may be utilized alone or in combination with pigments to create a desired color and/or color combination. Such structures surfaces could include diffraction gratings, selective mirrors, photonic crystals, crystal fibers, thin film reflection, matrices of nanochannels, spiral coils, thin films with diffuse reflectors, surface gratings, deformed matrices, biomimetic surfaces and/or proteins, as well as others. If desired, the structural coloration could include variable structures, such as reversible proteins and/or reflection proteins, which could allow alteration of the design and/or graphical element, which could be useful for a variety of reasons, including military camouflage and/or a visual indication of player status (i.e., eligible receiver, hurt player, etc.).

Additional Configuration Considerations

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure. The invention may be embodied in other specific forms without departing from the spirit or essential characteristics thereof. The foregoing embodiments are therefore to be considered in all respects illustrative rather than limiting on the invention described herein. The scope of the invention is thus intended to include all changes that come within the meaning and range of equivalency of the descriptions provided herein.

Many of the aspects and advantages of the present invention may be more clearly understood and appreciated by reference to the accompanying drawings. The accompanying drawings are incorporated herein and form a part of the specification, illustrating embodiments of the present invention and together with the description, disclose the principles of the invention. Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the disclosure herein.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosed embodiments are intended to be illustrative, but not limiting, of the scope of the disclosure.

INCORPORATION BY REFERENCE

The entire disclosure of each of the publications, patent documents, and other references referred to herein is incorporated herein by reference in its entirety for all purposes to the same extent as if each individual source were individually denoted as being incorporated by reference.

What is claimed is:

1. A helmet assembly customizable to a topography of a player's head, the helmet assembly comprising:
- a helmet shell comprising:
  - an inner surface;
  - an outer surface; and
  - one or more functional openings from the inner surface to the outer surface through the helmet shell;
- an inner liner configured to be positioned within the helmet shell, the inner liner selected from a set of predetermined inner liners having different sizes;
- a plurality of pads configured to be coupled to the inner liner, the plurality of pads selected from a set of pads having predetermined sizes, the plurality of pads selected to accommodate the topography of the player's head within the helmet shell; and
- a sensor configured to collect data related to use of the helmet assembly, including at least one of speed, direction, and magnitude of impact experienced by the player while wearing the helmet assembly.

2. The helmet assembly of claim 1, wherein the sensor is positioned in a back portion of the helmet shell.

3. The helmet assembly of claim 2, wherein the sensor is configured to be associated with at least one of a particular player and a player position.

4. The helmet assembly of claim 1, wherein each pad of the plurality of pads comprises a smooth top surface and a planar configuration.

5. The helmet assembly of claim 4, wherein the plurality of pads include at least a frontal pad, a crown pad, a lower-back pad, a mid-back pad, a midline pad, and right and left temporal pads.

6. The helmet assembly of claim 4, wherein the plurality of pads comprise energy absorbing structures.

7. The helmet assembly of claim 1, further comprising:
- a facemask cage configured to be coupled to the helmet shell, the facemask cage comprising:
  - at least three horizontal bars configured to extend horizontally across a frontal opening in the helmet shell, and
  - one or more vertical bars extending between the at least three horizontal bars.

8. The helmet assembly of claim 7, wherein the one or more vertical bars comprise at least two vertical bars positioned symmetrically on the facemask cage.

9. The helmet assembly of claim 1, wherein the one or more functional openings are positioned in side portions of the helmet shell.

10. The helmet assembly of claim 9, wherein the one or more functional openings are functional vent openings.

11. A customizable helmet assembly for use by a player, comprising:
- a helmet shell comprising an inner surface and an outer surface, the helmet shell defining a frontal opening configured to be positioned over a face of the player, and at least a portion of the helmet shell configured to be flexible;

an inner liner configured to be positioned within the helmet shell;

a plurality of pads configured to be coupled to the inner liner, the plurality of pads selected from a set of pads having predetermined sizes, the plurality of pads selected to accommodate the actual size or shape of the player's head; and a facemask cage configured to be coupled to the helmet shell, the facemask cage comprising:

at least three horizontal bars configured to extend horizontally across the frontal opening in the helmet shell, and one or more vertical bars extending between the at least three horizontal bars;

wherein the helmet shell comprises one or more functional openings through the helmet shell.

12. The customizable helmet assembly of claim 11, wherein the helmet shell is manufactured in a single piece.

13. The customizable helmet assembly of claim 11, wherein the helmet shell comprises a raised medial strip.

14. The customizable helmet assembly of claim 11, further comprising:

a sensor configured to collect data including at least one of speed, direction, and magnitude of impact.

15. The customizable helmet assembly of claim 11, wherein the inner liner is selected from a set of predetermined inner liners having different sizes.

16. The customizable helmet assembly of claim 11, wherein at least one pad of the plurality of pads is selected so as to match a topography of the player's head within the helmet.

17. The customizable helmet assembly of claim 16, wherein each pad of the plurality of pads comprises a smooth top surface and a planar configuration.

18. The customizable helmet assembly of claim 17, wherein the plurality of pads include at least a frontal pad, a crown pad, a lower-back pad, a mid-back pad, a midline pad, and right and left temporal pads.

19. The customizable helmet assembly of claim 11, wherein the one or more vertical bars comprise at least two vertical bars positioned symmetrically on the facemask cage.

20. The customizable helmet assembly of claim 11, further comprising: a chin strap enclosure and adjustment mechanism.

* * * * *